US011697143B2

(12) United States Patent
Pale et al.

(10) Patent No.: US 11,697,143 B2
(45) **Date of Patent: *Jul. 11, 2023**

(54) METHOD OF MANUFACTURING TWO TUBES SIMULTANEOUSLY AND MACHINE FOR USE THEREIN

(71) Applicant: American Axle & Manufacturing, Inc., Detroit, MI (US)

(72) Inventors: John A. Pale, Troy, MI (US); David I. Alexander, Beverly Hills, MI (US); Mahaveer Khetawat, Sterling Heights, MI (US)

(73) Assignee: AMERICAN AXLE & MANUFACTURING, INC., Detroit, MI (US)

( * ) Notice: Subject to any disclaimer, the term of this patent is extended or adjusted under 35 U.S.C. 154(b) by 445 days.

This patent is subject to a terminal disclaimer.

(21) Appl. No.: 16/953,460

(22) Filed: Nov. 20, 2020

(65) Prior Publication Data

US 2021/0069765 A1 Mar. 11, 2021

Related U.S. Application Data

(63) Continuation of application No. 15/537,212, filed as application No. PCT/US2015/066368 on Dec. 17, 2015, now Pat. No. 10,864,566.

(Continued)

(51) Int. Cl.
*B21C 23/03* (2006.01)
*B21C 23/20* (2006.01)

(Continued)

(52) U.S. Cl.
CPC ..... *B21C 23/217* (2013.01); *B21C 1/26* (2013.01); *B21C 23/005* (2013.01);

(Continued)

(58) Field of Classification Search
CPC ..... B21C 1/26; B21C 23/005; B21C 23/008; B21C 23/035; B21C 23/085;

(Continued)

(56) References Cited

U.S. PATENT DOCUMENTS 1,712,259 A 5/1929 Davis
2,027,406 A 1/1936 Spatta (Continued)

FOREIGN PATENT DOCUMENTS

CN 1247109 A 3/2000
CN 1672863 A 9/2005

(Continued)

OTHER PUBLICATIONS

English language abstract and machine-assisted English translation for CN 1672863 A extracted from espacenet.com database on Mar. 21, 2022, 5 pages.

(Continued)

*Primary Examiner* — Teresa M Ekiert
(74) *Attorney, Agent, or Firm* — Howard & Howard Attorneys PLLC

(57) ABSTRACT

A method is used to manufacture a tube having a hollow interior for housing an axle shaft. The tube is formed in a single machine having a fixed base and a single press structure movable toward the fixed base. The single machine includes first and second die assemblies coupled to the fixed base and first and second mandrels coupled to the single press structure. The method includes the steps of placing a billet into the first die assembly, pressing the billet into the first die assembly with the first mandrel to producing a pre-formed billet, and moving the pre-formed billet from the first die assembly to the second die assembly. THE method further includes the steps of pressing the pre-formed billet into the second die assembly with the second mandrel to (Continued)

elongate the pre-formed billet and form a hollow interior therein to produce an extruded tube.

20 Claims, 33 Drawing Sheets

Related U.S. Application Data

(60) Provisional application No. 62/093,197, filed on Dec. 17, 2014, provisional application No. 62/093,193, filed on Dec. 17, 2014, provisional application No. 62/093,202, filed on Dec. 17, 2014.

(51) Int. Cl.

| | |
|---|---|
| ***B21C 23/10*** | (2006.01) |
| ***B21C 23/12*** | (2006.01) |
| ***B21C 23/00*** | (2006.01) |
| ***B21C 23/32*** | (2006.01) |
| ***B21C 23/08*** | (2006.01) |
| ***B21C 37/16*** | (2006.01) |
| ***B21C 23/21*** | (2006.01) |
| ***C21D 8/10*** | (2006.01) |
| ***B21K 1/06*** | (2006.01) |
| ***B21C 1/26*** | (2006.01) |
| ***B21K 1/26*** | (2006.01) |
| ***B21C 29/04*** | (2006.01) |
| *B21C 25/08* | (2006.01) |
| *B21C 29/00* | (2006.01) |
| *B21C 35/02* | (2006.01) |

(52) U.S. Cl.

CPC ..... *B21C 23/035* (2013.01); *B21C 23/10* (2013.01); *B21C 23/12* (2013.01); *B21C 23/205* (2013.01); *B21C 23/211* (2013.01); *B21C 23/215* (2013.01); *B21C 23/218* (2013.01); *B21C 23/32* (2013.01); *B21C 29/04* (2013.01); *B21K 1/063* (2013.01); *B21K 1/26* (2013.01); *C21D 8/10* (2013.01); *B21C 23/002* (2013.01); *B21C 23/085* (2013.01); *B21C 25/08* (2013.01); *B21C 29/003* (2013.01); *B21C 35/023* (2013.01); *B21C 37/16* (2013.01)

(58) Field of Classification Search

CPC ... B21C 23/205; B21C 23/215; B21C 23/217; B21C 23/218; B21C 23/10; B21C 23/12; B21C 23/211; B21C 23/32; B21C 23/002; B21C 25/08; B21C 35/023; B21K 1/063; B21K 1/26

See application file for complete search history.

(56) References Cited

U.S. PATENT DOCUMENTS

| | | | |
|---|---|---|---|
| 2,256,065 | A | 9/1941 | Urschel et al. |
| 2,363,635 | A | 11/1944 | Blair |
| 2,363,636 | A | 11/1944 | Bloch et al. |
| 2,672,234 | A | 3/1954 | Lorant |
| 2,988,211 | A | 6/1961 | Kent et al. |
| 3,011,220 | A | 12/1961 | Brochheuser et al. |
| 3,217,527 | A | 11/1965 | Elger |
| 3,230,540 | A | 1/1966 | Wilch et al. |
| 3,245,734 | A | 4/1966 | Jahani et al. |
| 3,345,853 | A | 10/1967 | Edgecombe et al. |
| 3,400,009 | A | 9/1968 | Khanfar |
| 3,439,672 | A | 4/1969 | Simon |
| 3,491,576 | A | 1/1970 | Oguri et al. |
| 3,534,578 | A | 10/1970 | Asari |
| 3,572,199 | A | 3/1971 | Creek et al. |
| 3,698,078 | A | 10/1972 | Prucher |
| 3,705,509 | A | 12/1972 | Haller |
| 3,735,996 | A | 5/1973 | Heussen et al. |
| 3,779,375 | A | 12/1973 | Mexoff |
| 3,802,238 | A | 4/1974 | Grant |
| 3,807,837 | A | 4/1974 | Mexoff |
| 3,837,205 | A | 9/1974 | Simon |
| 3,886,649 | A | 6/1975 | Simon |
| 3,927,449 | A | 12/1975 | Gibble et al. |
| 3,931,904 | A | 1/1976 | Jones et al. |
| 4,002,286 | A | 1/1977 | Simon |
| 4,208,900 | A | 6/1980 | Zawacki et al. |
| 4,220,277 | A | 9/1980 | Hesse et al. |
| 4,301,672 | A | 11/1981 | Simon |
| 4,435,972 | A | 3/1984 | Simon |
| 4,454,745 | A | 6/1984 | Cudini |
| 4,558,579 | A | 12/1985 | Petkov et al. |
| 4,616,500 | A | 10/1986 | Alexoff |
| 4,803,880 | A | 2/1989 | Hopkins et al. |
| 4,982,592 | A | 1/1991 | Simon |
| 5,054,184 | A | 10/1991 | Gerard |
| 5,184,494 | A | 2/1993 | Krude |
| 5,205,464 | A | 4/1993 | Simon |
| 5,213,250 | A | 5/1993 | Simon |
| 5,303,985 | A | 4/1994 | Barnholt et al. |
| 5,320,580 | A | 6/1994 | Simon |
| 5,522,246 | A | 6/1996 | Simon |
| 5,709,021 | A | 1/1998 | DiCello et al. |
| 6,001,018 | A | 12/1999 | Breese |
| 6,230,540 | B1 | 5/2001 | Wilch et al. |
| 6,439,672 | B1 | 8/2002 | Simon |
| 6,572,199 | B1 | 6/2003 | Creek et al. |
| 6,698,078 | B2 | 3/2004 | Prucher |
| 6,735,996 | B2 | 5/2004 | Heussen et al. |
| 6,779,375 | B1 | 8/2004 | Alexoff |
| 6,807,837 | B1 | 10/2004 | Alexoff |
| 6,931,904 | B2 | 8/2005 | Jones et al. |
| 7,234,223 | B2 | 6/2007 | Liu |
| 7,334,312 | B2 | 2/2008 | Bucholtz et al. |
| 7,412,866 | B2 | 8/2008 | Jahani et al. |
| 7,537,290 | B2 | 5/2009 | Tye et al. |
| 7,568,286 | B2 | 8/2009 | Platner |
| 7,644,601 | B2 | 1/2010 | Brochheuser et al. |
| 7,681,426 | B2 | 3/2010 | Main et al. |
| 7,866,759 | B2 | 1/2011 | Jahani et al. |
| 8,011,220 | B2 | 9/2011 | Brochheuser et al. |
| 8,245,734 | B2 | 8/2012 | Jahani et al. |
| 9,400,009 | B2 | 7/2016 | Khanfar |
| 10,843,246 | B2 | 11/2020 | Pale et al. |
| 2004/0213487 | A1 | 10/2004 | Matsuura |
| 2006/0131949 | A1 | 6/2006 | Jahani et al. |
| 2006/0185148 | A1 | 8/2006 | Bucholtz et al. |
| 2007/0062241 | A1 | 3/2007 | Main et al. |
| 2007/0137277 | A1 | 6/2007 | Tye et al. |
| 2009/0038364 | A1 | 2/2009 | Jahani et al. |
| 2010/0139356 | A1 | 6/2010 | Brochheuser et al. |
| 2011/0070385 | A1 | 3/2011 | Jahani et al. |
| 2012/0267945 | A1 | 10/2012 | Jahani et al. |
| 2013/0192330 | A1 | 8/2013 | Dohmann et al. |
| 2013/0264123 | A1 | 10/2013 | Altschuler et al. |
| 2014/0053623 | A1 | 2/2014 | Hebrard |
| 2014/0208818 | A1 | 7/2014 | Leicht et al. |
| 2015/0285295 | A1 | 10/2015 | Khanfar et al. |
| 2015/0285296 | A1 | 10/2015 | Simon et al. |
| 2016/0101452 | A1 | 4/2016 | Kraft et al. |
| 2017/0361367 | A1 | 12/2017 | Pale et al. |
| 2018/0001364 | A1 | 1/2018 | Pale et al. |

FOREIGN PATENT DOCUMENTS

| | | | |
|---|---|---|---|
| CN | 100431775 | C | 11/2008 |
| CN | 101873900 | A | 10/2010 |
| CN | 202224535 | U | 5/2012 |
| CN | 202506688 | U | 10/2012 |
| CN | 103230951 | A | 8/2013 |
| CN | 103537509 | A | 1/2014 |
| CN | 104084446 | A | 10/2014 |
| CN | 203917546 | U | 11/2014 |
| DE | 502426 | C | 7/1930 |

(56) References Cited

FOREIGN PATENT DOCUMENTS

| | | | |
|---|---|---|---|
| DE | 842039 | C | 6/1952 |
| DE | 1452498 | A1 | 3/1969 |
| DE | 2905961 | A1 | 8/1980 |
| EP | 1177843 | A2 | 2/2002 |
| GB | 964009 | A | 7/1964 |
| GB | 1204167 | A | 9/1970 |
| GB | 1329225 | A | 9/1973 |
| GB | 2169231 | A | 7/1986 |
| KR | 20110070483 | A | 6/2011 |
| KR | 101137626 | B1 | 4/2012 |
| WO | 9703769 | A1 | 2/1997 |
| WO | 2016100642 | A1 | 6/2016 |
| WO | 2016100661 | A1 | 6/2016 |
| WO | 2016100675 | A1 | 6/2016 |

OTHER PUBLICATIONS

English language abstract and machine-assisted English translation for CN 104084446 A extracted from espacenet.com database on Mar. 21, 2022, 7 pages.

English language abstract and machine-assisted English translation for CN 101873900 extracted from espacenet.com database on Oct. 31, 2018, 10 pages.

English language abstract and machine-assisted English translation for CN 103230951 extracted from espacenet.com database on Jul. 9, 2018, 10 pages.

English language abstract and machine-assisted English translation for CN 103537509 extracted from espacenet.com database on Jul. 9, 2018, 26 pages.

English language abstract and machine-assisted English translation for CN 1247109 extracted from espacenet.com database on Jul. 9, 2018, 11 pages.

English language abstract and machine-assisted English translation for CN 202224535 extracted from espacenet.com database on Oct. 17, 2018, 21 pages.

English language abstract and machine-assisted English translation for CN 202506688 extracted from espacenet.com database on Oct. 17, 2018, 7 pages.

English language abstract and machine-assisted English translation for CN 203917546 extracted from espacenet.com database on Oct. 17, 2018, 13 pages.

English language abstract and machine-assisted English translation for DE 29 05 961 extracted from espacenet.com database on Jul. 26, 2018, 6 pages.

English language abstract and machine-assisted English translation for KR 2011-0070483 extracted from espacenet.com database on Jul. 26, 2018, 10 pages.

English language abstract for CN 100431775 extracted from espacenet.com database on Jul. 26, 2018, 1 page.

English language translation of relevant portion of "Axle Type and Dimensional Standards for Vehicles TB450-79", Dec. 31, 1980, provided by CCPIT Patent and Trademark Law Office on May 5, 2019, 1 page; and Chinese language document: "Axle Type and Dimensional Standards for Vehicles TB450-79", Dec. 31, 1980, pp. 38-44.

International Search Report for Application No. PCT/US2015/066337 dated Mar. 3, 2016, 2 pages.

International Search Report for Application No. PCT/US2015/066368 dated Mar. 3, 2016, 2 pages.

International Search Report for Application No. PCT/US2015/066394 dated Feb. 22, 2016, 2 pages.

Machine-assisted English translation for DE 502 426 extracted from espacenet.com database on Sep. 5, 2018, 4 pages.

Machine-assisted English translation for DE 842 039 extracted from espacenet.com database on Sep. 5, 2018, 4 pages.

Partial English language translation for DE 1 452 498 provided by HGF Limited on Jul. 26, 2018, 1 page.

English language abstract and machine-assisted English translation for KR 101137626 B1 extracted from espacenet.com database on Mar. 11, 2021, 8 pages.

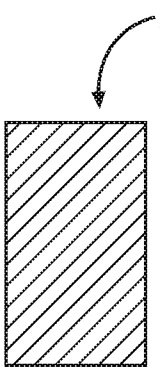
FIG. 1
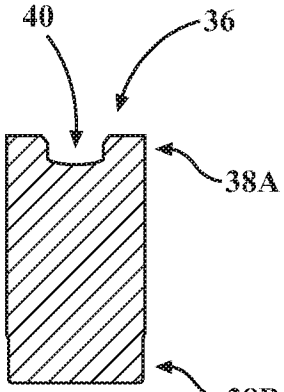
FIG. 2
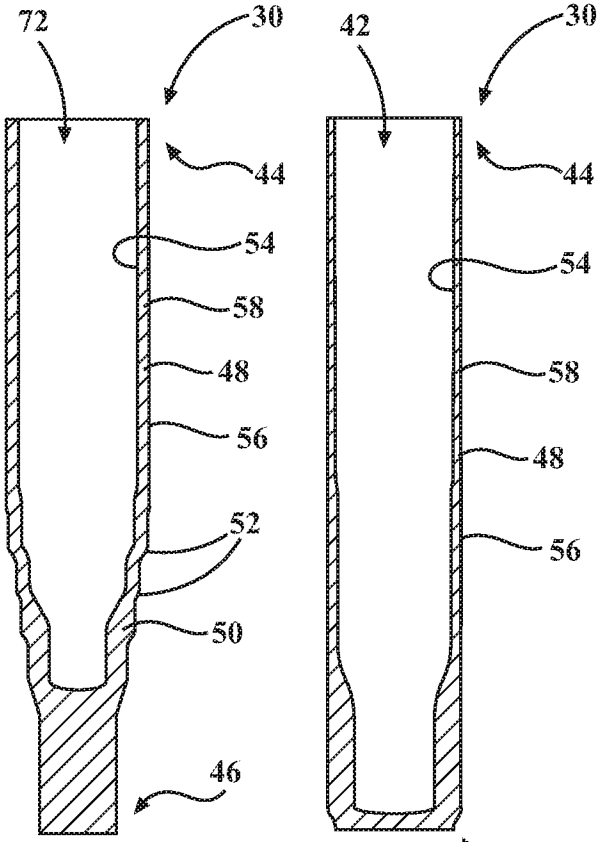
FIG. 3A
FIG. 3B
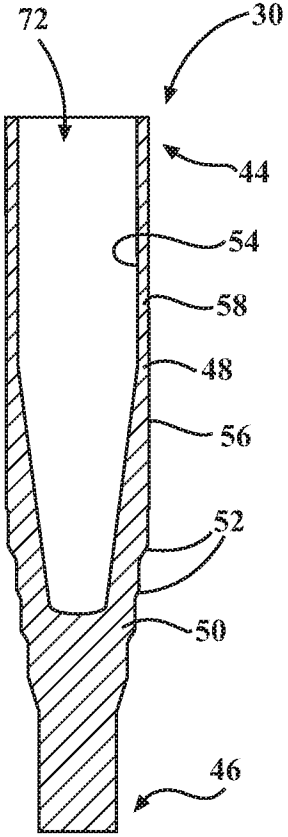
FIG. 3C
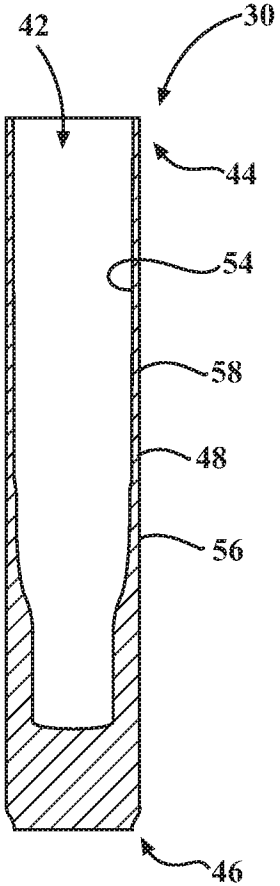
FIG. 3D

METHOD OF MANUFACTURING TWO TUBES SIMULTANEOUSLY AND MACHINE FOR USE THEREIN

RELATED APPLICATIONS

The present application is a continuation of U.S. patent application Ser. No. 15/537,212, filed on Jun. 16, 2017, which is the National Stage of International Patent Application No. PCT/US0215/066368, filed on Dec. 17, 2015, which claims priority to and all advantages of U.S. Provisional Patent Application Nos. 62/093,193, 62/093,197, and 62/093,202, each of which were filed on Dec. 17, 2014, the disclosures of which are specifically incorporated by reference in their entirety.

BACKGROUND

The present disclosure relates to a method of manufacturing a tube and a machine for use therein.

Conventional tubes used for housing an axle shaft of a vehicle are formed using multiple machines to transform simple tubes into the conventional tubes. More specifically, a conventional tube is made from a single simple tube that goes through multiple steps to be transformed into the conventional tube. Typically, each of the multiple steps used to transform the single simple tube into the conventional tube is performed in separate machines. For example, the single simple tube may be extruded by one machine and then drawn in a completely separate machine. Additionally, the spindle end of the tube is also manufactures in yet another machine and subsequently welded to the simple tube to complete the conventional tube. Often time, the different machines are located in different areas of a manufacturing plant or may be located in another manufacturing plant all together.

Because the production of the conventional tube requires multiple machines, additional steps of heating or lubricating parts after the parts are processed by one machine but before another machine can process them. As such, the process of manufacturing the conventional tube from a single simple tube is time consuming as the parts are moved between separate machines and subjected to additional steps of heating or lubricating the parts. As such, there remains a need to improve the production process to minimize the manufacturing time to transform a single simple tube into a tube for housing an axle shaft.

SUMMARY AND ADVANTAGES

One embodiment is directed toward a method of manufacturing a tube. The tube has a hollow interior for housing an axle shaft that transmits rotational motion from a prime mover to a wheel of a vehicle. The tube is formed in a single machine having a fixed base and a single press structure movable toward the fixed base. The single machine includes a first die assembly coupled to the fixed base, a second die assembly coupled to the fixed base, a first mandrel coupled to the single press structure, and a second mandrel coupled to the single press structure and spaced from the first mandrel. The method includes the steps of placing a billet into a cavity of the first die assembly, pressing the billet into the cavity of the first die assembly with the first mandrel coupled to the single press structure to form a bore at one end of the billet thereby producing a pre-formed billet, moving the pre-formed billet from the cavity of the first die assembly to a cavity of the second die assembly, and pressing the pre-formed billet into the cavity of the second die assembly with the second mandrel coupled to the single press structure to elongate the pre-formed billet and form a hollow interior therein thereby producing an extruded tube. By manufacturing the tube in a single machine according to the method, a manufacturing time to produce the tube is greatly reduced relative to conventional methods that require parts be moved to various machines to form a conventional tube.

BRIEF DESCRIPTION OF THE DRAWINGS

Other advantages of the disclosed subject matter will be readily appreciated, as the same becomes better understood by reference to the following detailed description when considered in connection with the accompanying drawings wherein:

FIG. 1 is a cross-sectional view of a billet.

FIG. 2 is a cross-sectional view of a pre-formed billet.

FIG. 3A is a cross-sectional view of an extruded tube used to manufacture a full-float axle tube.

FIG. 3B is a cross-sectional view of the extruded tube used to manufacture a semi-float axle tube.

FIG. 3C is a cross-sectional view of a preliminarily extruded tube used to manufacture a full-float axle tube.

FIG. 3D is a cross-sectional view of the preliminarily extruded tube used to manufacture a semi-float axle tube.

DETAILED DESCRIPTION

The present disclosure is related to manufacturing an article from a starting component. For example, the article may be a tube for housing an axle shaft of a vehicle. The axle shaft transmits rotational motion from a prime mover, such as an engine or electric motor, to a wheel of a vehicle. Other possible examples of the article include drive shafts, gas cylinders, and CV joints.

It is to be appreciated that, depending on the steps used to manufacture the tube, the tube may be referred to as an extruded tube 30 or a drawn tube 32. For example, when the tube is formed by extrusion, the tube is referred to as the extruded tube 30. When the tube is additionally formed by drawing, the tube is referred to as the drawn tube 32.

Figure 5A:
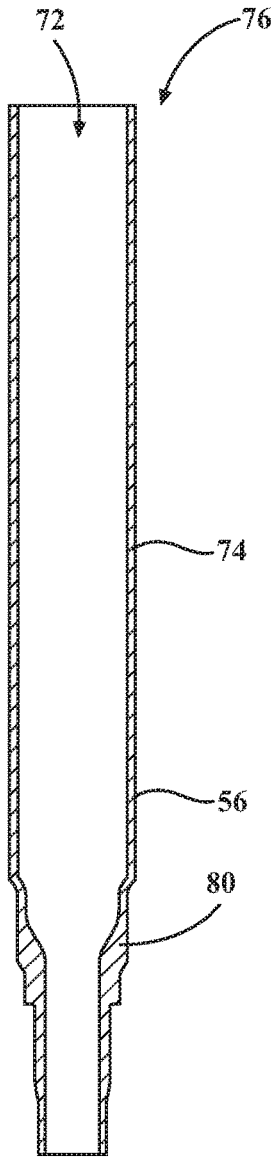
FIG. 5A is a cross-sectional view of the drawn tube as a full-float axle tube.
Figure 5B:
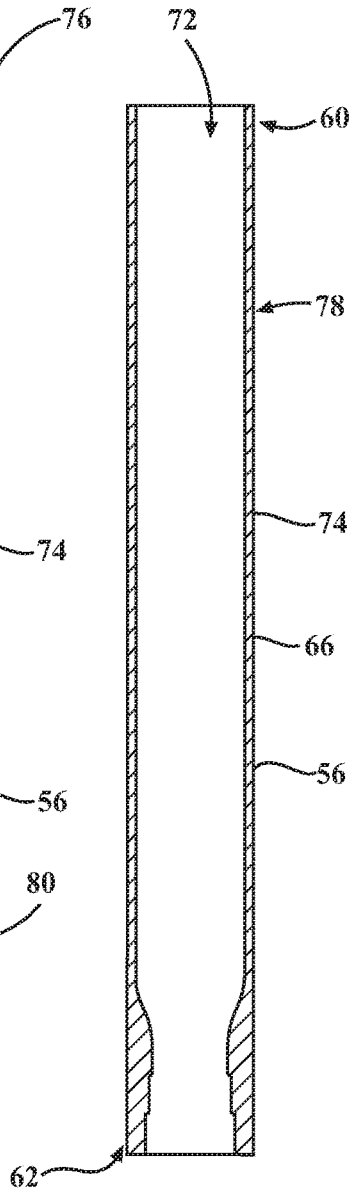
FIG. 5B is a cross-sectional view of the drawn tube as a semi-float axle tube.

Additionally, the tube may be further defined as a full-float axle tube 76, generally shown in FIG. 5A or a semi-float axle tube 78, generally shown in FIG. 5B. Generally, the difference between the full-float axle tube 76 and the semi-float axle tube 78 is the load bearing capabilities of the axle within the tube. Generally, the axle within the semi-float axle tubes 78 carries the load and torque and the axle within the full-float axle tubes 76 only carries the torque. For convenience, similar features between the full-float axle tube 76 and the semi-float axle tube 78 are identified by the same terms and reference numerals herein and in the Figures.

Referring to the Figures, wherein like numerals indicate like or corresponding parts throughout the several views, a billet 34 is generally shown in cross-section in FIG. 1. Generally, the extruded tube 30 and the drawn tube 32 are manufactured from the billet 34. Said differently, when the article is either the extruded tube 30 or the drawn tube 32, the starting component is the billet 34. The billet 34 typically has a cylindrical configuration with a solid cross-section. Said differently, the billet 34 is not a tube. Said yet another way, the billet 34 lacks an internal void space. It is to be appreciated that the billet 34 may have any suitable configuration besides cylindrical, such as rectangular. The billet 34 typically comprises a material selected from the group of low carbon alloy steels, plain carbon steels, and combinations thereof. The material of the billet 34 is typically selected based on the desired properties of the tube. Generally, the material of the billet 34 is selected based on the material's work hardening properties and ability to be welded. Examples of suitable material for the billet 34 include SAE 15V10, SAE 15V20, and SAE 15V30. It is to be appreciated that the carbon content of the material of the billet 34 may vary from of about 0.1 to about 0.4 percent based on a total weight of the material.

With reference to FIG. 2, a pre-formed billet 36 is shown in cross-section. The pre-formed billet 36 has a pair of ends 38A, 38B. One end 38A of the pre-formed billet 36 defines a bore 40. The other end 38B of the pre-formed billet 36 may have a reduced cross-sectional width. Overall, the pre-formed billet 36 still has the cylindrical configuration. The bore 40 is created in the billet 34 to transform the billet 34 into the pre-formed billet 36. The bore 40 has a diameter that can vary depending on the subsequent forming steps and depending on the final product to be produced, such as the full-float or semi-float axle tubes 78.

With reference to FIGS. 3A and 3B, the extruded tube 30 is shown in cross-section. Notably, the extruded tube 30 shown in FIG. 3A is for making the full-float axle tube 76 and the extruded tube shown in FIG. 3B is for making the semi-float axle tube 78. The extruded tube 30 is generally formed by elongating the pre-formed billet 36 and extending the bore 40 of the pre-formed billet 36 to define a hollow interior 42 of the extruded tube 30. As such, the extruded tube 30 has an open end 44 and a wheel end 46. The extruded tube 30 has a length, which is typically of from about 275 to about 700 millimeters. More typically, when the extruded tube 30 is the full-float axle tube 76, its length is about 500 to about 700 millimeters. When the extruded tube 30 is the semi-float axle tube 78, its length is about 350 to about 600 millimeters. The extruded tube 30 has an extruded body portion 48 having a substantially consistent diameter. The extruded body portion 48 extends from the open end 44 of the extruded tube 30.

As shown in FIG. 3A, when the extruded tube 30 is the full-float axle tube 76, the extruded tube 30 has an extruded necked portion 50 adjacent the extruded body portion 48. The extruded necked portion 50 has a diameter that is smaller than the diameter of the extruded body portion 48. The extruded necked portion 50 also has a plurality of shoulders 52 where the diameter of the extruded necked portion 50 is reduced. For example, the extruded necked portion 50 has a stepped configuration with the shoulders 52 defining each step of the stepped configuration. The wheel end 46 of the extruded tube 30 is adjacent the extruded necked portion 50. The wheel end 46 has a solid cross-section.

When the extruded tube 30 is the full-float axle tube 76, the hollow interior 42 of the extruded tube 30 extends from the open end 44 into the extruded necked portion 50 towards the wheel end 46 and the wheel end 46 is closed. When the extruded tube 30 is the semi-float tube 78, the hollow interior 42 extends from the open end 44 to the wheel end 46 with the wheel end 46 closed. During subsequent machining, the wheel end 46 of both the full-float axle tube 76 and the semi-float axle tube 78 is opened such that the hollow interior 42 extends from the open end 44 to the wheel end 46.

An interior surface 54 of the extruded tube 30 defines the hollow interior 42. The extruded tube 30 also has an exterior surface 56 opposite the interior surface 54 of the extruded tube 30. An extruded wall 58 of the extruded tube 30 is defined between the interior surface 54 and the exterior surface 56 of the extruded tube 30. The extruded wall 58 has a thickness. Generally, the thickness of the extruded wall 58 is substantially consistent in the extruded body portion 48. Typically, the thickness of the extruded wall 58 in the extruded body portion 48 is of from about 5 to about 16 millimeters, more typically of from about 5 to about 12 millimeters. In the full-float axle tube 76, the thickness of the extruded wall 58 in the extruded necked portion 50 varies and tends to be thicker than the thickness of the extruded wall 58 in the extruded body portion 48. In the semi-float axle tube 78, the thickness of the extruded wall 58 may be thicker at the wheel end 46 relative to the extruded body portion 48.

In one embodiment described in greater detail below, a preliminarily extruded tube 126 is formed prior to the formation of the extruded tube 30. Said different, extruded tube 30 formed upon the completion of at least two extrusions. FIGS. 3C and 3D show the preliminarily extruded tube 126. Notably, the preliminarily extruded tube 126 shown in FIG. 3C is for the full-float axle tube 76 and the preliminarily extruded tube 126 shown in FIG. 3D is for the semi-float axle tube 78. The purpose of the preliminarily extruded tube 126 will be better understood through further description below.

Figure 4A:
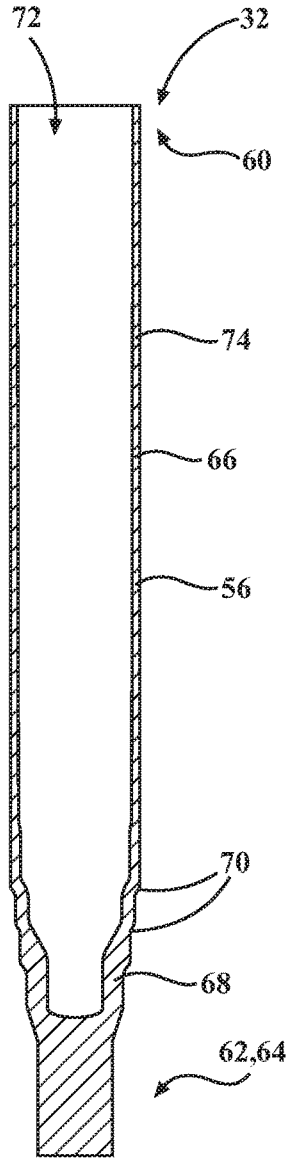
FIG. 4A is a cross-sectional view of a drawn tube used to manufacture the full-float axle tube.
Figure 4B:
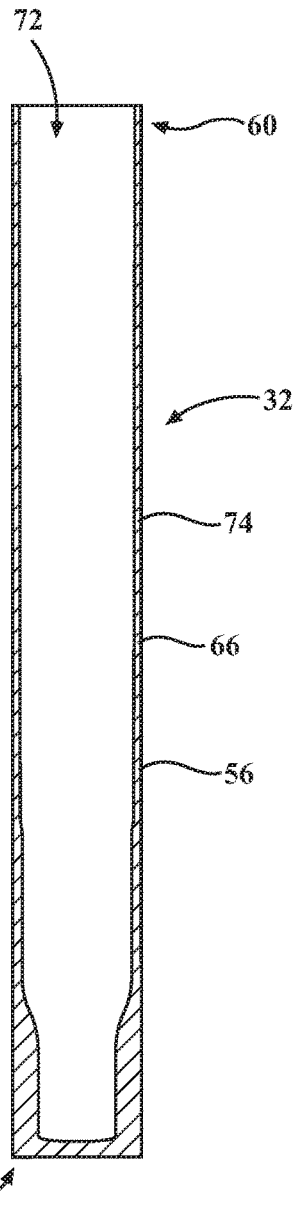
FIG. 4B is a cross-sectional view of the drawn tube used to manufacture the semi-float axle tube.

With reference to FIGS. 4A and 4B, the drawn tube 32 is shown in cross-section. Notably, the extruded tube 30 shown in FIG. 4A is for the full-float axle tube 76 and the extruded tube 30 shown in FIG. 4B is for the semi-float axle tube 78. The drawn tube 32 is generally formed by further elongating the extruded tube 30 and extending the hollow interior 42 of the extruded tube 30. Similar to the extruded tube 30, the drawn tube 32 has an open end 60 and a wheel end 62. The drawn tube 32 has a length, which is typically of from about 400 to about 1,000 millimeters. More specifically, when the drawn tube 32 is the full-float axle tube 76 its length is of from about 600 to 1,000 millimeters, more typically from about 600 to 900 millimeters, and more typically of from about 600 to about 850 millimeters. When the drawn tube 32 is the semi-float axle tube 78, its length is of from about 400 to about 900 millimeters and more typically of from about 600 to about 780 millimeters. The drawn tube 32 can be a single component. Said differently, the drawn tube 32 is formed as a one-piece tube. As such, the drawn tube 32 is free of joints, which are common when combining two components by welding.

Generally, when the drawn tube 32 is the full-float axle tube 76, the wheel end 62 of the drawn tube 32 is referred to as a spindle end 64 of the drawn tube 32. When present, the spindle end 64 of the drawn tube 32 is integral with the drawn body portion 66 such that the spindle end 64 cannot be separated from the drawn body portion 66. The drawn tube 32 has a drawn body portion 66 having a substantially consistent diameter. The drawn body portion 66 extends from the open end 60 of the drawn tube 32. When the drawn tube 32 is the full-float axle tube 76, the drawn tube 32 has a drawn necked portion 68 adjacent the drawn body portion 66. The drawn necked portion 68 has a diameter that is smaller than the diameter of the drawn body portion 66. The drawn necked portion 68 also has a plurality of shoulders 70 where the diameter of the drawn necked portion 68 is reduced. The spindle end 64 of the drawn tube 32 is adjacent the drawn necked portion 68. The spindle end 64 has a solid cross-section.

A hollow interior 72 of the drawn tube 32 extends from the open end 60 towards the wheel end 62. In the full-float axle tube 76, the hollow interior 72 extends into the drawn necked portion 68 and extends through the drawn tube 32 such that the wheel end 62 is open. Typically, the wheel end 62 is machined to create the opening at the wheel end 62 such that the hollow interior 72 extends through the drawn tube 32. In the semi-float axle tube 78, the hollow interior 72 does not extend through the drawn tube 32 such that the wheel end 62 is closed. However, the wheel end 62 is machined to create the opening at the wheel end 62 such that the hollow interior 72 extends through the drawn tube 32.

The drawn tube 32 has a drawn wall 74 having a thickness. Generally, the thickness of the drawn wall 74 is substantially consistent in the drawn body portion 66. However, as a result of elongating the extruded tube 30 to form the drawn tube 32, the thickness of the drawn wall 74 is reduced relative to the thickness of the extruded wall 58.

Typically, the thickness of the drawn wall 74 is of from about 3 to about 18 millimeters, more typically of from about 3 to about 10 millimeters, and even more typically of from about 3 to about 8 millimeters. It is to be appreciated that the thickness of the drawn wall 74 in the drawn body portion 66 may vary depending on the application and the type of tube produced. For example, when the tube is the full-float axle tube 76 the thickness of the drawn wall 74 in the drawn body portion 66 is typically of from about 4 to about 10 millimeters, more typically or from about 4 to about 8 millimeters, and even more typically of from about 4 to about 7 millimeters for medium duty applications. Additionally, when the tube is the full-float axle tube 76 the thickness of the drawn wall 74 in the drawn body portion 66 is typically of from about 6 to about 18 millimeters, more typically or from about 6 to about 14 millimeters, even more typically of from about 6 to about 10 millimeters, and yet even more typically less than 8 millimeters for heavy duty applications. When the tube is the semi-float axle tube 78 the thickness of the drawn wall 74 in the drawn body portion 66 is typically of from about 3 to about 10 millimeters, more typically of from about 3 to about 8 millimeters, even more typically of from about 3 to about 6 millimeters, and yet even more typically less than 4.5 millimeters for light duty applications. It is to be appreciated that the term light duty generally refers to pick-up trucks and SUVs, the term medium duty generally refers to vehicles having a single wheel at each axle end, such as the Ford F-250, F-350, and F-450 or the Chevrolet ("Chevy") Silverado 2500, 3500, and 4500, and the term heavy duty generally refers to vehicles having multiple wheels at each axle end.

Figure 28:
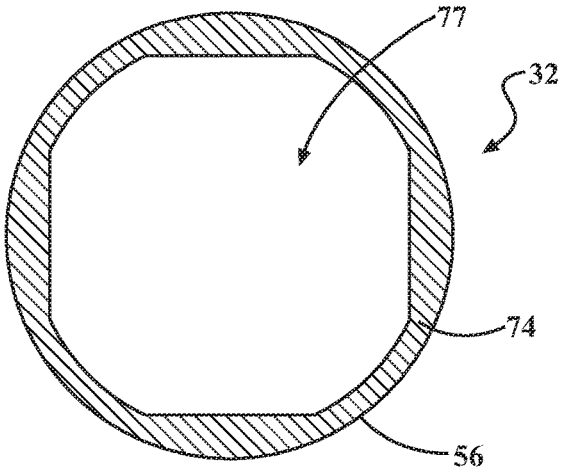
FIG. 28 is cross-sectional view of an alternative cross-section of the drawn.
Figure 29:
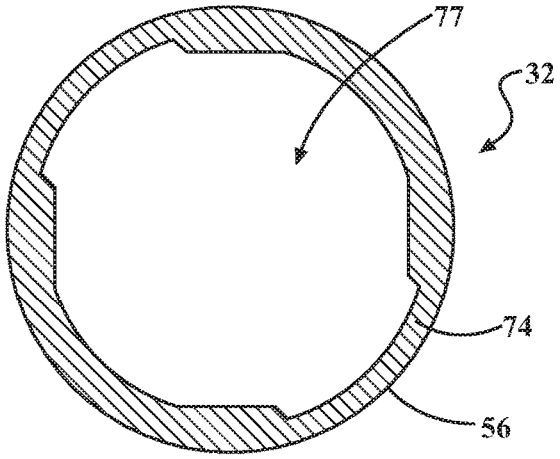
FIG. 29 is a cross-sectional view of another alternative cross-section of the drawn tube.
Figure 30A:
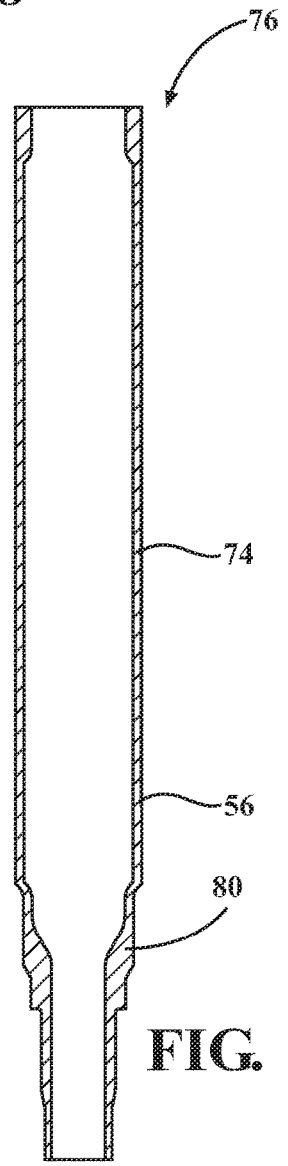
FIG. 30A is a cross-sectional view of the full-float axle tube with an increased drawn wall thickness at an open end.
Figure 30B:
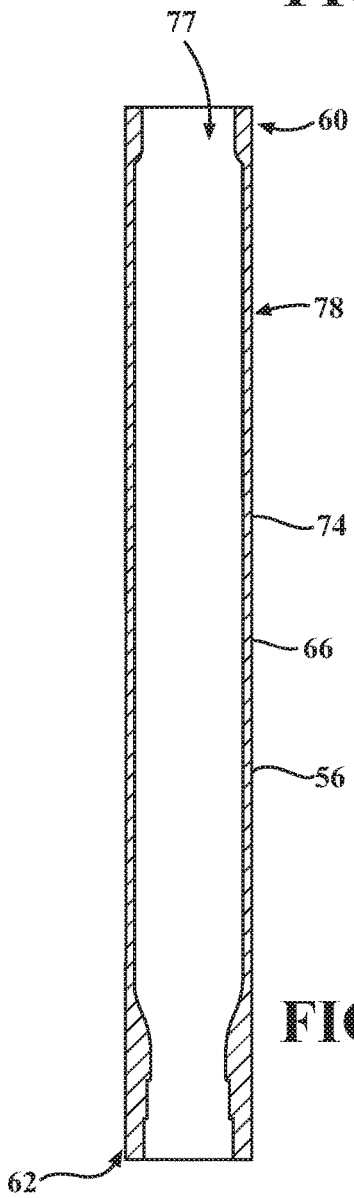
FIG. 30B is a cross-sectional view of the semi-float axle tube with an increased drawn wall thickness at the open end.
Figure 31:
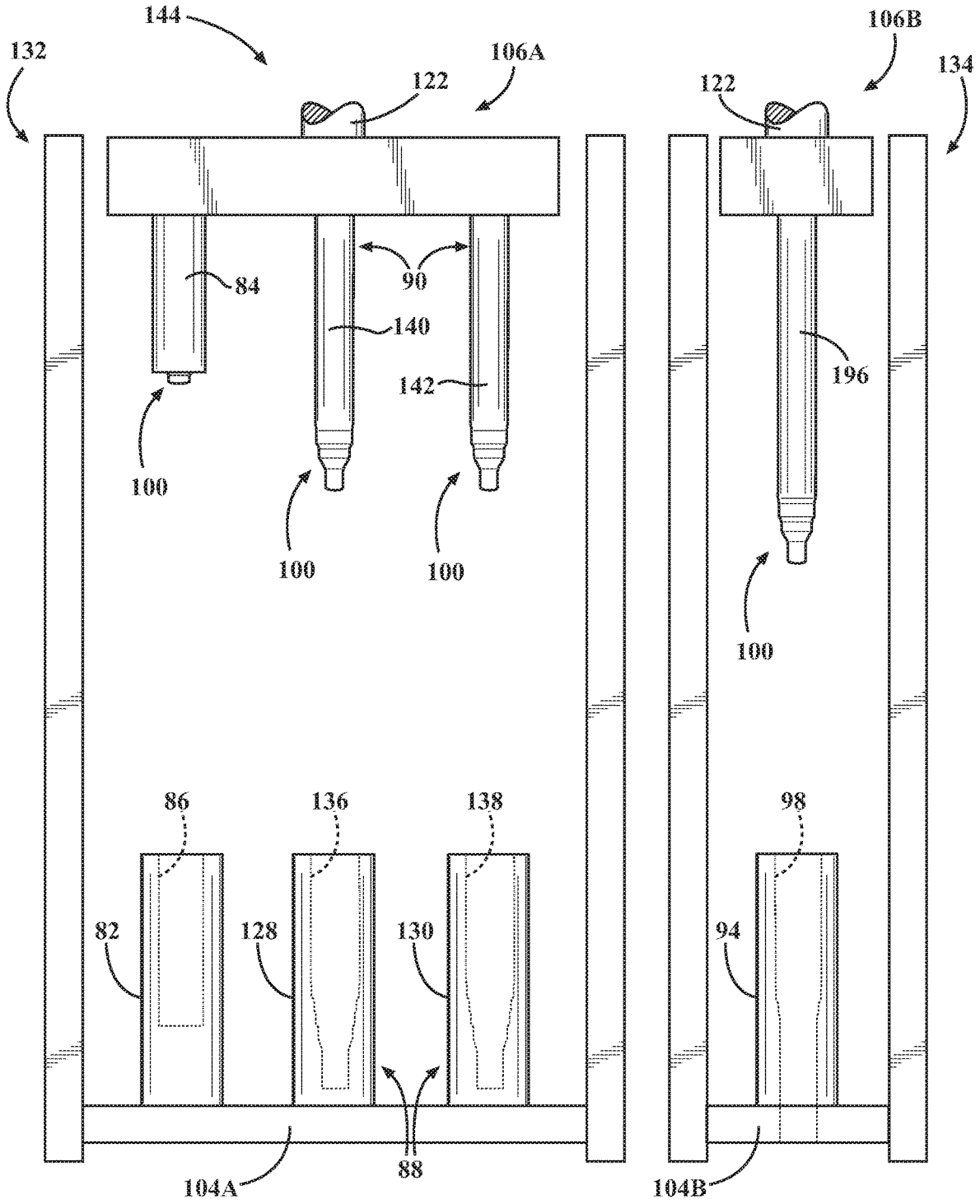
FIG. 31 is a front view of a first machine and a second machine.
Figure 32:
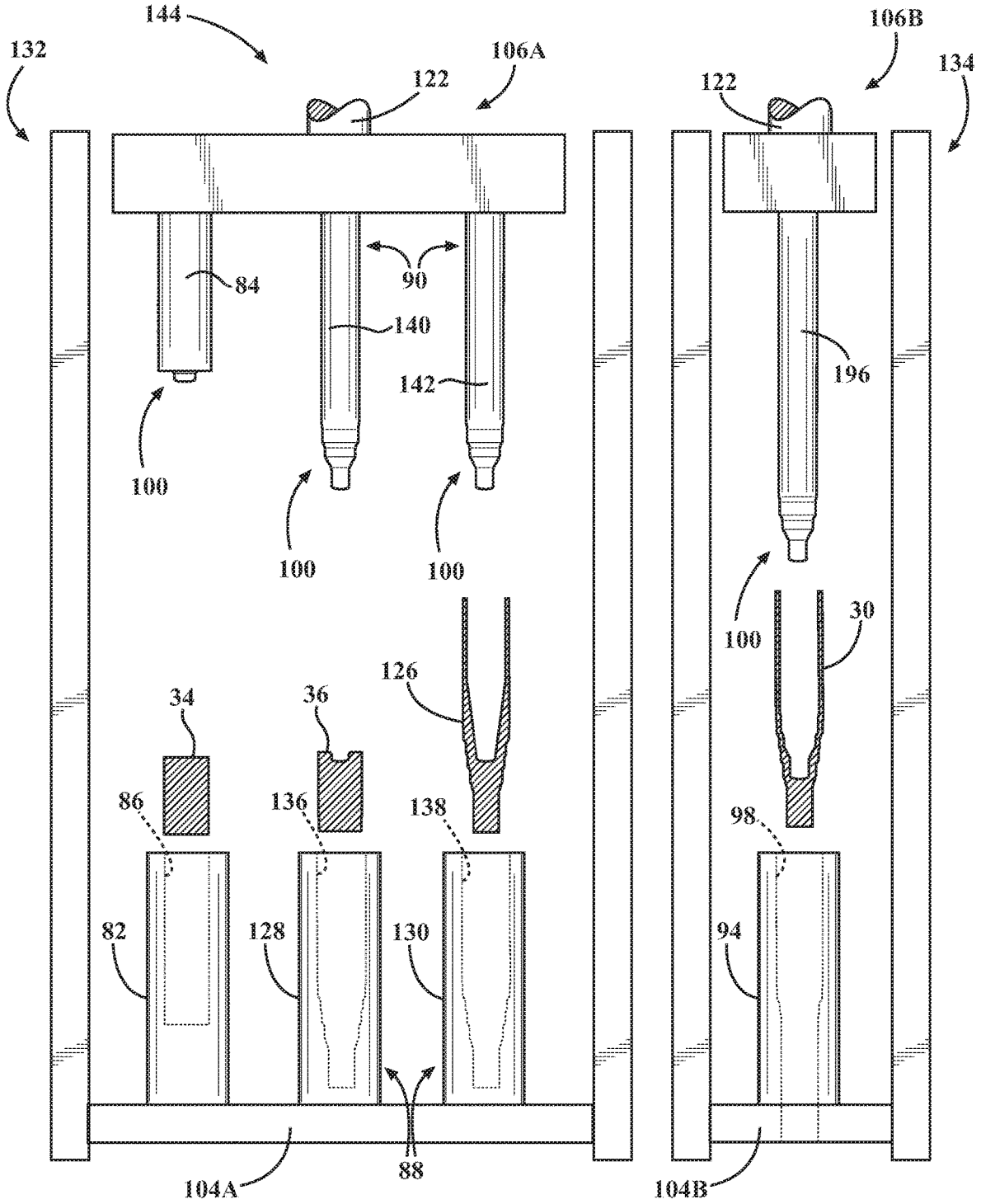
FIG. 32 is a front view of the first and second machines with the billet, the pre-formed billet, the preliminarily extruded tube, and the extruded tube spaced above a respective one of the first die assembly, an initial stage second die assembly, a later stage second die assembly, and the third die assembly.
Figure 33:
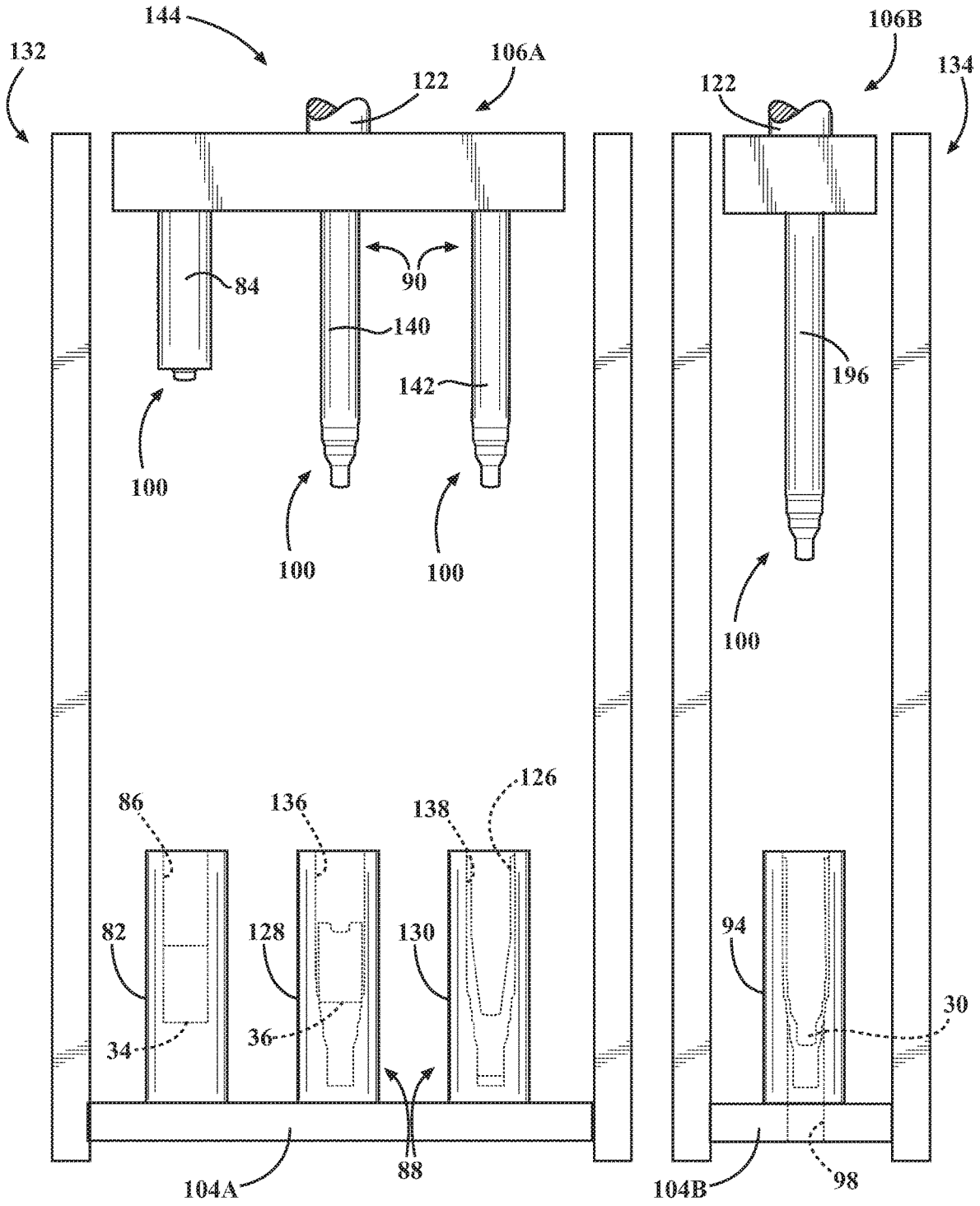
FIG. 33 is a front view of the first and second machines with the billet, the pre-formed billet, the preliminarily extruded tube, and the extruded tube disposed within the cavities of a respective one of the first die assembly, the initial stage second die assembly, the later stage second die assembly, and the third die assembly.
Figure 34:
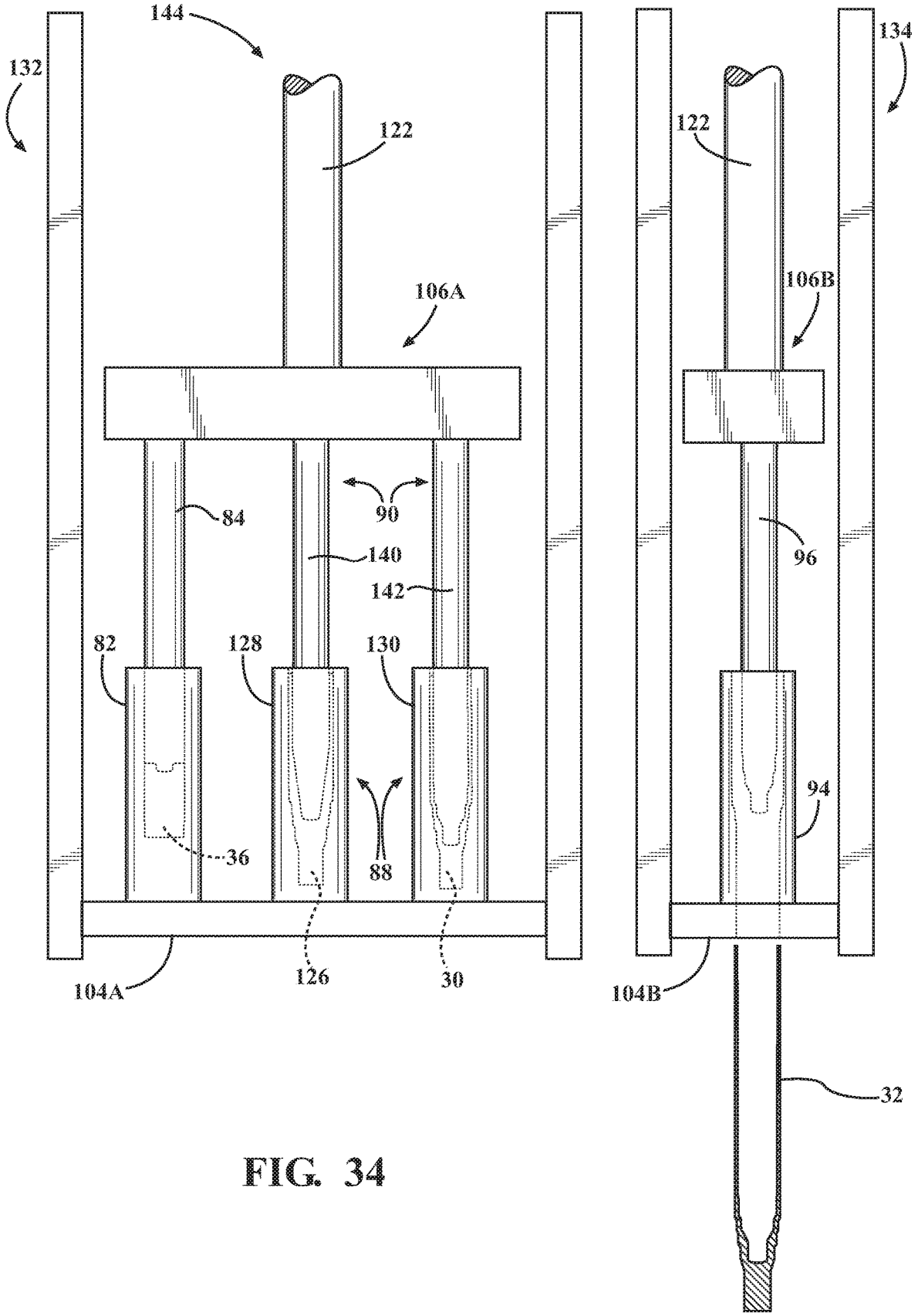
FIG. 34 is a front view of the first and second machines each having a press structure in the pressed position.

It is also to be appreciated that the thickness of the drawn wall 74 may be consistent about the circumference of the drawn tube 32 within the drawn body portion 66. However, as shown in FIGS. 28 and 29, the thickness of the drawn wall 74 may vary about the circumference of the drawn tube 32 within the drawn body portion 66. Said differently, the thickness of the drawn wall 74 may be increased in localized areas. Furthermore, the variation of the thickness of the drawn wall 74 shown in FIGS. 28 and 29 may extend for an entire length of the drawn body portion 74. Alternatively, the variation of the thickness of the drawn wall 74 shown in FIGS. 28 and 29 may only exist for a portion of the length of the tube, for example at the open end 60 of the drawn tube 32. It is believed that varying the thickness of the drawn wall 74 allows for increases stiffness of the drawn tube 32 while still eliminating weight and cost of additional materials to form a uniform thickness for the drawn wall 74. The variation of the thickness of the drawn wall 74 may also assist with welding the drawn tube 32 to other components after manufacturing the drawn tube 32, such as welding (e.g., slug welding, puddle welding, and MIG welding) to a center differential carrier. Although two example cross-sections for the drawn wall 74 are shown in FIGS. 28 and 29, it is to be appreciated that additional cross-sectional designs can be used based on the stiffness and welding requirements.

With reference to FIG. 5A, the wheel end 62 of the drawn tube 32 for the full-float axle tube 76 can be opened. Said differently, the hollow interior 72 of the drawn tube 32 for the full-float axle tube 76 is extended such that the hollow interior 72 spans an entire length of the drawn tube 32 to produce the full-float axle tube 76. Said differently, the wheel end 62 of the drawn tube 32 is opened such that the hollow interior 72 extends from the open end 60 of the drawn tube 32 to the spindle end 64 of the drawn tube 32 to produce the full-float axle tube 76. It is to be appreciated that the wheel end 62 of the drawn tube 32 may be opened in any suitable manner to transform the drawn tube 32 into the full-float axle tube 76. For example, the wheel end 62 of the drawn tube 32 may be drilled to form a hole in communication with the hollow interior 72 of the drawn tube 32 to extend the hollow interior 72 of the drawn tube 32 through the wheel end 62. However, the hole may be formed in other ways besides drilling, such as by piercing. Additionally, an exterior 80 of the full-float axle tube 76 may be machined to provide a desired configuration, especially at the spindle end 64.

With reference to FIG. 5B the wheel end 62 of the drawn tube 32 for the semi-float axle tube 78 can be opened. Said differently, the hollow interior 72 of the drawn tube 32 for the semi-float axle tube 78 is extended such that the hollow interior 72 spans an entire length of the drawn tube 32 to produce the semi-float axle tube 78. It is to be appreciated that the wheel end 62 of the drawn tube 32 may be opened in any suitable manner to transform the drawn tube 32 into the semi-float axle tube 78. For example, the wheel end 62 of the drawn tube 32 may be drilled to form a hole in communication with the hollow interior 72 of the drawn tube 32 to extend the hollow interior 72 of the drawn tube 32 through the wheel end 62. However, the hole may be formed in other ways besides drilling, such as by piercing. Additionally, an interior of the semi-float axle tube 78 may be machined to provide a desired configuration, such as the stepped configuration shown in FIG. 5B.

Figure 6:
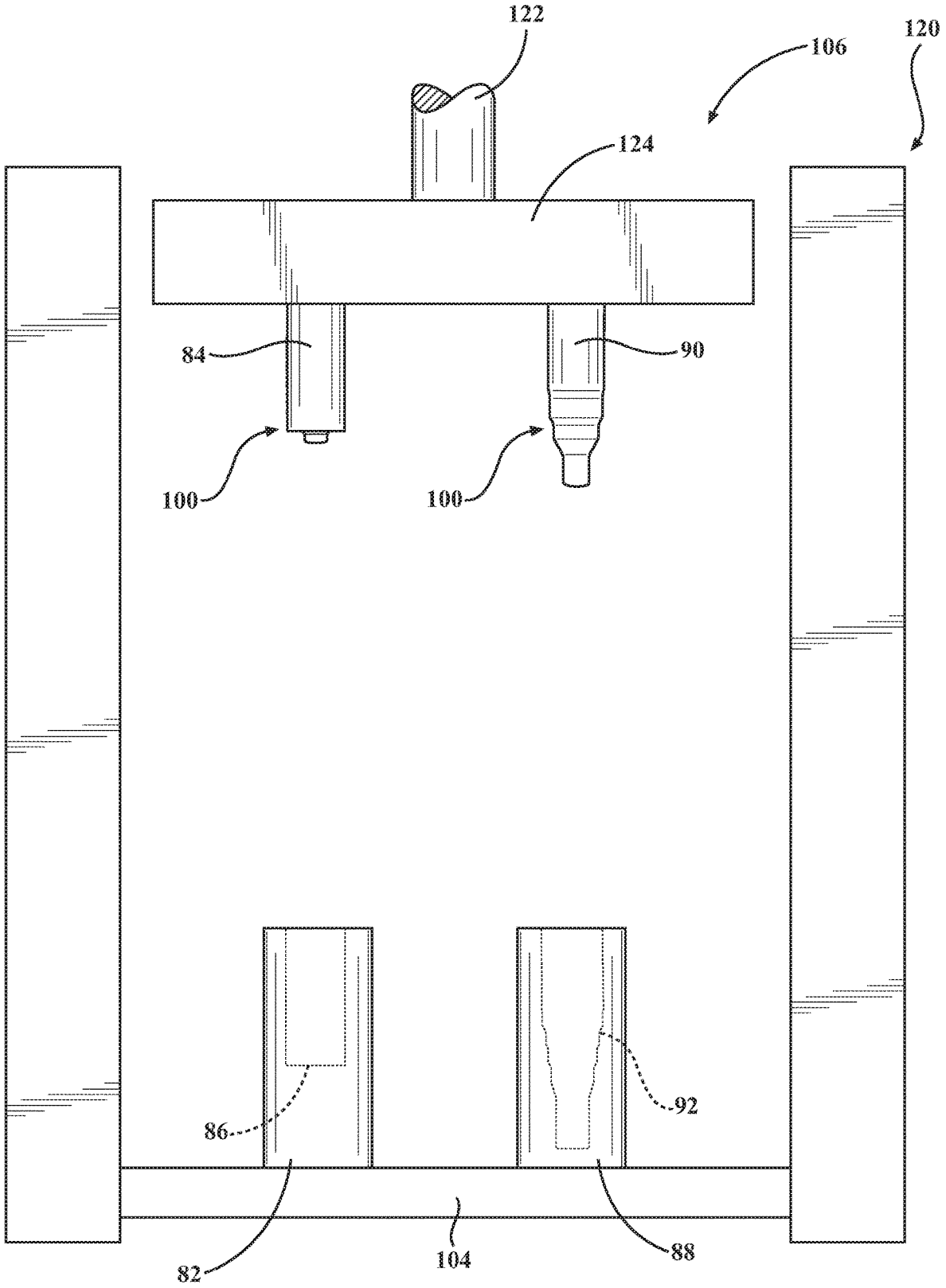
FIG. 6 is a front view of a single machine having a first die assembly and a second die assembly with a single press structure.
Figure 7:
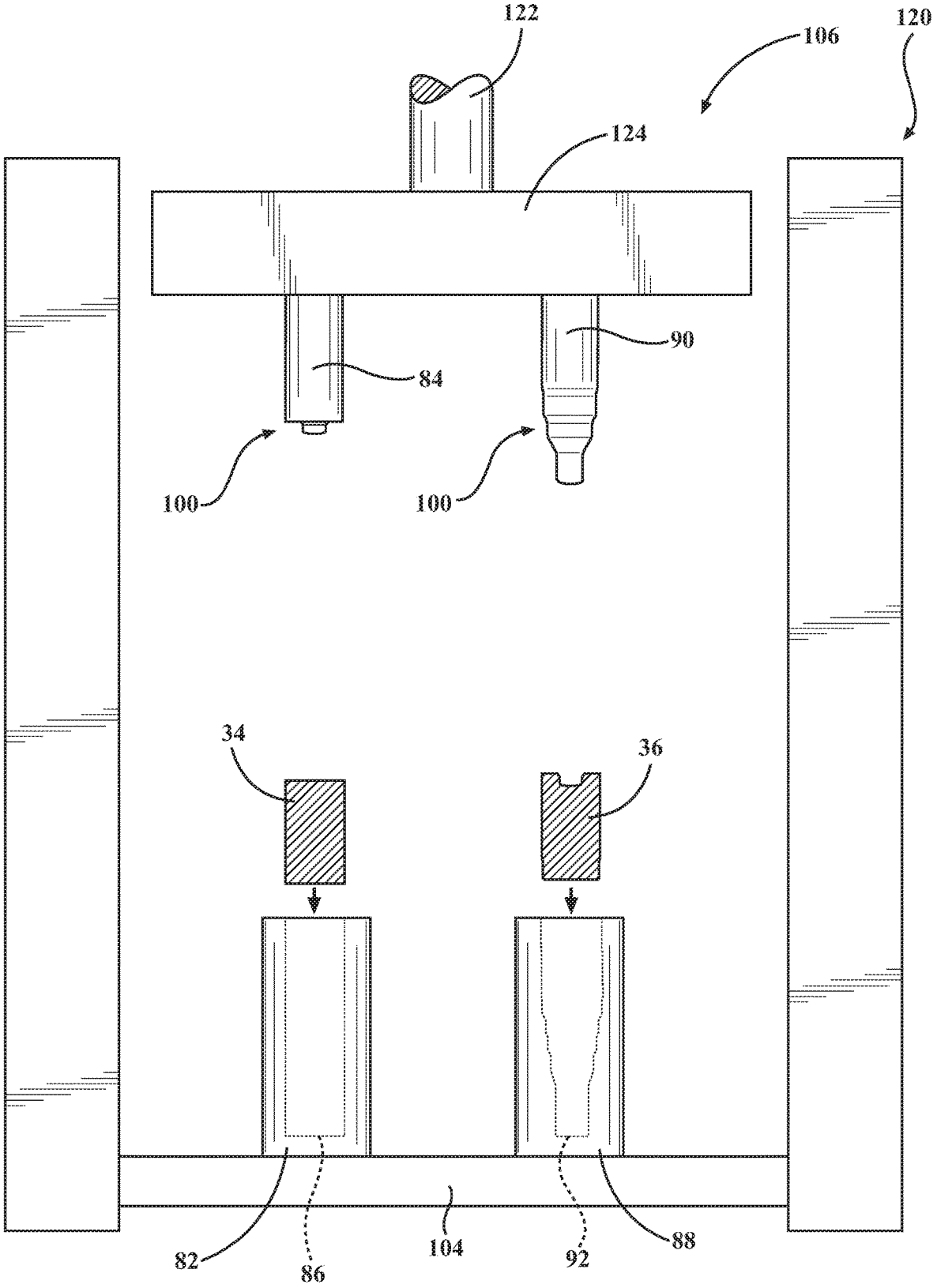
FIG. 7 is a front view of the single machine with the billet and the pre-formed billet positions above a respective one of the first die assembly and the second die assembly.
Figure 11:
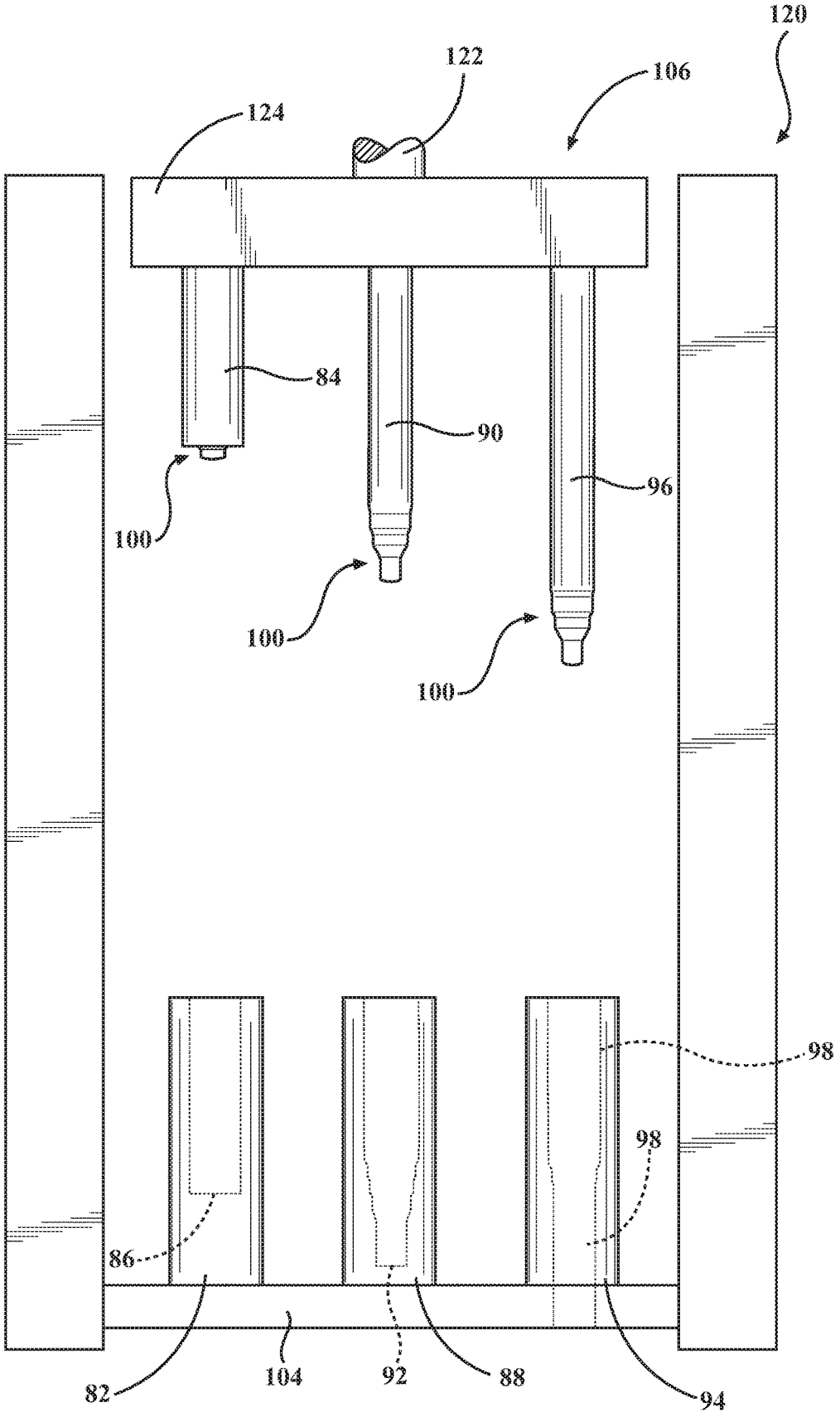
FIG. 11 is a front view of the single machine having a third die assembly.
Figure 12:
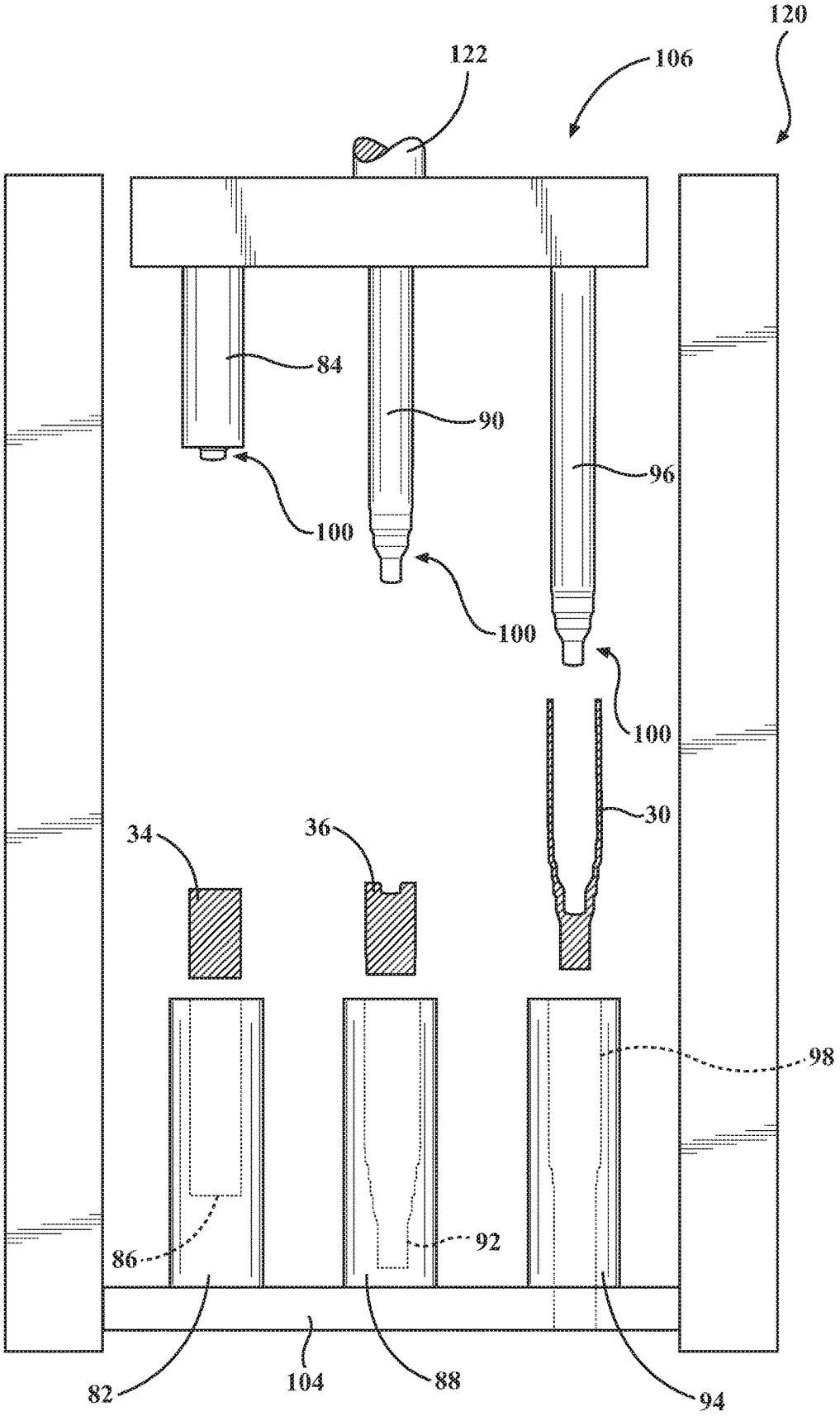
FIG. 12 is a front view of the single machine with the billet, the pre-formed billet, and an extruded tube spaced above a respective one of the first die assembly, the second die assembly, and the third die assembly.
Figure 13:
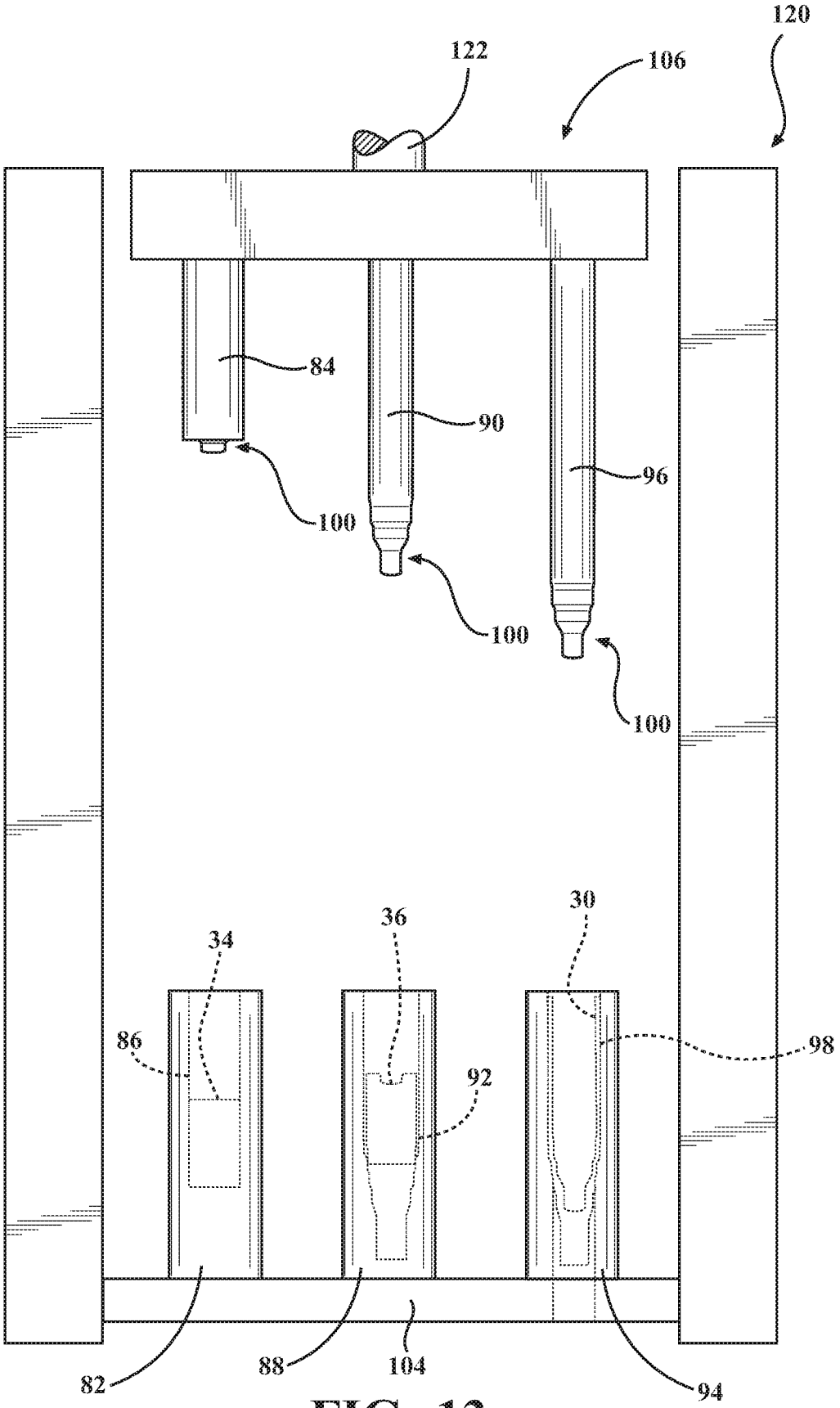
FIG. 13 is a front view of the single machine with the billet, pre-formed billet, and extruded tube disposed within the cavities of a respective one of the first die assembly, the second die assembly, and the third die assembly.
Figure 14:
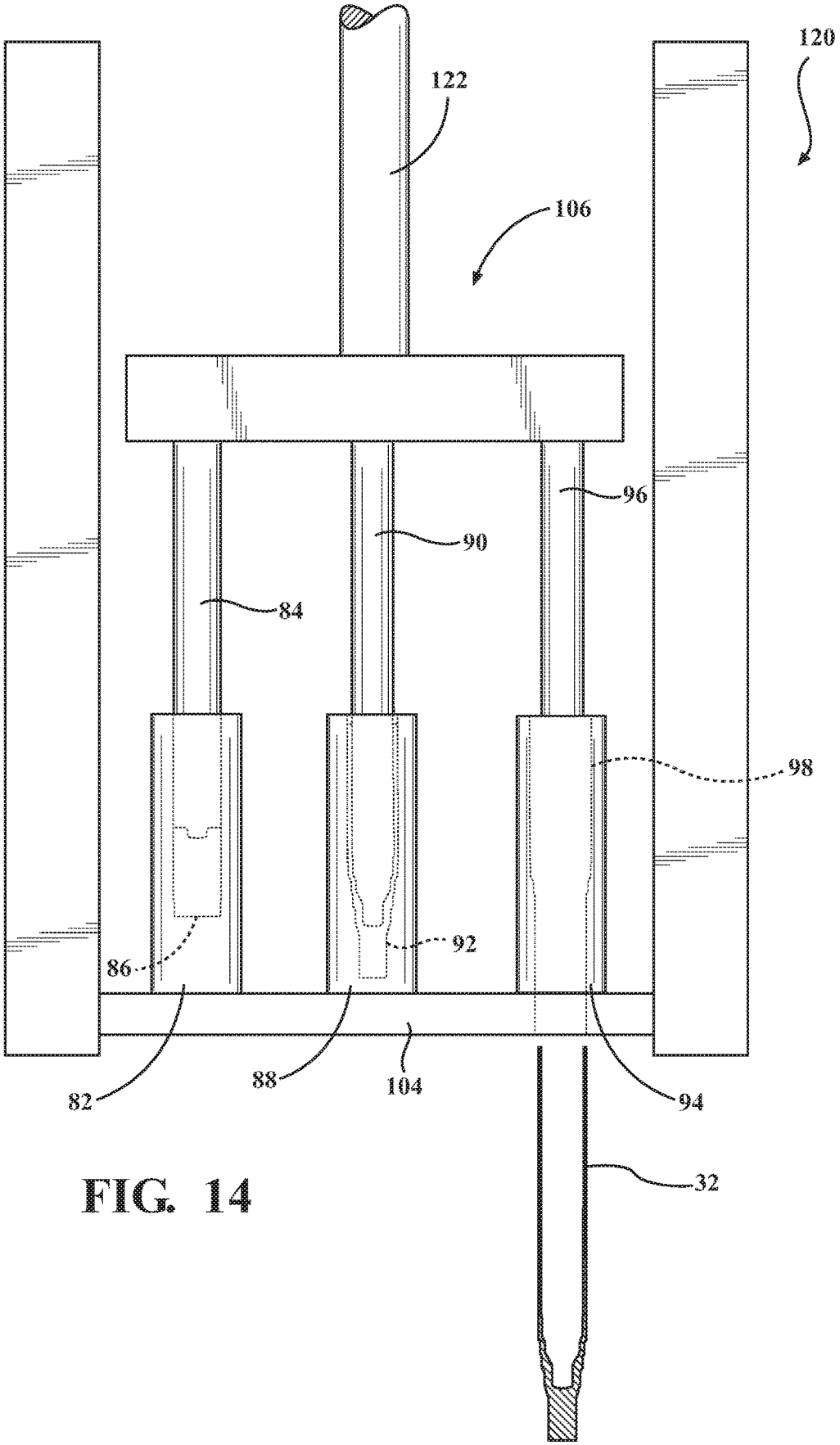
FIG. 14 is a front view of the single machine with the third die assembly and the single press structure in the pressed position.

With reference to FIGS. 6 and 11, typically, a plurality of die assemblies 82, 88, 94 are used to transform the billet 34 into either the extruded tube 30 or the drawn tube 32. For example, a first die assembly 82 is used to transform the billet 34 into the pre-formed billet 36. More specifically, a first mandrel 84 is used to press the billet 34 into a cavity 86 of the first die assembly 82 which results in the formation of the bore 40 at one end 38A of the billet 34 thereby producing the pre-formed billet 36.

A second die assembly 88 is used to transform the pre-formed billet 36 into the extruded tube 30. More specifically, a second mandrel 90 is used to press the pre-formed billet 36 into a cavity 92 of the second die assembly 88 which results in the elongation of the pre-formed billet 36 and the extension of the bore 40 into the pre-formed billet 36 to form the hollow interior 42 thereby producing the extruded tube 30.

A third die assembly 94 is used to transform the extruded tube 30 into the drawn tube 32. More specifically, a third mandrel 96 is used to press the extruded tube 30 into a cavity 98 of the third die assembly 94 which results in a further elongation of the extruded tube 30 and a thinning of the thickness of the extruded wall 58 thereby producing the drawn tube 32. The third mandrel 96 is used to press the extruded tube 30 through the third die assembly 94 with the cavity 98 of the third die assembly 94 progressively narrowing to further elongate the extruded tube 30 and reducing the thickness of the extruded wall 58 thereby producing the drawn tube 32.

As generally understood in the art, the cavities 86, 92, 98 of the die assemblies 82, 88, 94 and a working end 100 of the mandrels 84, 90, 96 are configured to cooperate with each other to transform the part within each of the die assemblies 82, 88, 94. For example, when the third mandrel 96 is inserted into the cavity 98 of the third die assembly 94, a space having a distance is defined between the third die assembly 94 and the third mandrel 96. The distance of the space results in the thickness of the drawn wall 74 of the drawn tube 32 once the third mandrel 96 presses the extruded tube 30 into the third die assembly 94.

Method of Manufacturing the Tube Having a Yield Strength of at Least 750 MPa

With reference to FIGS. 6-14, a method of manufacturing the drawn tube 32 with the thickness of the drawn wall 74 of from about 3 to about 18 millimeters and with the drawn tube 32 having a yield strength of at least 750 MPa is described below.

The method of manufacturing the drawn tube 32 with the yield strength of at least 750 MPa includes the steps of placing the billet 34 into the cavity 86 of the first die assembly 82, pressing the billet 34 into the cavity 86 of the first die assembly 82 to form the bore 40 at one end 38A of the billet 34 thereby producing the pre-formed billet 36, and moving the pre-formed billet 36 from the cavity 86 of the first die assembly 82 to the cavity 92 of the second die assembly 88. The method also includes the steps of pressing the pre-formed billet 36 into the cavity 92 of the second die assembly 88 to elongate the pre-formed billet 36 and form the hollow interior 42 therein thereby producing the extruded tube 30, moving the extruded tube 30 from the cavity 92 of the second die assembly 88 to the cavity 98 of the third die assembly 94, and pressing the extruded tube 30 into the cavity 98 of the third die assembly 94 to further elongate the extruded tube 30 and decrease the thickness of the extruded wall 58 of the extruded tube 30 to be of from about 3 to about 18 millimeters thereby producing the drawn tube 32 having the yield strength of at least 750 MPa.

Although the yield strength of the drawn tube 32 is described as being at least 750 MPa above, the yield strength may also be at least 900 MPa or even at least 1,000 MPa. In this method, the billet 34 comprises a material selected from the group of low carbon alloy steels, plain carbon steels, and combinations thereof.

It is to be appreciated that the step of pressing the pre-formed billet 36 into the cavity 92 of the second die assembly 88 may be further defined as forward and backward extruding the pre-formed billet 36 to elongate the pre-formed billet 36 and form the hollow interior 42 therein thereby producing the extruded tube 30. Additionally, the step of pressing the extruded tube 30 into the cavity 98 of the third die assembly 94 may be further defined as drawing the extruded tube 30 to further elongate the extruded tube 30 and decrease the thickness of the extruded wall 58 of the extruded tube 30 to of from about 3 to about 18 millimeters thereby producing the drawn tube 32.

As shown in FIGS. 31-34, the second die assembly 88 may be further defined as an initial stage second die assembly 128 and a later stage second die assembly 130. As such, the step of pressing the pre-formed billet 36 into the cavity 92 of the second die assembly 88 may be further defined as the steps of backward extruding the pre-formed billet 36 with the initial stage second die assembly 128 to elongate the pre-formed billet 36 and form the hollow interior 42 therein thereby producing the preliminarily extruded tube 126, moving the preliminarily extruded tube 126 into the later stage second die assembly 130, and backward extruding the preliminarily extruded tube 126 with the later stage second die assembly 130 to further elongate the preliminarily extruded tube 126 thereby producing the extruded tube 30. Separating the second die assembly 88 into the initial and later stage second die assemblies 128, 130 may reduce the amount of heat transferred to the tooling during the extrusion of the extruded tube 30, which may be detrimental to the tools which form the extruded tube 30 (i.e., the second die assembly 88).

A total drawn tube manufacturing time to complete the steps of placing a billet 34, pressing the billet 34 to produce the pre-formed billet 36; moving the pre-formed billet 36, pressing the pre-formed billet 36 to produce the extruded tube 30, moving the extruded tube 30, and pressing the extruded tube 30 to produce the drawn tube 32 is typically of from about 20 to about 240 seconds, more typically of from about 20 to about 120 seconds, even more typically of from about 20 to about 60 seconds, and yet even more typically of from about 20 to about 40 seconds.

The method may further comprise the step of heating the billet 34 to a temperature between 1,500 and 2,300 degrees Fahrenheit prior to the step of pressing the billet 34 into the cavity 86 of the first die assembly 82. The billet 34 may be heated in a furnace, through the use of heating methods including gas-fire and induction heating. It is to be appreciated that the billet 34 may be heated to the desired temperature by any suitable device and in any suitable manner.

The method may further comprise the step of pressing the pre-formed billet 36 into the cavity 92 of the second die assembly 88 is conducted at a temperature at least equal to 1,500 degrees Fahrenheit. As such, each of the steps prior to the step of pressing the pre-formed billet 36 into the cavity 92 of the second die assembly 88, including the step of pressing the billet 34 into the cavity 86 of the first die assembly 82 to form the bore 40 at one end 38A of the billet 34 thereby producing the pre-formed billet 36 may be performed before the pre-formed billet 34 reaches a temperature of 1,500 degrees Fahrenheit. Said differently, the billet 34 may decrease from the initial temperature of between 1,500 and 2,300 degrees Fahrenheit to at least equal to 1,500 degrees Fahrenheit as the billet 34 is formed into the extruded tube 30. As such, the pressing of the billet 34 in the first die assembly 82 and the pressing of the pre-formed billet 36 into the second die assembly 88 are commonly referred to by those skilled in the art of metal working and forming as a hot forging. Hot forging allows for increased ductility in the worked metallic material to facilitate the formation of various designs and configurations.

As described above, the second die assembly 88 may be further defined as the initial and later stage second die assemblies 128, 130 which progressively press the pre-formed billet 36 and the preliminarily extruded tube 126, respectively, to produce a work product: the extruded tube 30. It is to be appreciated that step of pressing the pre-formed billet 36 into the cavity 92 of the second die assembly 88 is conducted at a temperature at least equal to 1,500 degrees Fahrenheit may refer to both pressing the pre-formed billet 36 in the initial stage second die assembly 128 and the preliminarily extruded tube 126 in the later stage second die assembly 130 at a temperature at least equal to 1,500 degrees Fahrenheit. Alternatively, only one of the steps of pressing the pre-formed billet 36 in the initial stage second die assembly 128 and the preliminarily extruded tube 126 in the later stage second die assembly 130 may be performed at a temperature at least equal to 1,500 degrees Fahrenheit.

The step of pressing the extruded tube 30 into the cavity 98 of the third die assembly 94 may be conducted at a temperature between 800 and 900 degrees Fahrenheit. Said differently, the billet 34 may decrease from the initial temperature of between 1,500 and 2,300 degrees Fahrenheit to between 800 and 900 degrees Fahrenheit as the billet 34 is formed into the drawn tube 32. The 800-900 degree Fahrenheit range falls between the hot forging described above and cold forging, which those skilled in the art will appreciate is performed at approximately room temperature. While hot forging allows for high ductility of the worked material, the worked material generally has lower resultant yield strength than a product formed by cold forging. Alternatively, a product formed by cold forging is typically stronger than a product formed hot forging, but the worked material is typically not as ductile as the worked material in a hot forging process, which results in greater wear and tear on the cold forging machinery. Conducting the step of pressing the extruded tube 30 into the cavity 98 of the third die assembly 94 at a temperature between 800 and 900 degrees Fahrenheit balances the resultant yield strength and the ductility of the drawn tube 32 such that drawn tube 32 has a yield strength of at least 750 MPa while the incurring reduced wear and tear to the third die assembly 94 than if the drawn tube 32 was formed through a cold forging process. However, one skilled in the art will appreciate that the step of pressing the extruded tube 30 into the cavity 98 of the third die assembly 94 may be performed at any suitable temperature.

The method may further comprise the step of cooling the extruded tube 30 prior to the step of pressing the extruded tube 30 into the cavity 98 of the third die assembly 94. More specifically, the extruded tube 30 may be cooled from approximately 1,500 degrees Fahrenheit to between 800 and 900 degrees Fahrenheit. The cooling of a material between pressings is commonly referred to in the art as dwelling. In one embodiment, the first and second die assemblies 82, 88 are coupled to a first machine 132 and the third die assembly 94 is coupled to a second machine 134. The extruded tube 30 may be removed from the second die assembly 88 in the first machine 132 and may move to the third die assembly 94 in the second machine 134. The amount of time that is required to move the extruded tube 30 from the first machine 132 to the second machine 134 while exposed to room temperature air may cool the extruded tube 30 to the desired 800 and 900 degrees Fahrenheit. Alternatively, the extruded tube 30 may be exposed to forced air between the second and third die assemblies 88, 94 which may accelerate the cooling of the extruded tube 30. As another alternative, the extruded tube 30 may be quenched in a liquid (such as oil, water, etc.) between the second and third die assemblies 88, 94 which may accelerate the cooling of the extruded tube 30. It is to be appreciated that the extruded tube 30 may be cooled in any suitable manner.

The method may include the step of machining the spindle end 64 of the drawn tube 32 to produce a full-float hollow axle tube 76 having the hollow interior 72 that spans the length of the full-float hollow axle tube 76.

It is to be appreciated that the method described above is not specifically tied to the use of a single machine 120. Said differently, the method described above may use multiple machines to complete the steps described above to manufacture the drawn tube 32. For example, as described above and in greater detail below, and shown in FIGS. 31-34, the drawn tube 32 may be formed using the first machine 132 and the second machine 134. However, the method described above could utilize the single machine 120 that is described in detail below. Additionally, the method described above could utilize the apparatus 102 described in detail below.

Figure 18:
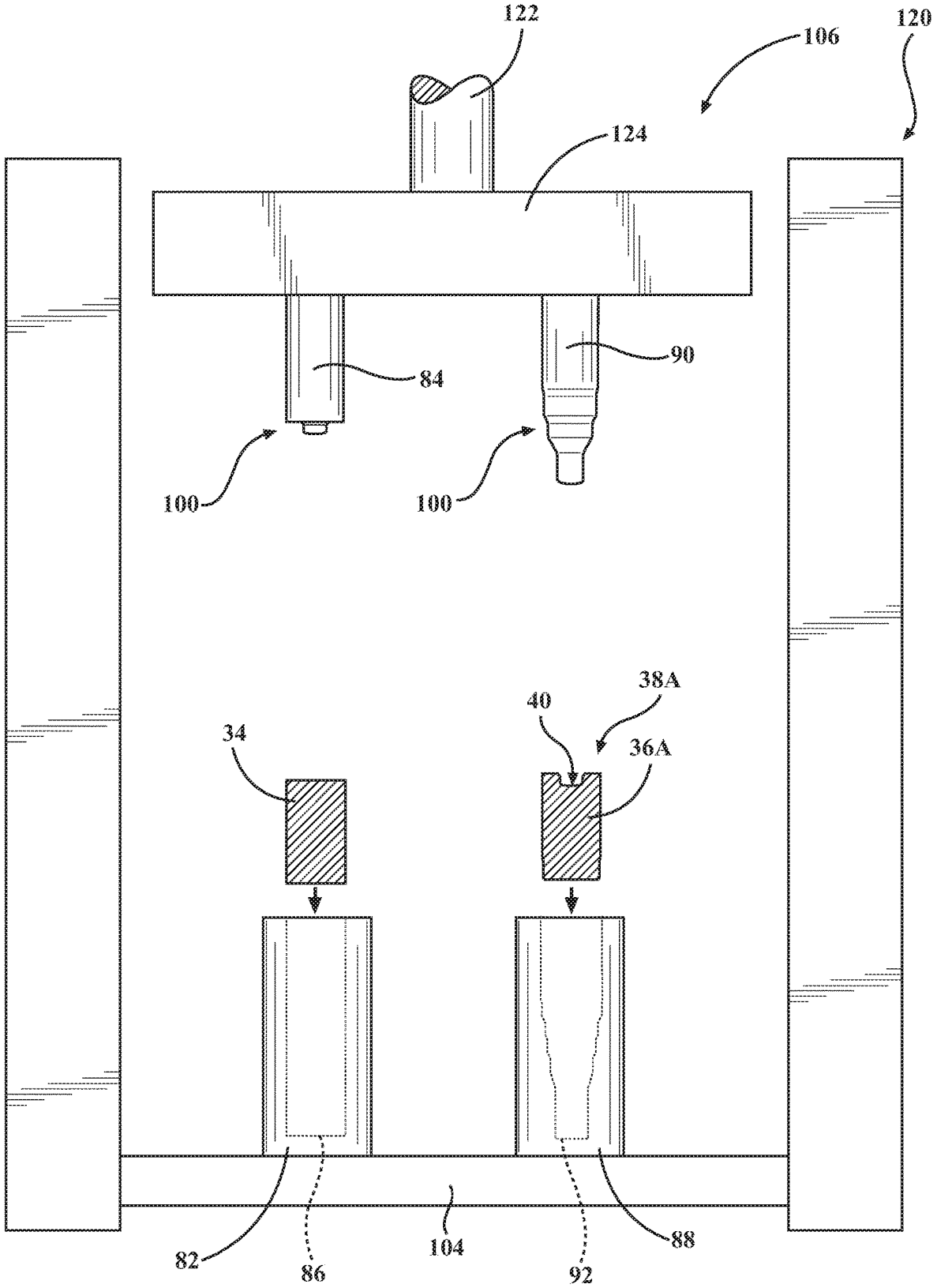
FIG. 18 is a front view of the single machine with the billet and a first pre-formed billet positions above a respective one of the first die assembly and the second die assembly.
Figure 19:
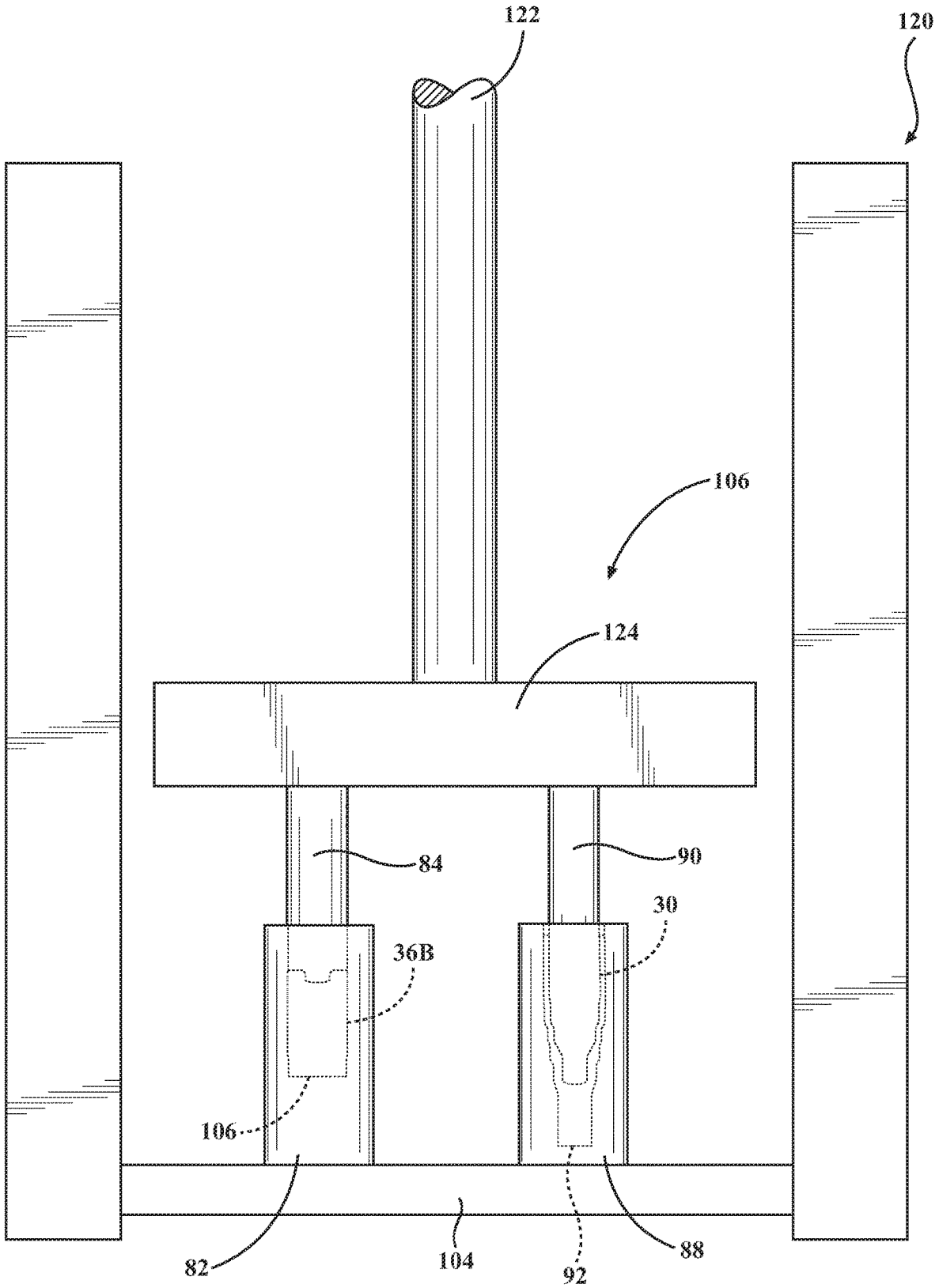
FIG. 19 is a front view of the single machine with the single press structure in the pressed position to produce a second pre-formed billet and an extruded tube.
Figure 20:
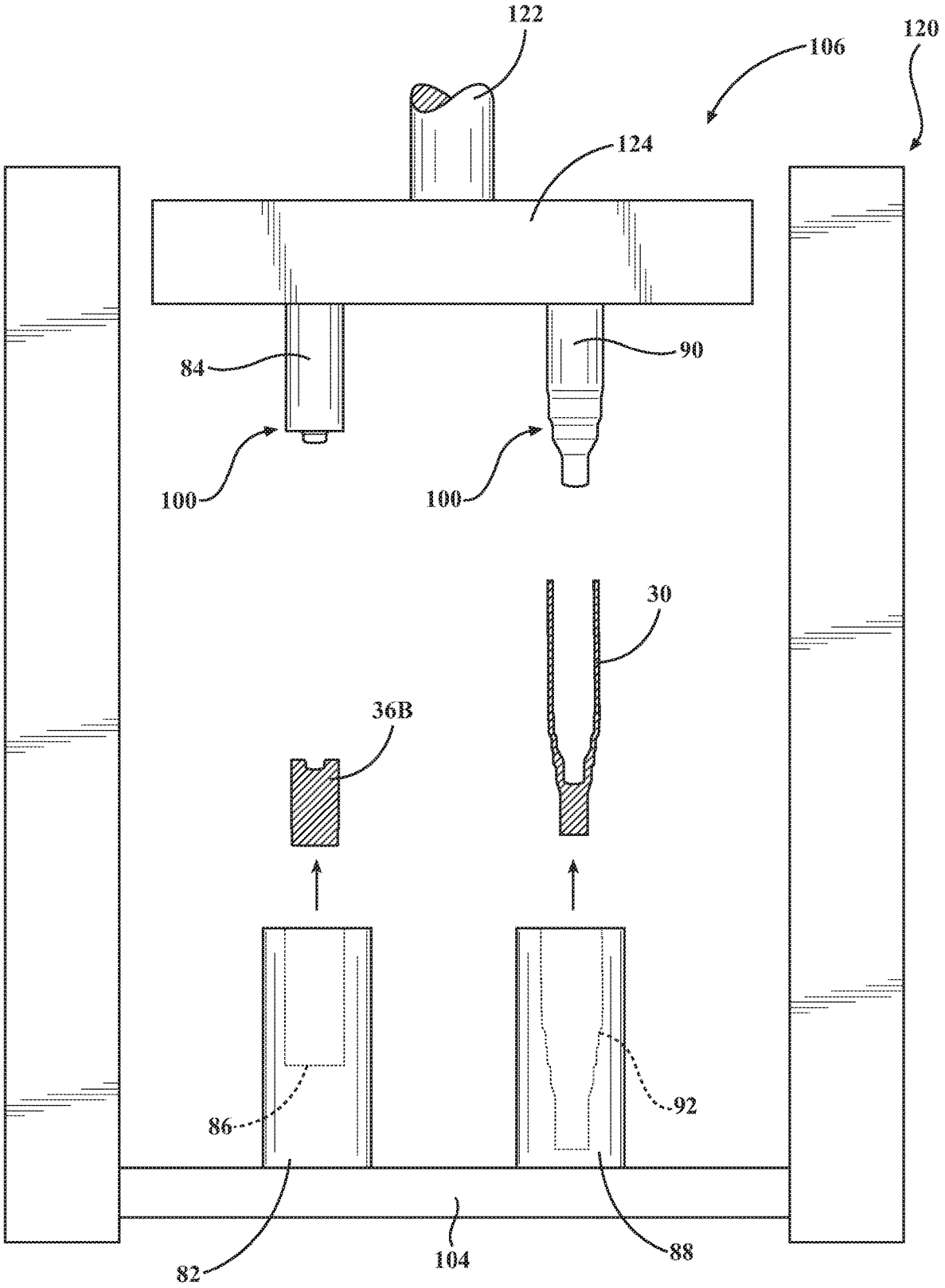
FIG. 20 is a front view of a single machine with the second pre-formed billet and the extruded tube removed from the die assemblies.
Figure 21:
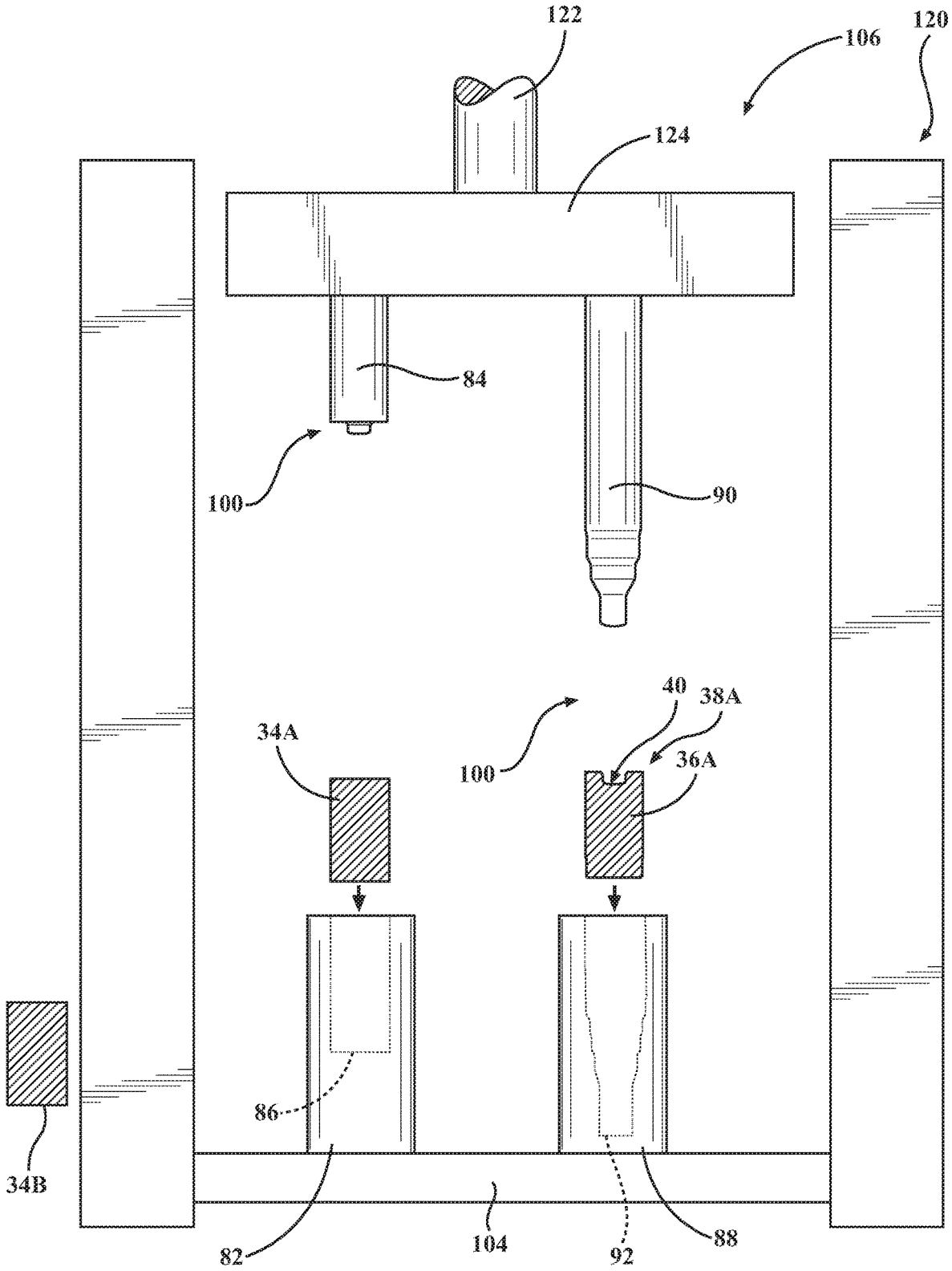
FIG. 21 is a front view of the single machine with a first billet and a first pre-formed billet positions above respective die assemblies and a second billet adjacent the single machine.
Figure 22:
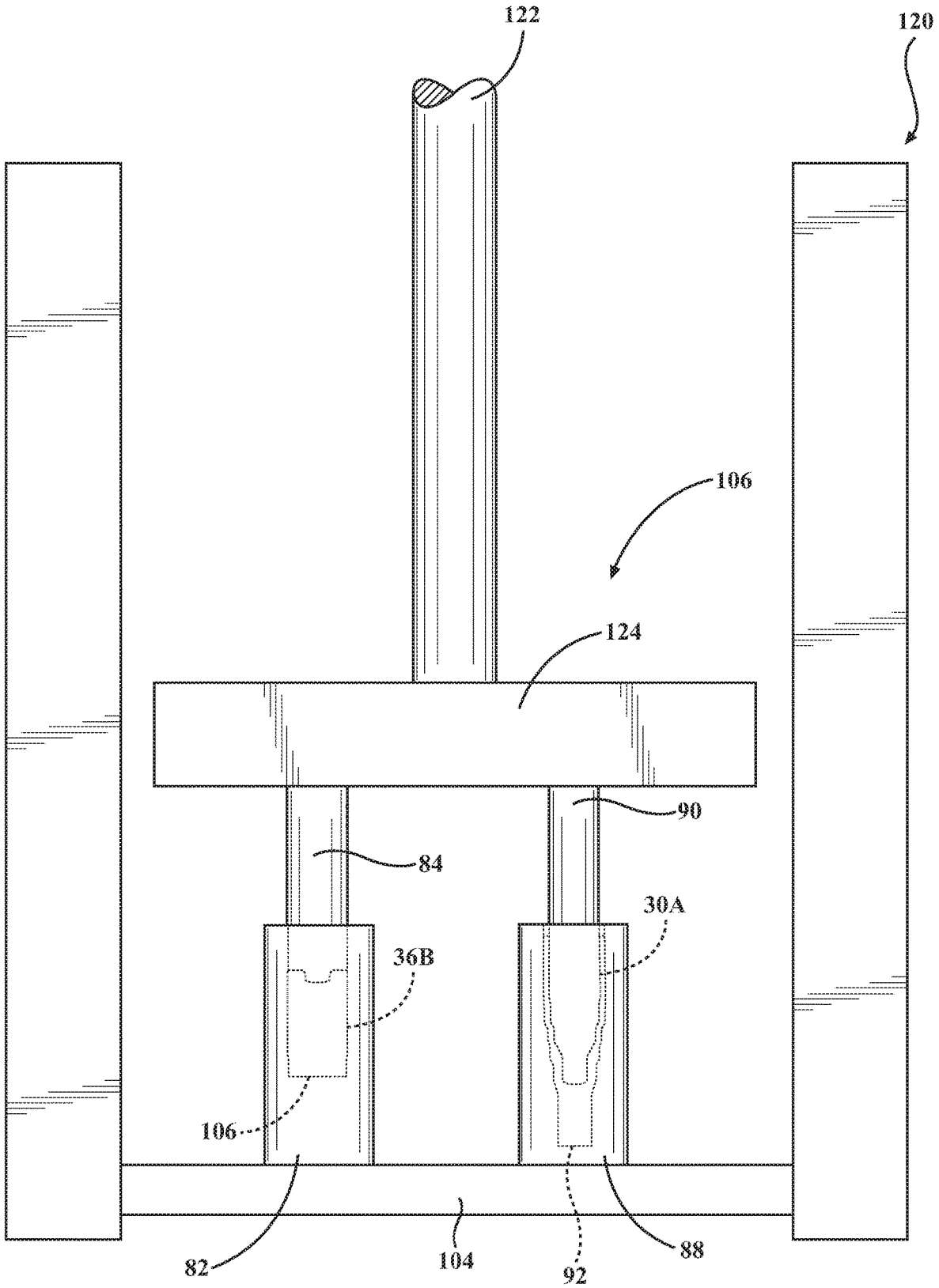
FIG. 22 is a front view of the single machine with the single press structure in the pressed position to produce a second pre-formed billet and a first extruded tube.
Figure 23:
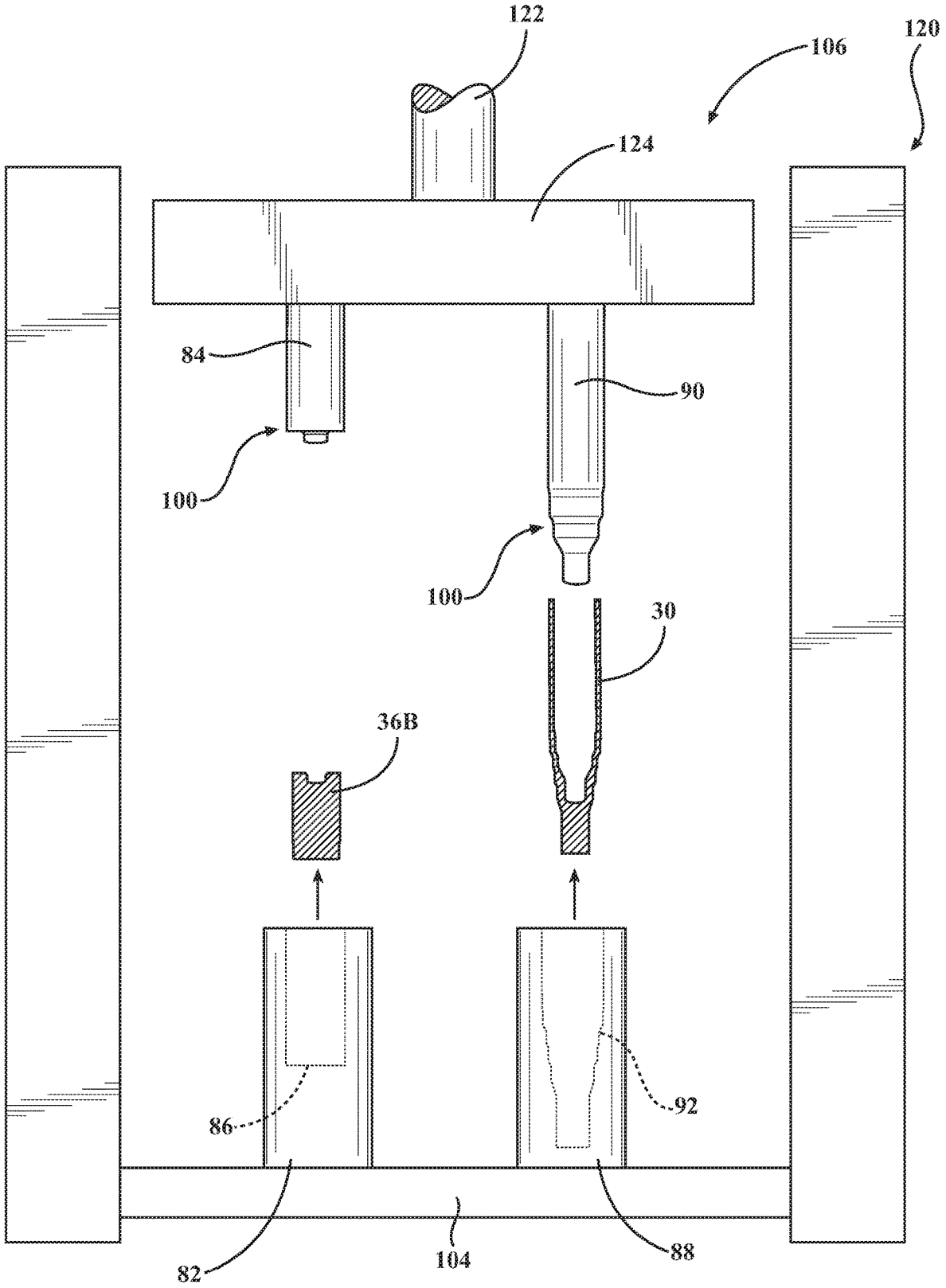
FIG. 23 is a front view of a single machine with the second pre-formed billet and the first extruded tube removed from the die assemblies.
Figure 24:
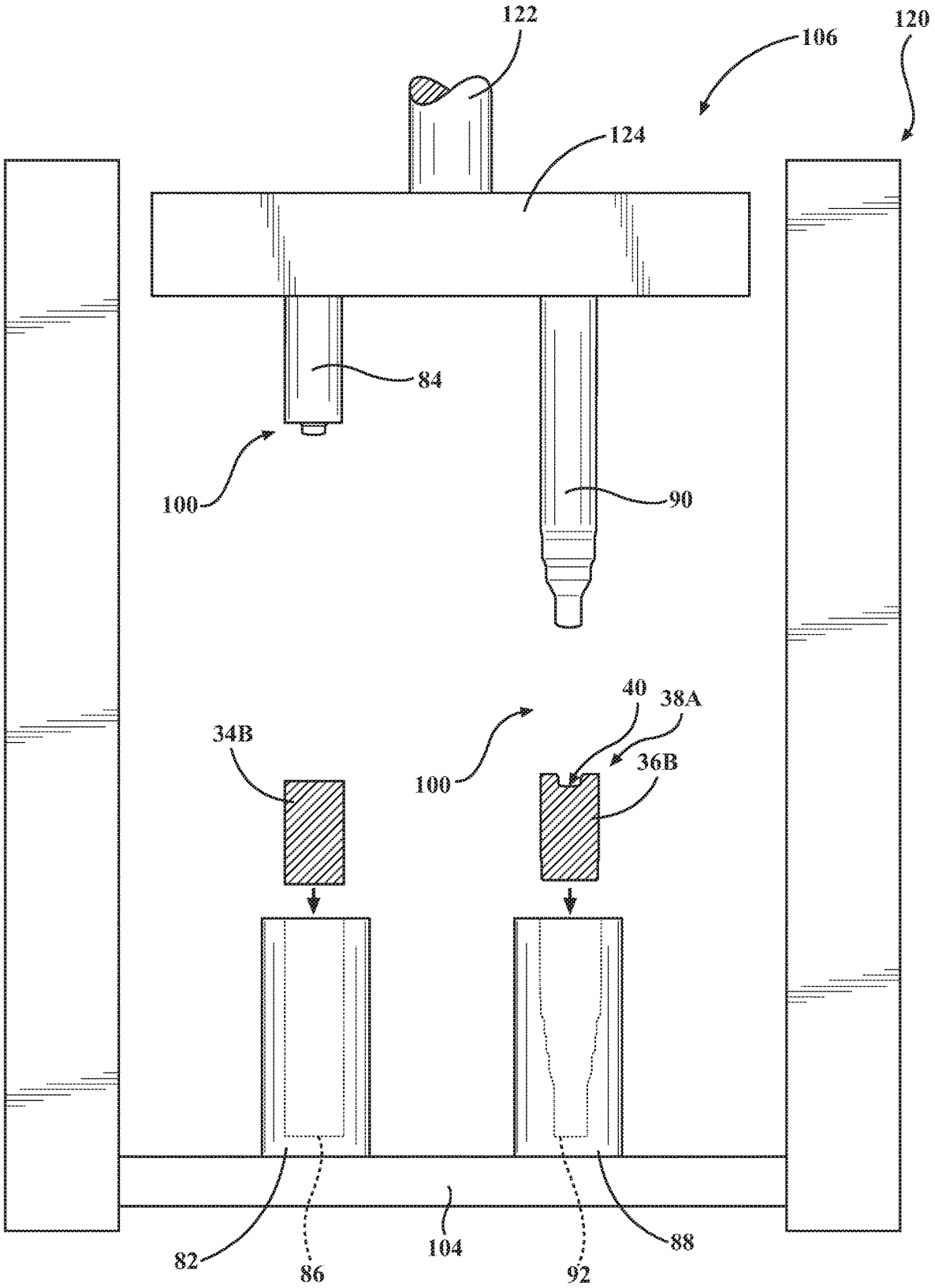
FIG. 24 is a front view of the single machine with the second billet and the second pre-formed billet positions above respective die assemblies and a second billet adjacent the single machine.
Figure 25:
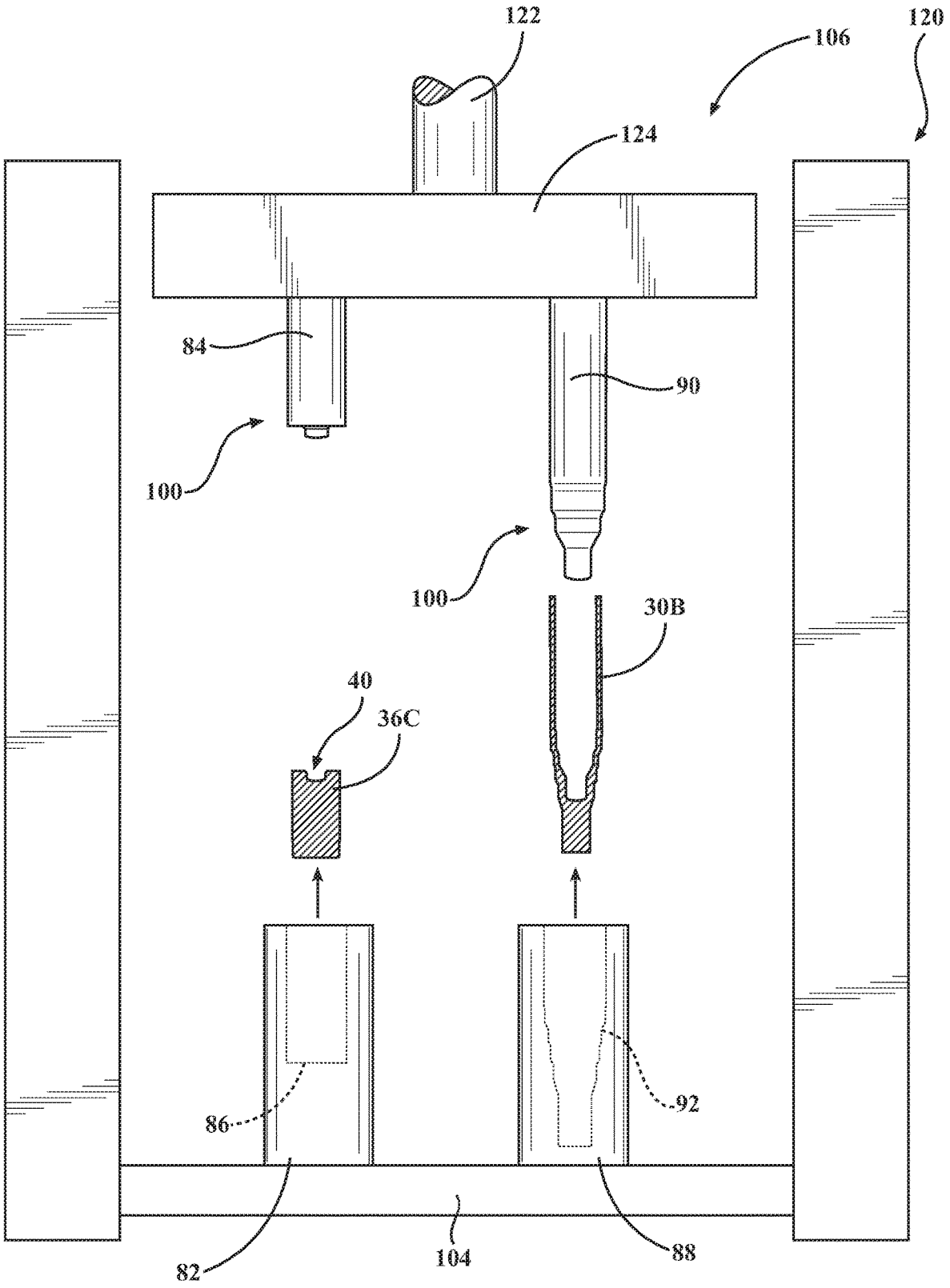
FIG. 25 is a front view of the single machine with a third pre-formed billet and a second extruded tube removed from the die assemblies.

Alternative Method of Manufacturing the Tube Having a Yield Strength of at Least 750 MPa An alternative method of manufacturing the drawn tube 32 having a yield strength of at least 750 MPa is described below. With reference to FIGS. 18-20, the alternative method includes the steps of placing the billet 34 into the cavity 86 of the first die assembly 82 and placing a first pre-formed billet 36A having the bore 40 defined in one end 38A thereof into the cavity 92 of the second die assembly 88. The alternative method also includes the steps of forming the billet 34 within the cavity 86 of the first die assembly 82 to produce a second pre-formed billet 36B and extruding the first pre-formed billet 36A within the cavity 92 of the second die assembly 88 to produce the extruded tube 30 having a hollow interior 42.

Figure 26:
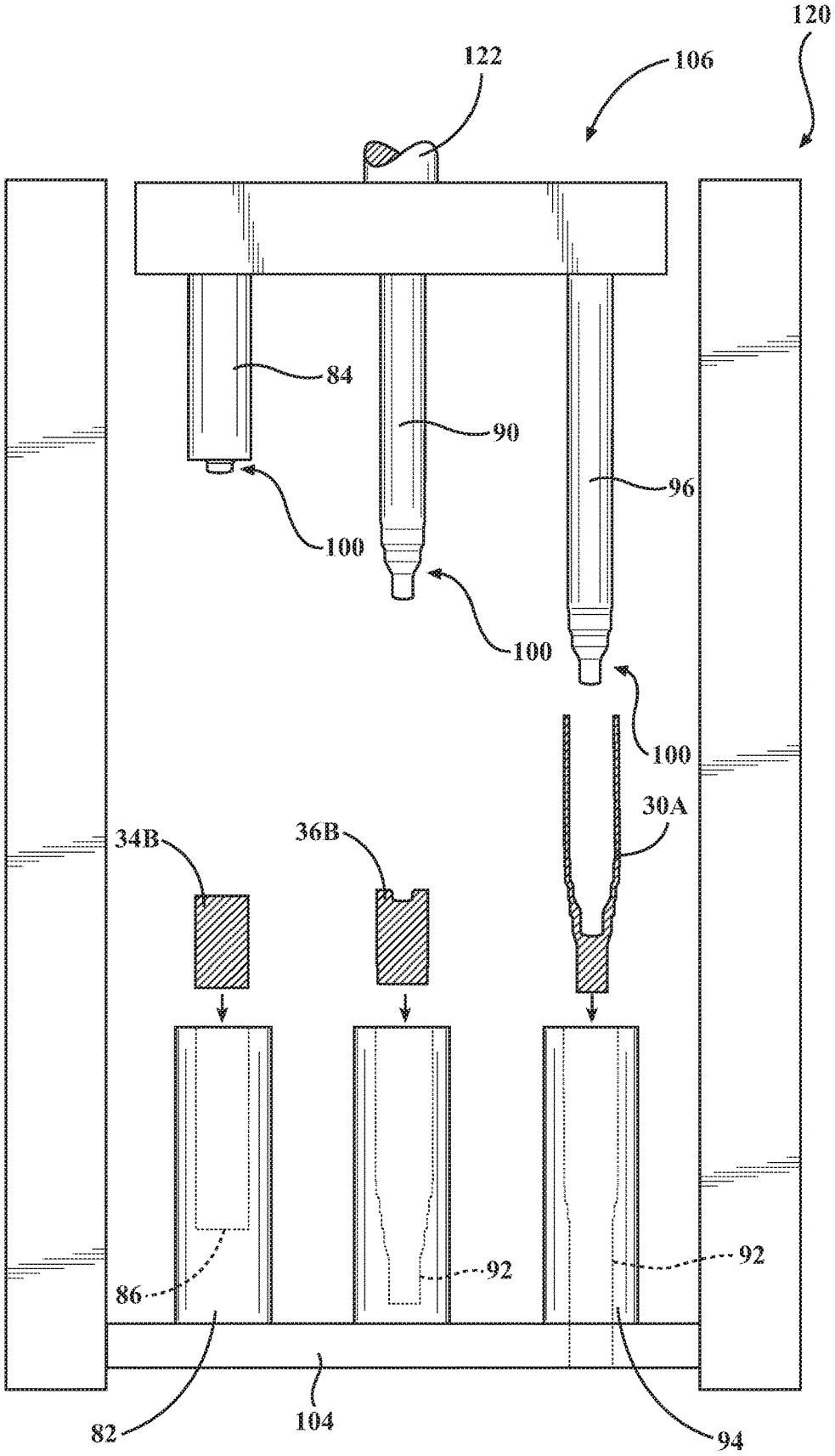
FIG. 26 is a front view of the single machine with the second billet, the second pre-formed billet, and the first extruded tube positions above a respective one of the first die assembly, the second die assembly, and a third die assembly.
Figure 27:
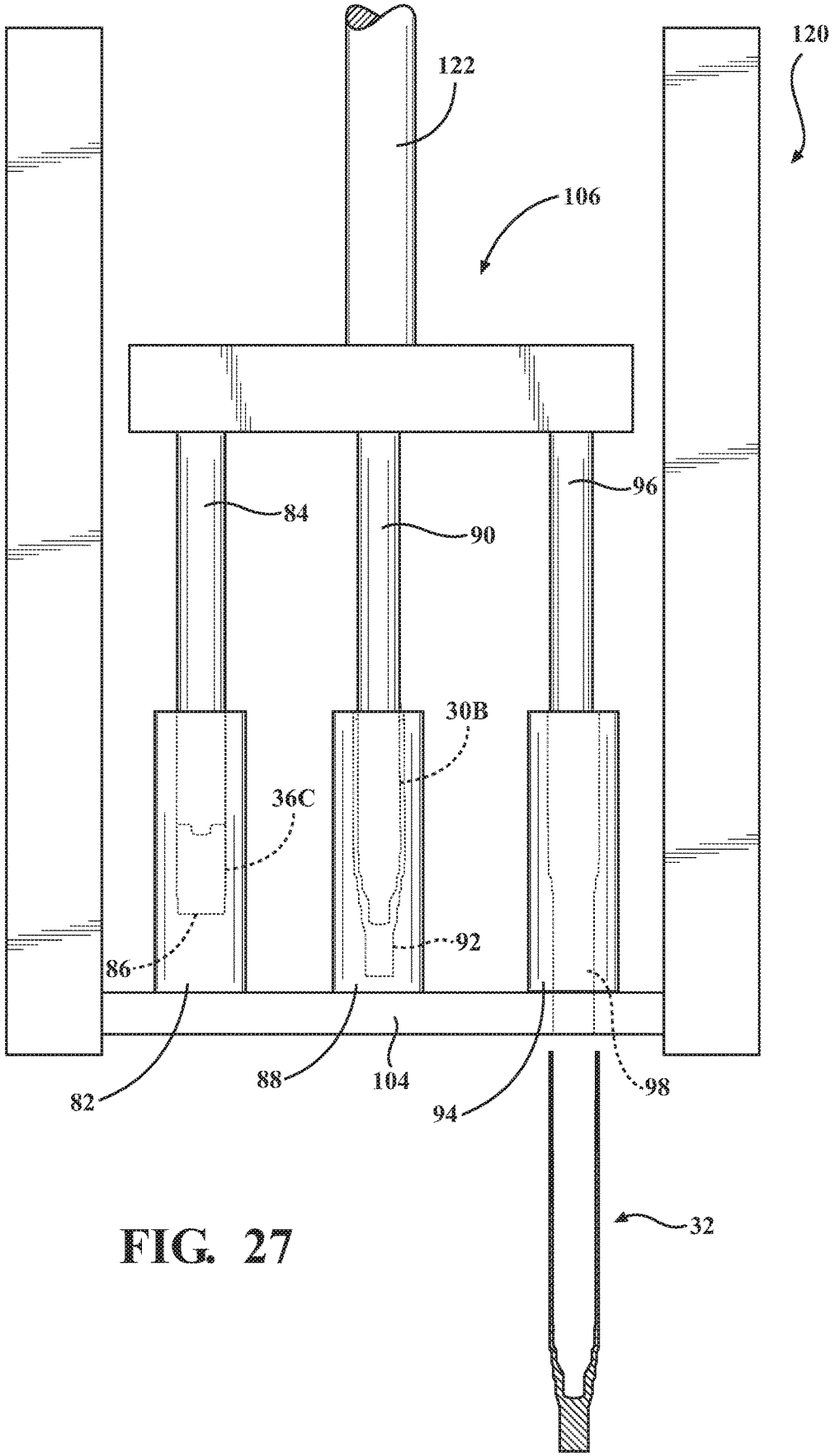
FIG. 27 is a front view of the single machine with the single press structure in the pressed position to produce the third pre-formed billet, the second extruded tube, and a drawn tube.

It is to be appreciated that the step of extruding the first pre-formed billet 36A may be further defined as forward and backward extrusion of the first pre-formed billet 36A within the cavity 92 of the second die assembly 88 to produce the extruded tube 30 having the hollow interior 42. It is also to be appreciated that the billet 34 may be further defined as a first billet 34A and the extruded tube 30 may be further defined as a first extruded tube 30A. With reference to FIGS. 21-25, when the method includes the first billet 34A and the first extruded tube 30A, the method includes the step of removing the second pre-formed billet 36B from the cavity 86 of the first die assembly 82, placing the second pre-formed billet 36B into the cavity 92 of the second die assembly 88, placing a second billet 34B into the cavity 86 of the first die assembly 82, forming the second billet 34B within the cavity 86 of the first die assembly 82 to produce a third pre-formed billet 36C having a bore 40 defined in one end thereof, and extruding the second pre-formed billet 36B within the cavity 92 of the second die assembly 88 to produce a second extruded tube 30B having the hollow interior 42. With reference to FIGS. 26 and 27, additionally, the method may include the steps of removing the second pre-formed billet 36B from the cavity 86 of the first die assembly 82, placing the second pre-formed billet 36B into the cavity 92 of the second die assembly 88, placing a second billet 34B into the cavity 86 of the first die assembly 82, removing the first extruded tube 30A from the cavity 92 of the second die assembly 88, placing the first extruded tube 30A into the cavity 98 of the third die assembly 94, forming the second billet 34B within the cavity 86 of the first die assembly 82 to produce the third pre-formed billet 36C having the bore 40 defined in one end 38A thereof, extruding the second pre-formed billet 36B within the cavity 92 of the second die assembly 88 to produce the second extruded tube 30B having the hollow interior 42, and drawing the first extruded tube 30A within the cavity 98 of the third die assembly 94 to produce a drawn tube 32 having the drawn wall 74 that has a thickness that is reduced relative to the extruded wall 58 of the first extruded tube 30A.

As describe above and shown in FIGS. 36-38, the second die assembly 88 may be further defined as the initial stage second die assembly 128 and the later stage second die assembly 130. The step of placing the first pre-formed billet 36A having the bore 40 defined in one end thereof into the cavity 92 of the second die assembly 88 may be further defined as placing the first pre-formed billet 36A having the bore 40 defined in one end thereof into a cavity 136 of the initial stage second die assembly 128. The method may further comprise the step of placing a first preliminarily extruded tube 126A into a cavity 138 of the later stage second die assembly 130. Furthermore, the step of extruding the first pre-formed billet 36A within the cavity 92 of the second die assembly 88 may be further defined as the steps of backward extruding the first pre-formed billet 36A with the initial stage second die assembly 128 to elongate the first pre-formed billet 36A and form the hollow interior 42 therein thereby producing a second preliminarily extruded tube 126B and backward extruding the first preliminarily extruded tube 126A with the later stage second die assembly 130 to further elongate the first preliminarily extruded tube 126A thereby producing the extruded tube 30.

It is to be appreciated that the alternative method described above is not specifically tied to the use of a single machine 120. Said differently, the alternative method described above may use multiple machines to complete the steps described above to manufacture the drawn tube 32. For example, as described above and in greater detail below, and shown in FIGS. 36-38, the drawn tube 32 may be formed using the first machine 132 and the second machine 134. However, the alternative method described above could utilize the single machine 120 that is described in detail below. Additionally, the method described above could utilize the apparatus 102 described in detail below.

In each of the manufacturing methods described above, the resultant yield strength of the tube, whether the extruded tube 30 or the drawn tube 32, is influenced by several factors, including the material chemistry of the billet 34, the reduction in the cross-sectional area of the billet 34, the temperature of the billet 34, pre-formed billet 36, extruded tube 30 and drawn tube 32, and/or any rapid cooling after any of the forging steps.

The material chemistry of the billet 34 is selected to maximize the yield strength of the tube while limiting a total alloy content of the material of the billet 34 so that the material of the billet 34 maintains weldability.

A common measure of weldability is the Carbon Equivalency (CE) value. Standard practice is to maintain the CE value below 0.50. CE equals the percent carbon plus percent manganese divided by 6 plus the percents of chromium, molybdenum, and vanadium divided by 5 plus the percent copper and nickel divided by 15.

As the percent reduction in area (RA) of the billet 34 increases, the resultant yield strength of the tube will increase. The RA is found by subtracting the cross-sectional thickness of the drawn wall 74 of the tube from that of the cross-sectional area of the billet 34, dividing that by the cross-sectional area of the billet 34, and multiplying by 100. It can be seen then that for a given cross-sectional area of the billet 34, manufacturing the tube with a thinner wall thickness will increase the yield strength of the tube. For example, it has been found that manufacturing the tube with the drawn wall 74 having a thickness of 4.0 millimeters from a starting billet having a diameter of 100 millimeters can generate yield strength in the resultant drawn tube 32 of about 1000 MPa, given the appropriate material chemistry and forging temperature. However, if the thickness of the drawn wall 74 were to be 6.0 millimeters from the billet 34 having the diameter of 100 millimeters at the given forging temperature may only generate a resultant drawn tube 32 with the yield strength of about 750 MPa, and would require special in-process or post-process cooling practices (described below) to attain the yield strength of 1000 MPa.

The forging temperature of the extruded tube 30 prior to forming the drawn tube 32 is selected to balance several competing factors. The resultant yield strength of the drawn tube 32 will increase for a given forging process sequence as the forging temperature is decreased. However, the forces required to change from the billet 34 to the drawn tube 32 will increase as the forging temperature is decreased. If the forging temperature is too low, the energy required to change the billet 34 into the drawn tube 32 may exceed the capacity of the selected forging machine.

As generally discussed above, special cooling practices within the method may also be used to attain the desired yield strength of the drawn tube 32. It is known that conducting the final draw operation at lower temperatures will increase the resultant yield strength. However, conducting the prior extruding step at that same lower temperature may exceed the available energy of the extruding equipment. One approach to solve this problem is to pass the extruded tube 30 through water cooling rings just prior to the final draw operation to lower the temperature of the extruded tube 30 and allow the drawn tube 32 to attain the desired yield strength. An alternative for in-process cooling would be to delay the extruded tube 30 transportation from the second die assembly 88 to the third die assembly 94 to allow the extruded tube 30 to cool. For example, the extruded tube 30 can be placed into a cooling conveyor until the desired temperature of the extruded tube 30 is reached. Then the extruded tube 30 can be inserted into the third die assembly 94 for the final draw operation. Additionally, a separate machine could also be used for housing the third die assembly 94 for completing the final draw operation if desired.

Finally, post-forging process rapid cooling can be used to boost the yield strength of a drawn tube 32. With this technique the temperature of the billet 34 is selected to be high enough so that the temperature of the drawn tube 32 is still above a critical temperature (typically about 720 degrees Celsius (1330 degrees Fahrenheit)) after the drawn tube 32 exits the final draw operation. The drawn tube 32 is then immediately and rapidly cooled with water or forced air to attain the desired yield strength. However, the temperature of the billet 34 may be too high, which can negatively affect the mandrels 84, 90, 96 and die assemblies 82, 88, 94 if the cooling methods used for the mandrels 84, 90, 96 and die assemblies 82, 88, 94 do not have the capacity to remove enough heat to prevent excessive softening of the mandrels 84, 90, 96 and die assemblies 82, 88, 94, especially with high production rates. Also, care must be taken so that the rapid cooling method does not induce excessive runout in the drawn tube 32 that will cause problems in subsequent machining operations.

In each of the manufacturing methods described above, when the third die assembly 94 is present, the method may include a skip stroke process to produce the drawn tube 32. For example, the billet 34 may be disposed within the first die assembly 82 and the extruded tube 30 may be disposed within the third die assembly 94 with the second die assembly 88 remaining empty. The skip stroke method includes the steps of forming the billet 34 within the cavity 86 of the first die assembly 82 to produce the second pre-formed billet 36B and forming the extruded tube 30 within the third die assembly 94 to produce the drawn tube 32.

Apparatus Having a Mandrel Assembly

Figure 16:
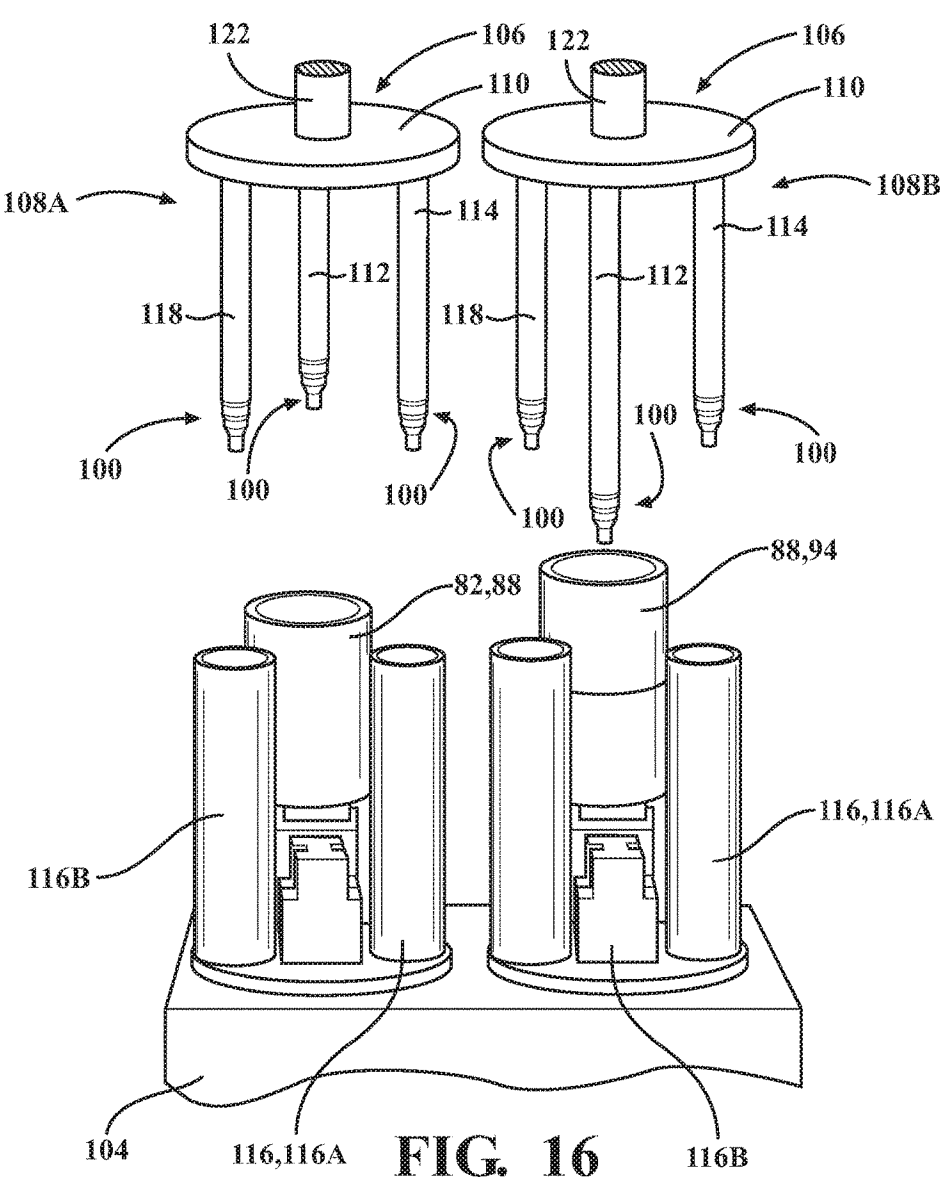
FIG. 16 is a perspective view of the apparatus having a first mandrel assembly and a second mandrel assembly.
Figure 15:
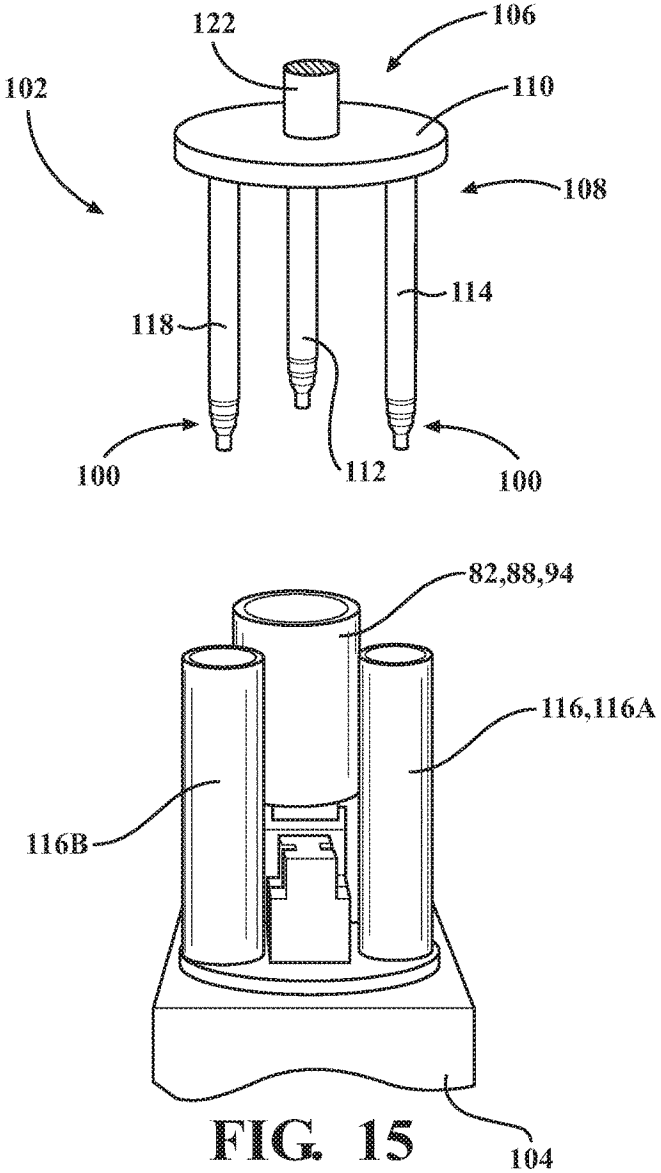
FIG. 15 is a perspective view of an apparatus having a mandrel assembly.
Figure 17:
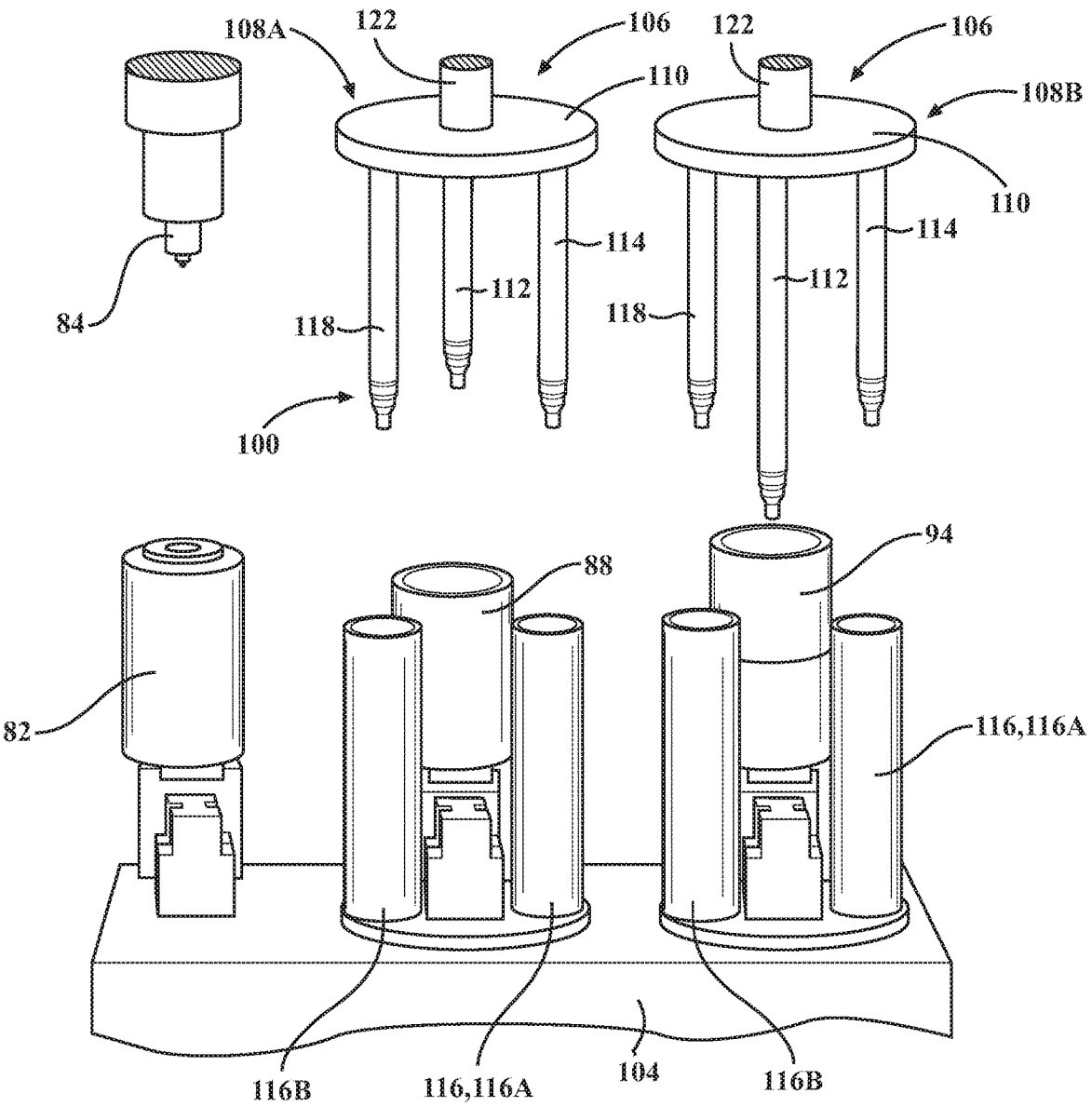
FIG. 17 is a perspective view of the apparatus of FIG. 16 further including another die cavity.

With reference to FIGS. 15-17, the present disclosure is also directed towards an apparatus 102 for manufacturing the extruded tube 30 or the drawn tube 32 for housing the axle shaft. The apparatus 102 includes a die assembly 82, 88, 94 coupled to a fixed base 104. It is to be appreciated that the die assembly 82, 88, 94 of the apparatus 102 may be any one of the first, second, and third die assemblies 82, 88, 94 described above. However, as described below, the die assembly 82, 88, 94 of the apparatus 102 is typically the second die assembly 88 that was described above. As such, the second die assembly 88 is coupled to the fixed base 104 of the apparatus 102. Furthermore, as described above and shown in FIG. 35, the second die assembly 88 may be further defined as the initial and later stage second die assemblies 128, 130. As such, any description below applicable to second die assembly 88 is also applicable to the initial and later stage second die assemblies 128, 130.

Figure 35:
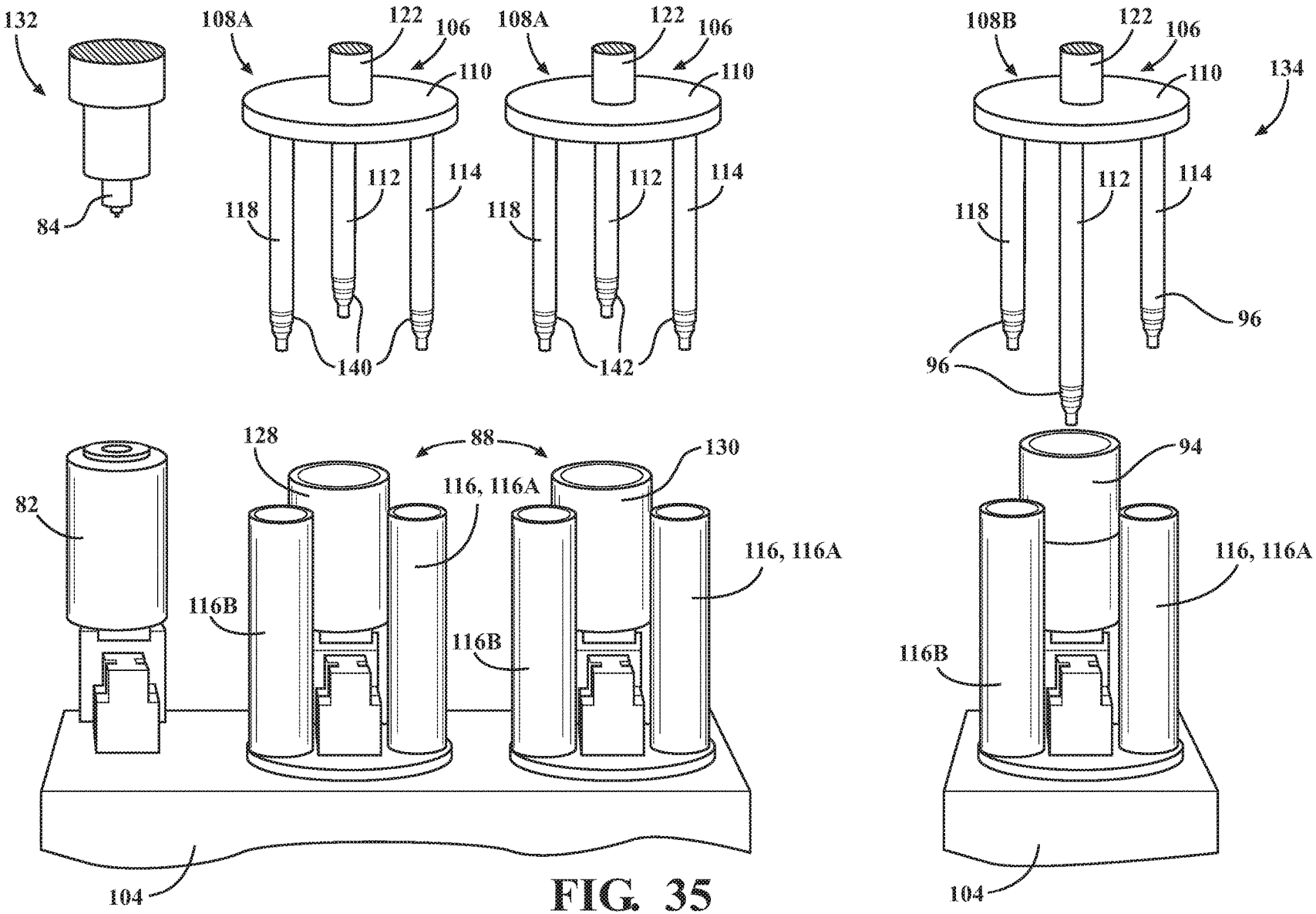
FIG. 35 is a perspective view of the apparatus of FIG. 16 having the first die assembly, the initial and later second die assemblies, and the third die assembly.

Returning to FIGS. 15-17, the die assembly 82, 88, 94 defines the cavity 86, 92, 98 therein and is configured to receive one of the billet 34, the pre-formed billet 36, or the extruded tube 30 depending on which of the first, second, and third die assemblies 82, 88, 94 are selected for use with the apparatus 102. The apparatus 102 includes a single press structure 106 moveable toward and then away from the fixed base 104. Alternatively, as described above, further below, and shown in the Figures, the may be multiple presses as shown in FIG. 35, the drawn tube 32 may be formed using the first machine 132 and the second machine 134 which have a press structure 106A, B and a fixed base 104A, B. For the sake of simplicity, any description of the single press structure 106 and the fixed base 104 (and any corresponding components) below are applicable to the press structure 106A, B and the fixed base 104A, B of the first and second machines 132, 134.

Returning to FIGS. 15-17, a mandrel assembly 108 is coupled to the single press structure 106. The mandrel assembly 108 comprises a rotatable platform 110 coupled to the single press structure 106. The rotatable platform 110 is rotatable relative to the single press structure 106. A first platform mandrel 112 is coupled to and extends from the rotatable platform 110 toward the fixed base 104 with the first platform mandrel 112 configured to enter the cavity 86, 92, 98 of the die assembly 82, 88, 94. A second platform mandrel 114 is also coupled to and extends from the rotatable platform 110 toward the fixed base 104 with the second platform mandrel 114 configured to enter the cavity 86, 92, 98 of the die assembly 82, 88, 94.

One of the first and second platform mandrels 112, 114 is aligned with the die assembly 82, 88, 94. For example, when the first platform mandrel 112 is aligned with the die assembly 82, 88, 94, the second platform mandrel 114 is not aligned with the die assembly 82, 88, 94. Rotation of the rotatable platform 110 selectively aligns either the first platform mandrel 112 or the second platform mandrel 114 with the cavity 86, 92, 98 of the die assembly 82, 88, 94. For example, when the first platform mandrel 112 is aligned with the cavity 86, 92, 98 of the die assembly 82, 88, 94, rotation of the rotatable platform 110 results in the alignment of the second platform mandrel 114 with the cavity 86, 92, 98 of the die assembly 82, 88, 94 and results in the non-alignment of the first platform mandrel 112 and the die assembly 82, 88, 94.

The apparatus 102 may include a container 116 coupled to the fixed base 104 adjacent the die assembly 82, 88, 94 with the container 116 including a cooling fluid, a lubricating fluid, and/or a combination thereof therein and configured to receive the second platform mandrel 114 as the first platform mandrel 112 enters the cavity 86, 92, 98 of the die assembly 82, 88, 94 for cooling the second platform mandrel 114.

Additionally, the apparatus 102 may include a third platform mandrel 118 coupled to and extending from the rotatable platform 110 toward the fixed base 104. As such rotation of the rotatable platform 110 aligns one of the first platform mandrel 112, the second platform mandrel 114, and the third platform mandrel 118 with the cavity 86, 92, 98 of the die assembly 82, 88, 94.

In one embodiment, the container 116 is further defined as a first container 116A and the apparatus 102 includes a second container 116B coupled to the fixed base 104 adjacent the die assembly 82, 88, 94 and the first container 116A. The second container 116B includes the lubricating fluid therein and is configured to receive the third platform mandrel 118 as the first platform mandrel 112 enters the cavity 86, 92, 98 of the die assembly 82, 88, 94 and the second platform mandrel 114 enters the first container 116A. However, it is to be appreciated that the second container 116B may include the cooling fluid, the lubricating fluid or a combination thereof.

In another embodiment, the mandrel assembly 108 is further defined as a first mandrel assembly 108A and the apparatus 102 includes a second mandrel assembly 108B and another die assembly 82, 88, 94. Typically, the die assembly 82, 88, 94 is the second die assembly 88 described above and the another die assembly 82, 88, 94 is the third die assembly 94 described above. When the another die assembly 82, 88, 94 is the third die assembly 94, the third die assembly 94 is coupled to the fixed base 104 and defines the cavity 98 therein configured to receive the extruded tube 30.

The second mandrel assembly 108B is coupled to the single press structure 106. Similar to the first mandrel assembly 108A, the second mandrel assembly 108B comprises a rotatable platform 110 coupled to the single press structure 106 with the rotatable platform 110 rotatable relative to the single press structure 106. The second mandrel assembly 108B includes a first platform mandrel 112 coupled to and extending from said rotatable platform 110 toward the fixed base 104 with the first platform mandrel 112 of the second mandrel assembly 108B configured to enter the cavity 86, 92, 98 of the another die assembly 82, 88, 94. A second platform mandrel 114 is coupled to and extending from the rotatable platform 110 toward the fixed base 104 with the second platform mandrel 114 of the second mandrel assembly 108B configured to enter the cavity 92 of the second die assembly 88. Rotation of the rotatable platform 110 of the second mandrel assembly 108B aligns either the first platform mandrel 112 of the second mandrel assembly 108B or the second platform mandrel 114 of the second mandrel assembly 108B with the cavity 86, 92, 98 of the another die assembly 82, 88, 94.

It is to be appreciated that the platform mandrels 112, 114, 118 be fixed, or may shuttle along a linear slide.

Method of Manufacturing the Article Using the Apparatus

A method of manufacturing the article using the apparatus 102 is described below. The apparatus 102 has the fixed base 104 and the single press structure 106 movable toward the fixed base 104. The apparatus 102 includes the die assembly 82, 88, 94 coupled to the fixed base 104. It is to be appreciated that the die assembly 82, 88, 94 of the apparatus 102 may be any one of the first, second, and third die assemblies 82, 88, 94 described above. Furthermore, the second die assembly 88 may be further defined as the initial and final stage second die assemblies 128, 130 as described above. The apparatus 102 includes the container 116 coupled to the fixed base 104 spaced from the die assembly 82, 88, 94 and the mandrel assembly 108. The mandrel assembly 108 includes the rotatable platform 110 coupled to the single press structure 106, the first platform mandrel 112 coupled to and extending from the rotatable platform 110 toward the fixed base 104, and the second platform mandrel 114 coupled to and extending from the rotatable platform 110 toward the fixed base 104.

The method of using the apparatus 102 comprises the steps of placing the starting component into the cavity 86, 92, 98 of the die assembly 82, 88, 94 and pressing the starting component into the cavity 86, 92, 98 of the die assembly 82, 88, 94 with the first platform mandrel 112 to form the first starting component into the article. The method of using the apparatus 102 also includes the steps of moving the second platform mandrel 114 into the container 116 simultaneously with the step of pressing the starting component with the first platform mandrel 112, removing the article from the die assembly 82, 88, 94 and placing the second starting component into the cavity 86, 92, 98 of the die assembly 82, 88, 94. The method of using the apparatus 102 further includes the steps of rotating the rotatable platform 110 to align the second platform mandrel 114 with the die assembly 82, 88, 94 and to align the first platform mandrel 112 with the container 116, pressing the second starting component into the cavity 86, 92, 98 of the die assembly 82, 88, 94 with the second platform mandrel 114 to form the second starting component into another article, and moving the first platform mandrel 112 into the container 116 simultaneously with the step of pressing the second starting component with the second platform mandrel 114.

It is to be appreciated that when the container 116 contains the cooling fluid and/or lubricating fluid, the step of moving the second platform mandrel 114 into the container 116 may be further defined as cooling the second platform mandrel 114 simultaneously with the step of pressing the first starting component with the first platform mandrel 112. It is also to be appreciated that the container 116 may be further defined as a first container 116A and the apparatus 102 includes the second container 116B spaced from the die assembly 82, 88, 94 and the first container 116A. In such an embodiment, the mandrel assembly 108 includes the third platform mandrel 118 coupled to and extending from the rotatable platform 110. As such, the method of using the apparatus 102 further comprises the step of moving the third platform mandrel 118 into the second container 116B simultaneously with the step of pressing the first starting component with the first platform mandrel 112. Furthermore, when the apparatus 102 includes the first and second containers 116A, 116B, the first container 116A contains the cooling fluid and the second container 116B contains the lubricating fluid. In such an embodiment, the step of moving the second platform mandrel 114 into the first container 116A is further defined as cooling the second platform mandrel 114 with the cooling fluid simultaneously with the step of pressing the first starting component with the first platform mandrel 112, and lubricating the third platform mandrel 118 with the lubricating fluid simultaneously with the step of pressing the first starting component with the first platform mandrel 112.

When the mandrel assembly 108 includes the third platform mandrel 118, the step of rotating the rotatable platform 110 to align the second platform mandrel 114 with the die assembly 82, 88, 94 is further defined as rotating the rotatable platform 110 to align the third platform mandrel 118 with the die assembly 82, 88, 94, to align the first platform mandrel 112 with the first container 116A, and to align the second mandrel 90 with the second container 116B.

It is to be appreciated that the apparatus 102 could be the single machine 120 described in detail below.

Method of Manufacturing the Tube Using the Apparatus

A method of manufacturing either the extruded tube 30 or the drawn tube 32 using the apparatus 102 is described below. As described above, the apparatus 102 includes the fixed base 104 and the single press structure 106 movable toward the fixed base 104. The apparatus 102 also includes the die assembly 82, 88, 94 coupled to the fixed base 104, the container 116 coupled to the fixed base 104 and spaced from the die assembly 82, 88, 94, and the mandrel assembly 108. The mandrel assembly 108 comprises the rotatable platform 110 coupled to the single press structure 106, the first platform mandrel 112 coupled to and extending from the rotatable platform 110 toward the fixed base 104, and the second platform mandrel 114 coupled to and extending from the rotatable platform 110 toward the fixed base 104.

The method of using the apparatus 102 to manufacture the tube comprises the steps of placing a first pre-formed billet 36A into the cavity 92 of the die assembly 88, pressing the first pre-formed billet 36A into the cavity 92 of the die assembly 88 with the first platform mandrel 112 to elongate the first pre-formed billet 36A to produce an extruded tube 30, and moving the second platform mandrel 114 into the container 116 simultaneously with the step of pressing the first pre-formed billet 36A with the first platform mandrel 112. The method of using the apparatus 102 to manufacture the tube also includes the steps of removing the extruded tube 30 from the die assembly 88, placing a second pre-formed billet 36B into the cavity 92 of the die assembly 88, and rotating the rotatable platform 110 to align the second platform mandrel 114 with the die assembly 88 and to align the first platform mandrel 112 with the container 116. The method of using the apparatus 102 to manufacture the tube further includes the steps of pressing the second pre-formed billet 36B into the cavity 92 of the die assembly 88 with the second platform mandrel 114 to elongate the second pre-formed billet 36B to produce another extruded tube 30, and moving the first platform mandrel 112 into the container 116 simultaneously with the step of pressing the second billet 34B with the second platform mandrel 114.

It is to be appreciated that the step of pressing the first pre-formed billet 36A into the cavity 92 may be further defined as extruding the pre-formed billet 36 to produce the extruded tube 30. It is also to be appreciated that the method of using the apparatus 102 to manufacture the tube could be used to produce a drawn tube 32 in addition to the extruded tube 30 as described above. For example, rather than placing a first pre-formed billet 36A into the die assembly 88, a first extruded tube 30A could be inserted into the die assembly 94. The subsequent step of pressing the extruded tube 30 into the cavity 98 would produce the drawn tube 32.

In an effort to further minimize the total extruded tube manufacturing time, the second mandrel 90 of the apparatus 102 may be further defined as the mandrel assembly 108. As described above, the mandrel assembly 108 includes the rotatable platform 110 coupled to the single press structure 106 with the rotatable platform 110 rotatable relative to the single press structure 106. A first platform mandrel 112 is coupled to and extends from the rotatable platform 110 toward the fixed base 104. Similarly, the second platform mandrel 114 is coupled to and extends from the rotatable platform 110 toward the fixed base 104. The rotatable platform 110 is rotatable relative to the single press structure 106 for selectively aligning either the first platform mandrel 112 or the second platform mandrel 114 with the cavity 92 of the second die assembly 88. As such, the apparatus 102 can switch between the first platform mandrel 112 or the second platform mandrel 114 for pressing the pre-formed billet 36 into the second die assembly 88. By switching between the first and second platform mandrels 112, 114, only one of the first and second platform mandrels 112, 114 is actually doing work to transform the pre-formed billet 36 into the extruded tube 30 while the other one of the first and second platform mandrels 112, 114 is allowed to cool. This type of cooling is referred to as offline cooling because one of the first and second platform mandrel 112, 114 is allowed to cool without delaying or stopping the apparatus 102 from continuing to work using the other one of the first and second platform mandrels 112, 114.

When the container 116 contains the cooling fluid, the step of moving the second platform mandrel 114 into the container 116 is further defined as cooling the second platform mandrel 114 simultaneously with the step of pressing the first pre-formed billet 36A with the first platform mandrel 112. It is to be appreciated that the container 116 may be further defined as the first container 116A and the apparatus 102 includes the second container 116B spaced from the die assembly 82, 88, 94 and the first container 116A. In such an embodiment, the mandrel assembly 108 includes the third platform mandrel 118 coupled to and extending from the rotatable platform 110 and the method further comprises the step of moving the third platform mandrel 118 into the second container 116B simultaneously with the step of pressing the first pre-formed billet 36A with the first platform mandrel 112. Additionally, when the first container 116A contains the cooling fluid and the second container 116B contains the lubricating fluid, the step of moving the second platform mandrel 114 into the first container 116A is further defined as, cooling the second platform mandrel 114 with the cooling fluid simultaneously with the step of pressing the first pre-formed billet 36A with the first platform mandrel 112, and lubricating the third platform mandrel 118 with the lubricating fluid simultaneously with the step of pressing the first pre-formed billet 36A with the first platform mandrel 112.

When the third platform mandrel 118 is present, the step of rotating the rotatable platform 110 to align the second platform mandrel 114 with the die assembly 88 is further defined as rotating the rotatable platform 110 to align the third platform mandrel 118 with the die assembly 88 to align the first platform mandrel 112 with the first container 116A, and to align the second mandrel 90 with the second container 116B.

In each of the manufacturing methods described above, when the third die assembly 94 is present, the method may include a skip stroke process to produce the drawn tube 32. For example, the billet 34 may be disposed within the first die assembly 82 and the extruded tube 30 may be disposed within the third die assembly 94 with the second die assembly 88 remaining empty. The skip stroke method includes the steps of forming the billet 34 within the cavity 86 of the first die assembly 82 to produce the second pre-formed billet 36B and forming the extruded tube 30 within the third die assembly 94 to produce the drawn tube 32.

It is to be appreciated that the apparatus 102 could be the single machine 120 described in detail below.

A Single Machine for Manufacturing the Tube

Generally, at least one machine is used to manufacture the extruded tube 30 or the drawn tube 32. In one embodiment, the extruded tube 30 is manufactured from the billet 34 using a single machine 120. As shown in FIGS. 6-10, the single machine 120 comprises the fixed base 104. The first die assembly 82 is coupled to the fixed base 104. The first die assembly 82 defines the cavity 86 therein configured to receive the billet 34. During operation of the machine, the first die assembly 82 is configured to hold the billet 34 so that the bore 40 can be formed in the end 38A of the billet 34 to produce the pre-formed billet 36.

The single machine 120 includes the second die assembly 88 coupled to the fixed base 104 and spaced from the first die assembly 82. The second die assembly 88 defines the cavity 92 therein and is configured to receive the pre-formed billet 36. During operation of the single machine 120, the second die assembly 88 is configured to hold the pre-formed billet 36 and to assist with extruding the pre-formed billet 36 into the extruded tube 30.

As described above, the second die assembly 88 may be further defined as the initial stage second die assembly 128 and the later stage second die assembly 130, which is generally shown in FIGS. 31-35. The second mandrel 90 may be further defined as an initial stage second mandrel 140 corresponding with the initial stage second die assembly 128 and a later stage second mandrel 142 corresponding with the later stage second die assembly 130. The initial and later stage second mandrels 140, 142 may move simultaneously with the first mandrel 84 as the single press structure 106 moves towards and then away from the fixed base 104 such that the initial stage second mandrel 140 enters the cavity 136 of the initial stage second die assembly 128 and the later stage second mandrel 142 enters the cavity 138 of the later stage second die assembly 130 as the single press structure 106 moves towards the fixed base 104. The initial stage second mandrel 140 may press the pre-formed billet 36 in the cavity 136 of the initial stage second die assembly 128. The later stage second mandrel 142 may press the preliminarily extruded tube 126 in the cavity 138 of the later stage second die assembly 130.

Returning to FIGS. 6-10, the single machine 120 also includes the single press structure 106 moveable toward and then away from the fixed base 104. Said differently, the single press structure 106 has a starting position, shown in FIG. 6, and a pressed position, shown in FIG. 10, in which the single press structure 106 has moved closer to the fixed base 104. As such, the single press structure 106 is moveable between the starting position and the pressed position. A moveable component 122 of the single press structure 106 is responsible for moving the single press structure 106 between the starting and pressed positions. The moveable component 122 may move by any suitable method, such as hydraulically or mechanically.

Figure 8A:
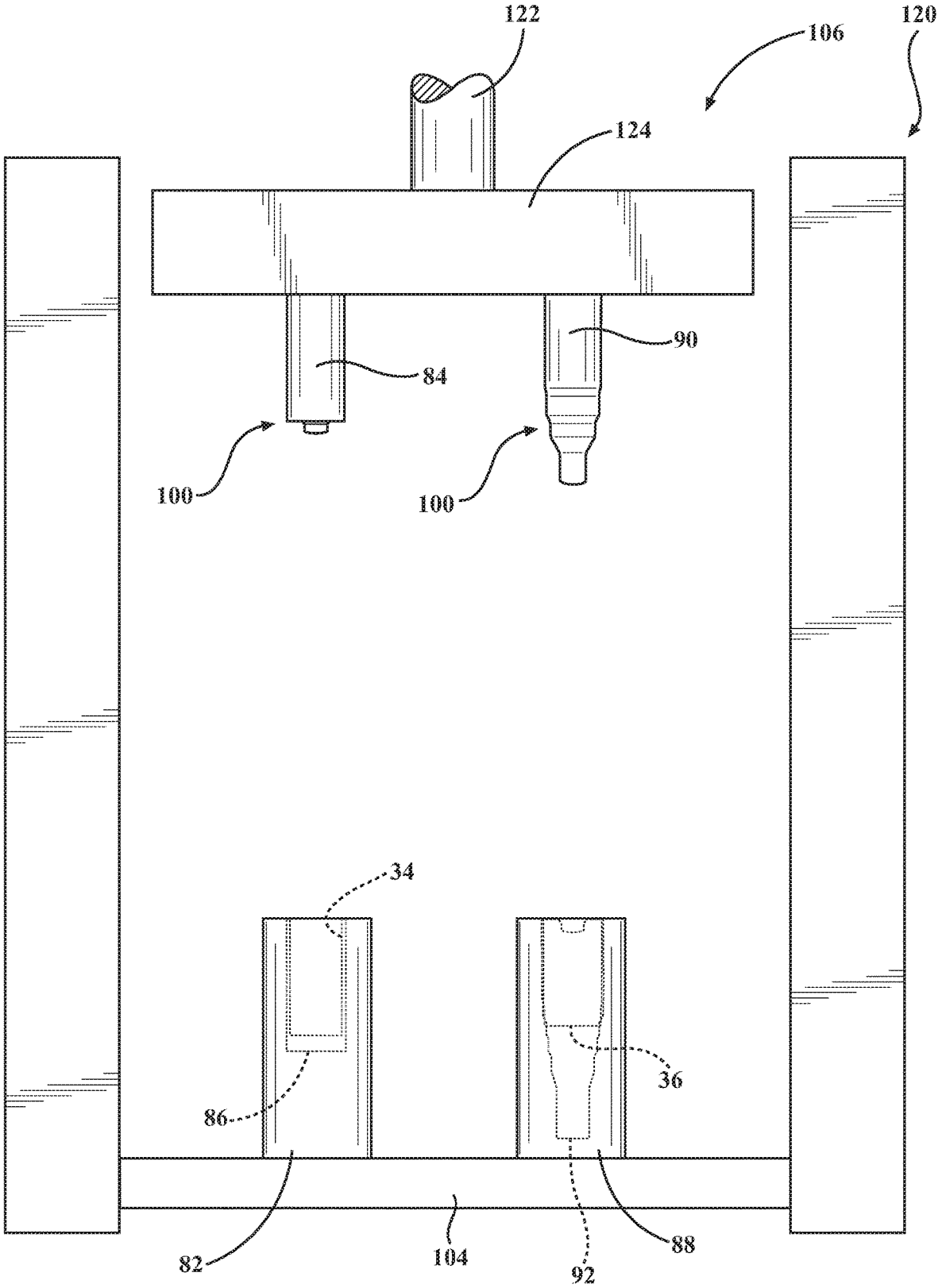
FIG. 8A is a front view of the single machine with the billet and the pre-formed billet inserted into cavities of a respective one of the first die assembly and the second die assembly.
Figure 8B:
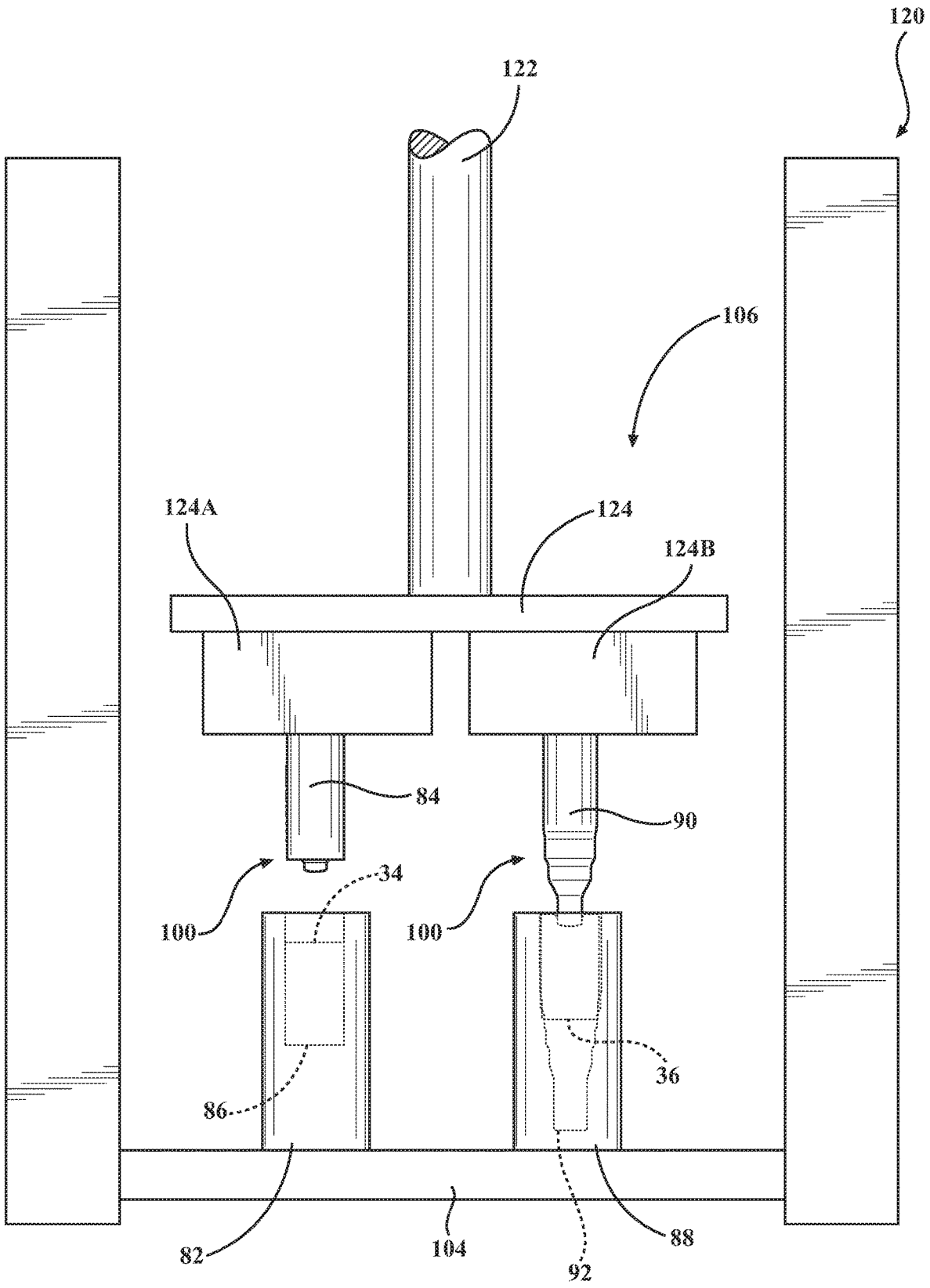
FIG. 8B is a front view of the single machine with the single press structure having multiple press plates.
Figure 9:
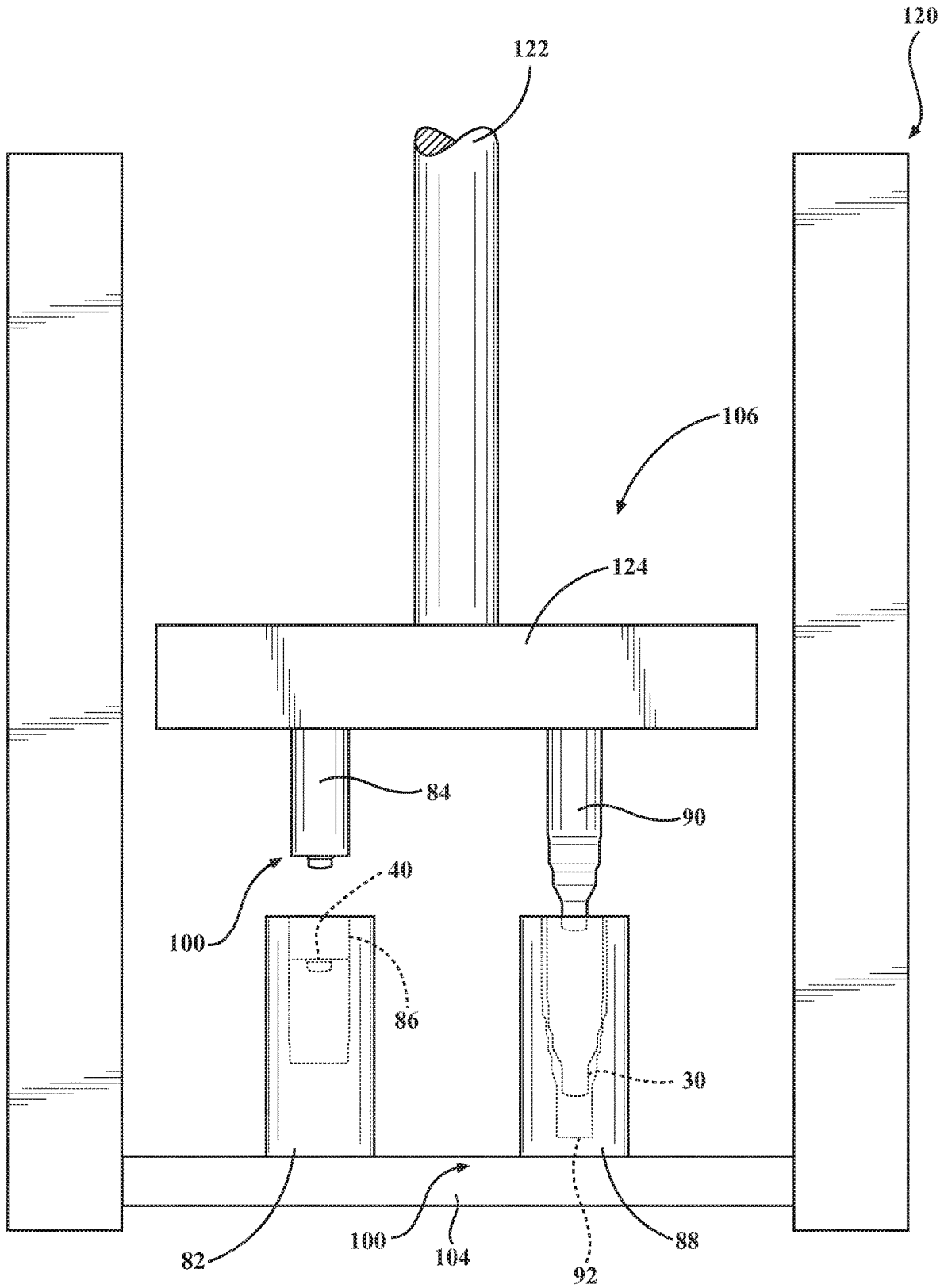
FIG. 9 is a front view of the single machine with the single press structure moving from a starting position towards a pressed position.
Figure 10:
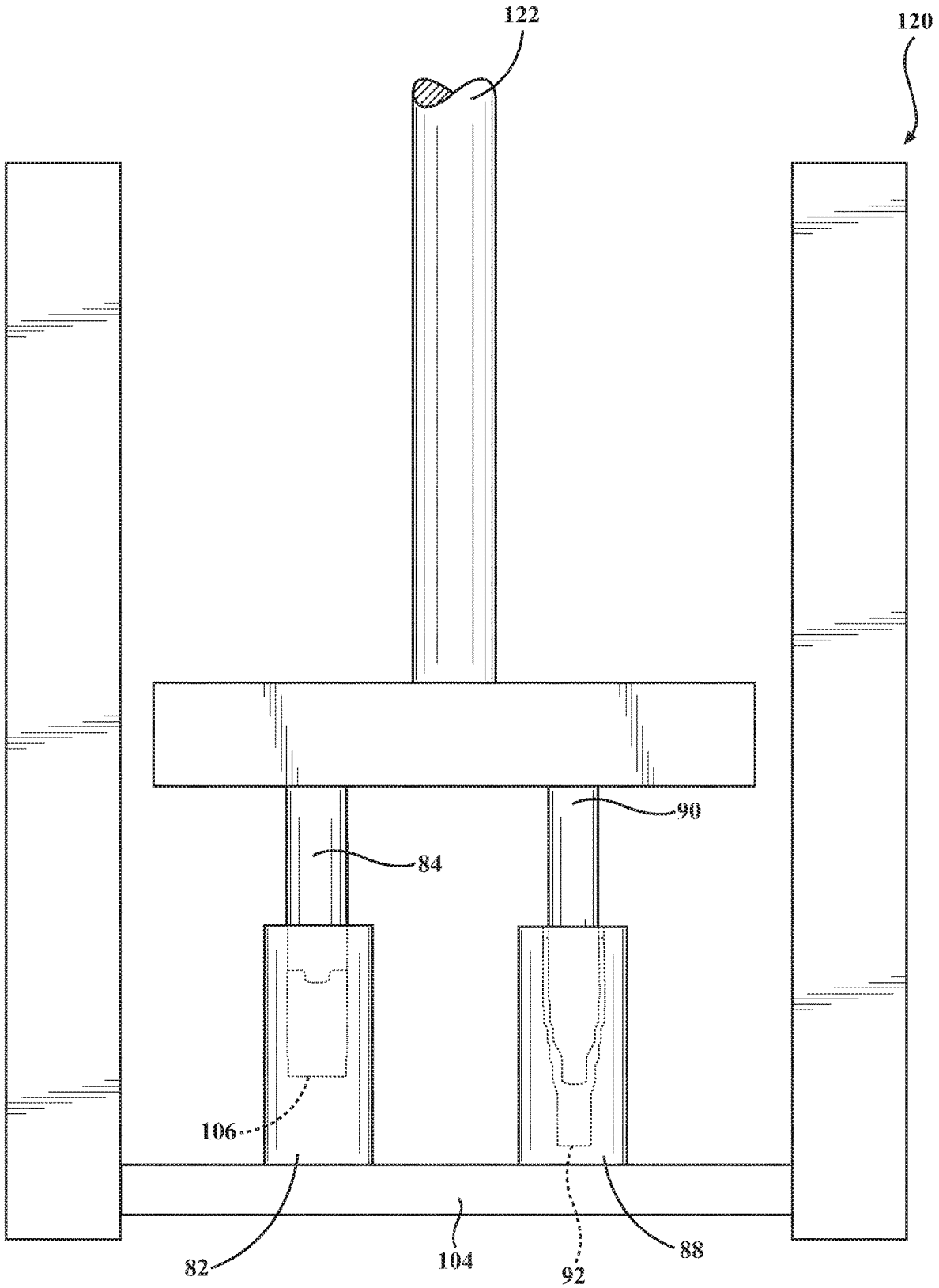
FIG. 10 is a front view of the single machine with the single press structure in the pressed position.

It is to be appreciated that the single press structure 106 may include a single press plate 124 coupled to the moveable component 122. Alternatively. The single press structure 106 may include multiple press plates 124A, 124B, as shown in FIG. 8B, with each of the multiple press plates 124A, 124B coupled to the moveable component 122.

The single press structure 106 comprises the first mandrel 84 aligned with the cavity 86 of the first die assembly 82. The single press structure 106 also comprises the second mandrel 90 aligned with the cavity 92 of the second die assembly 88. For example, the first and second mandrels 84, 90 may be coupled to the single press plate 124. Alternatively, the first and second mandrels 84, 90 may be coupled to a respective one of the multiple press plates 124A, 124B. Because the first and second mandrels 84, 90 are coupled to the single press plate 124 or a respective one of the multiple press plates 124A, 124B and the multiple press plates 124A, 124B are coupled to the same moveable component 122, the first and second mandrels 84, 90 move simultaneously with each other as the single press structure 106 moves towards and then away from the fixed base 104. When the single press structure 106 moves toward the fixed base 104 from the starting position to the pressed position, the first mandrel 84 enters the cavity 86 of the first die assembly 82 and the second mandrel 90 enters the cavity 92 of the second die assembly 88 as the single press structure 106 moves towards the fixed base 104.

The term single machine 120 as used herein is meant to convey that the use of moveable component 122 even though multiple die assemblies 82, 88, 94 may be used. For example, even though the single machine 120 has the first and second die assemblies 82, 88 and the first and second mandrels 84, 90, it is still considered a single machine 120 because it only has a single press structure 106 moveable by the single moveable component 122 common to both the first and second die assemblies 82, 88, 94.

Method of Manufacturing the Tube with the Single Machine

A method of manufacturing the tube, when the tube is the extruded tube 30, with the single machine 120 comprises the steps of placing the billet 34 into the cavity 86 of the first die assembly 82 and pressing the billet 34 into the cavity 86 of the first die assembly 82 with the first mandrel 84 that is coupled to the single press structure 106. The pressing of the first mandrel 84 into the billet 34 forms a bore 40 at one end of the billet 34 thereby producing the pre-formed billet 36.

It is to be appreciated that the step of pressing the first mandrel 84 into the billet 34 may be further defined as extruding the pre-formed billet 36 by cycling the single press structure 106 towards and then away from the fixed base 104 to elongate the pre-formed billet 36 and form the hollow interior 42 therein thereby producing the extruded tube 30. Said differently, the billet 34 may be transformed into the pre-formed billet 36 by forward and/or backward extrusion that is accomplished within the first die assembly 82.

The method further includes the steps of moving the pre-formed billet 36 from the cavity 86 of the first die assembly 82 to the cavity 92 of the second die assembly 88. Then the pre-formed billet 36 is pressed into the cavity 92 of the second die assembly 88 with the second mandrel 90 that is coupled to the single press structure 106 to elongate the pre-formed billet 36 and form the hollow interior 42 therein to produce the extruded tube 30.

The method has a total extruded tube manufacturing time to produce the extruded tube 30. Because the first and second die assemblies 82, 88 are within the single machine 120 and the because the first and second mandrels 84, 90 are coupled to the single press structure 106, the total extruded tube manufacturing time is minimized relative to conventional tube manufacturing practices. More specifically, because the use of the single machine 120 eliminates the use of multiple machines to produce the extruded tube 30, any additional steps of heating or lubricating parts and the time to move parts between multiple machines is eliminated, which reduces the total extruded tube manufacturing time.

Typically, the total extruded tube manufacturing time to complete the steps of placing a billet 34, pressing the billet 34 to produce the pre-formed billet 36; moving the pre-formed billet 36, and pressing the pre-formed billet 36 to produce the extruded tube 30 is of from about 15 to about 120 seconds, more typically of from about 15 to about 60 seconds, and even more typically of from about 15 to about 30 seconds.

In an effort to further minimize the total extruded tube manufacturing time, the second mandrel 90 of the single machine 120 may be further defined as the mandrel assembly 108. As described above, the mandrel assembly 108 includes the rotatable platform 110 coupled to the single press structure 106 with the rotatable platform 110 rotatable relative to the single press structure 106. A first platform mandrel 112 is coupled to and extends from the rotatable platform 110 toward the fixed base 104. Similarly, the second platform mandrel 114 is coupled to and extends from the rotatable platform 110 toward the fixed base 104. The rotatable platform 110 is rotatable relative to the single press structure 106 for selectively aligning either the first platform mandrel 112 or the second platform mandrel 114 with the cavity 92 of the second die assembly 88. As such, the single machine 120 can switch between the first platform mandrel 112 or the second platform mandrel 114 for pressing the pre-formed billet 36 into the second die assembly 88. By switching between the first and second platform mandrels 112, 114 only one of the first and second platform mandrels 112, 114 is actually doing work to transform the pre-formed billet 36 into the extruded tube 30 while the other one of the first and second platform mandrels 112, 114 is allowed to cool. This type of cooling is referred to as offline cooling because one of the first and second platform mandrel 112, 114 is allowed to cool without delaying or stopping the single machine 120 from continuing to work using the other one of the first and second platform mandrels 112, 114.

The single machine 120 may include the container 116 coupled to the fixed base 104 adjacent the second die assembly 88. The container 116 includes the cooling fluid therein and is configured to receive the second platform mandrel 114 as the first platform mandrel 112 enters the cavity 92 of the second die assembly 88 for cooling the second platform mandrel 114.

Additionally, the mandrel assembly 108 of the single machine 120 may include the third platform mandrel 118 coupled to and extending from the rotatable platform 110 toward the fixed base 104. Rotation of the rotatable platform 110 aligns one of the first platform mandrel 112, the second platform mandrel 114, and the third platform mandrel 118 with the cavity 92 of the second die assembly 88.

When the mandrel assembly 108 of the single machine 120 includes the third platform mandrel 118, the container 116 of the single machine 120 is further defined as the first container 116A and the single machine 120 further comprises the second container 116B. The second container 116B is coupled to the fixed base 104 adjacent the second die assembly 88 and the first container 116A. The second container 116B includes the lubricating fluid therein and is configured to receive the third platform mandrel 118 as the first platform mandrel 112 enters the cavity 92 of the second die assembly 88 and the second platform mandrel 114 enters the first container 116A.

As described above and generally shown in FIGS. 31-35, the second die assembly 88 may be further defined as the initial stage second die assembly 128 and the later stage second die assembly 130. The second mandrel 90 may be further defined as the initial stage second mandrel 140 corresponding with the initial stage second die assembly 128 and the later stage second mandrel 142 corresponding with the later stage second die assembly 130. The step of pressing the pre-formed billet 36 into the cavity 92 of the second die assembly 88 may be further defined as the steps of backward extruding the pre-formed billet 36 with the initial stage second die assembly 128 and the initial stage second mandrel 140 by cycling the single press structure 106 towards and then away from the fixed base 104 to elongate the pre-formed billet 36 and form the hollow interior 42 therein thereby producing the preliminarily extruded tube 126, moving the preliminarily extruded tube 126 into the later stage second die assembly 130, and backward extruding the preliminarily extruded tube 126 with the later stage second die assembly 130 and the initial stage second mandrel 140 by cycling the single press structure 106 towards and then away from the fixed base 104 to further elongate the preliminarily extruded tube 126 thereby producing the extruded tube 30.

When the tube is to be the drawn tube 32, the single machine 120 further includes the third die assembly 94 coupled to the fixed base 104 and spaced from the first and second die assemblies 82, 88. The third die assembly 94 defines the cavity 98 configured to receive the extruded tube 30. When the single machine 120 includes the third die assembly 94, the single machine 120 includes the third mandrel 96 coupled to the single press structure 106 and aligned with the cavity 98 of the third die assembly 94. During operation of the single machine 120, the third die assembly 94 is configured to assist with drawing the extruded tube 30 to further elongate the extruded tube 30 to produce the drawn tube 32.

When the third mandrel 96 is present, the first, second, and third mandrels 84, 90, 96 move simultaneously with each other as the single press structure 106 moves towards and away from the fixed base 104 such that the first mandrel 84 enters the cavity 86 of the first die assembly 82, the second mandrel 90 enters the cavity 92 of the second die assembly 88, and the third mandrel 96 enters the cavity 98 of the third die assembly 94 as the single press structure 106 moves towards the fixed base 104.

Typically, the second mandrel 90 has a length of at least 600 millimeters and the third mandrel 96 has a length of at least 1,000 millimeters. Due to the length of the second and third mandrels 90, 96, the single press structure 106 must have a large enough stroke length to accommodate the second and third mandrels 90, 96 while allowing parts to be inserted into and removed from the second and third die assemblies 88, 94.

When the single machine 120 is to produce the drawn tube 32, the method described above further includes the steps of moving the extruded tube 30 from the cavity 92 of the second die assembly 88 to the cavity 98 of the third die assembly 94 and pressing the extruded tube 30 into the cavity 98 of the third die assembly 94 with the third mandrel 96 coupled to the single press structure 106 to elongate the extruded tube 30 and decrease the thickness of the extruded wall 58 of the extruded tube 30 thereby producing the drawn tube 32. It is to be appreciated that the step of pressing the extruded tube 30 may be further defined as drawing the extruded tube 30 by cycling the single press structure 106 towards and then away from the fixed base 104 to elongate the extruded tube 30 and decrease the thickness of the extruded wall 58 of the extruded tube 30 thereby producing the drawn tube 32.

The method has a total drawn tube manufacturing time to produce the drawn tube 32. Because the first, second, and third die assemblies 82, 88, 94 are within the single machine 120 and the because the first, second, and third mandrels 84, 90, 96 are coupled to the single press structure 106, the total drawn tube manufacturing time is minimized relative to conventional tube manufacturing practices. Typically, the total drawn tube manufacturing time to complete the steps of placing a billet 34, pressing the billet 34 to produce the pre-formed billet 36; moving the pre-formed billet 36, and pressing the pre-formed billet 36 to produce the extruded tube 30, moving the extruded tube 30, and pressing the extruded tube 30 to produce the drawn tube 32 is of from about 20 to about 240 seconds, more typically of from about 20 to about 120 seconds, and even more typically of from about 20 to about 40 seconds.

The drawn tube 32 produced by the single machine 120 has a yield strength typically of at least 600 MPa, even more typically of at least 700 MPa, and even more typically of at least 750 MPa.

When the full-float hollow axle tube 76 is desired, the method includes the step of machining the wheel end 62 of the drawn tube 32 to produce the full-float hollow axle tube 76 having the hollow interior 72 that spans the length of the full-float hollow axle tube 76.

When the single machine 120 is to be used to produce the drawn tube 32, the mandrel assembly 108 may be further defined as the first mandrel assembly 108A and the third mandrel 96 may be further defined as a second mandrel assembly 108B. Similar to the mandrel assembly 108 described above, the second mandrel assembly 108B includes the rotatable platform 110 coupled to the single press structure 106 with the rotatable platform 110 rotatable relative to the single press structure 106. The second mandrel assembly 108B also includes the first platform mandrel 112 coupled to and extending from the rotatable platform 110 toward the fixed base 104 and the second platform mandrel 114 coupled to and extending from the rotatable platform 110 toward the fixed base 104. Rotation of the rotatable platform 110 of the second mandrel assembly 108B aligns either the first platform mandrel 112 of the second mandrel assembly 108B or the second platform mandrel 114 of the second mandrel assembly 108B with the cavity 98 of the third die assembly 94.

It is to be appreciated that the method of manufacturing the extruded tube 30 and the method of manufacturing the drawn tube 32 with the single machine 120 may include at least one of the steps of lubricating the second mandrel 90 before the step of pressing the pre-formed billet 36 into the cavity 92 of the second die assembly 88 and cooling the second mandrel 90 before the step of lubricating the second mandrel 90.

Alternative Method of Manufacturing the Tube with the Single Machine

In an alternative method to produce the extruded tube 30 with the single machine 120, the method includes the steps of placing the billet 34 into the cavity 86 of the first die assembly 82 and placing the first pre-formed billet 36A having the bore 40 defined in one end 38A thereof into the cavity 92 of the second die assembly 88. The alternative method using the single machine 120 also includes the step of moving the single press structure 106 toward the fixed base 104 after the steps of placing the billet 34 into the first die assembly 82 and placing the pre-formed billet 36 into the second die assembly 88 such that the first mandrel 84 contacts the billet 34 in the first die assembly 82 and the second mandrel 90 contacts the first pre-formed billet 36A in the second die assembly 88. The step of moving the single press structure 106 completes the steps of forming the billet 34 within the cavity 86 of the first die assembly 82 to produce the second pre-formed billet 36B having the bore 40 defined in one end 38A thereof, and extruding the first pre-formed billet 36A within the cavity 92 of the second die assembly 88 to produce the extruded tube 30 having the hollow interior 42.

In the alternative method using the single machine 120 described above, the billet 34 may be further defined as the first billet 34A and the extruded tube 30 may be further defined as the first extruded tube 30A. As such, the alternative method of using the single machine 120 may include the steps of placing the second pre-formed billet 36B into the cavity 92 of the second die assembly 88, placing the second billet 34B into the cavity 86 of the first die assembly 82, and moving the single press structure 106 toward the fixed base 104 after the steps of removing the second pre-formed billet 36B, placing the second pre-formed billet 36 into the first die assembly 82, and placing the second billet 34B into the cavity 86 of the first die assembly 82. The step of moving the single press structure 106 completes the steps of forming the second billet 34B within the cavity 86 of the first die assembly 82 to produce the third pre-formed billet 36C having the bore 40 defined in one end 38A thereof, and extruding the second pre-formed billet 36B within the cavity 92 of the second die assembly 88 to produce the second extruded tube 30B having the hollow interior 42.

As described above and generally shown in FIGS. 31-35, the second die assembly 88 may be further defined as the initial stage second die assembly 128 and the later stage second die assembly 130. The second mandrel 90 may be further defined as the initial stage second mandrel 140 corresponding with the initial stage second die assembly 128 and the later stage second mandrel 142 corresponding with the later stage second die assembly 130. The step of placing the first pre-formed billet 36A having the bore 40 defined in one end thereof into the cavity 92 of the second die assembly 88 may be further defined as placing the first pre-formed billet 36A having the bore 40 defined in one end thereof into the cavity 136 of the initial stage second die assembly 128, and further comprising the step of placing the first preliminarily extruded tube 126A into the cavity 138 of the later stage second die assembly 130. The step of extruding the first pre-formed billet 36A within the cavity 92 of the second die assembly 88 may be further defined as the steps of backward extruding the first pre-formed billet 36A with the initial stage second die assembly 128 to elongate the first pre-formed billet 36A and form the hollow interior 42 therein thereby producing the second preliminarily extruded tube 126B and backward extruding the first preliminarily extruded tube 126A with the later stage second die assembly 130 to further elongate the first preliminarily extruded tube 126A thereby producing the extruded tube 30.

Furthermore, in the alternative method using the single machine 120 described above, the billet 34 may be further defined as the first billet 34A, the extruded tube 30 may be further defined as the first extruded tube 30A, and the single machine 120 further includes the third die assembly 94. In such an alternative method, the alternative method includes the steps of removing the second pre-formed billet 36B from the cavity 86 of the first die assembly 82, placing the second pre-formed billet 36B into the cavity 92 of the second die assembly 88, placing a second billet 34B into the cavity 86 of the first die assembly 82, removing the first extruded tube 30A from the cavity 92 of the second die assembly 88, placing the first extruded tube 30A into a cavity 98 of the third die assembly 94, and moving the single press structure 106 toward the fixed base 104 after the steps of placing the second billet 34B into the first die assembly 82, placing the second pre-formed billet 36B into the second die assembly 88, and placing the first extruded tube 30A into the third die assembly 94 such that the first mandrel 84 contacts the second billet 34B in the first die assembly 82, the second mandrel 90 contacts the second pre-formed billet 36B in the second die assembly 88, and the third mandrel 96 contacts the first extruded tube 30A in the third die assembly 94. The step of moving the single press structure 106 completes the steps of forming the second billet 34B within the cavity 86 of the first die assembly 82 to produce a third pre-formed billet 36C having a bore 40 defined in one end thereof, extruding the second pre-formed billet 36B within the cavity 92 of the second die assembly 88 to produce a second extruded tube 30B having a hollow interior 42, and drawing the first extruded tube 30A within the cavity 98 of the third die assembly 94 to produce a drawn tube 32 having a wall that has a thickness that is reduced relative to the first extruded tube 30A.

The alternative method using the single machine 120 may also include the steps of removing the second extruded tube 30B from the second die assembly 88, placing the second extruded tube 30B into the cavity 98 of the third die assembly 94, moving the single press structure 106 toward the fixed base 104 after the step of placing the second extruded tube 30B into the third die assembly 94 to complete the step of drawing the second extruded tube 30B within the cavity 98 of the third die assembly 94 to produce a second drawn tube 32 having a wall that has a thickness that is reduced relative to the second extruded tube 30B.

When the single machine 120 is to be used to produce the drawn tube 32, the mandrel assembly 108 may be further defined as the first mandrel assembly 108A and the third mandrel 96 may be further defined as a second mandrel assembly 108B. Similar to the mandrel assembly 108 described above, the second mandrel assembly 108B includes the rotatable platform 110 coupled to the single press structure 106 with the rotatable platform 110 rotatable relative to the single press structure 106. The second mandrel assembly 108B also includes the first platform mandrel 112 coupled to and extending from the rotatable platform 110 toward the fixed base 104 and the second platform mandrel 114 coupled to and extending from the rotatable platform 110 toward the fixed base 104. Rotation of the rotatable platform 110 of the second mandrel assembly 108B aligns either the first platform mandrel 112 of the second mandrel assembly 108B or the second platform mandrel 114 of the second mandrel assembly 108B with the cavity 98 of the third die assembly 94.

In each of the manufacturing methods described above, when the third die assembly 94 is present, the method may include a skip stroke process to produce the drawn tube 32. For example, the billet 34 may be disposed within the first die assembly 82 and the extruded tube 30 may be disposed within the third die assembly 94 with the second die assembly 88 remaining empty. The skip stroke method includes the steps of forming the billet 34 within the cavity 86 of the first die assembly 82 to produce the second pre-formed billet 36B and forming the extruded tube 30 within the third die assembly 94 to produce the drawn tube 32.

Manufacturing System Comprising a First Machine and a Second Machine for Manufacturing the Tube As generally described above and shown in FIGS. 31-35, the subject invention also provides for a manufacturing system 144 for manufacturing the tube that has the hollow interior 72 for housing the axle shaft, which transmits rotational motion from the prime mover to the wheel of the vehicle. The manufacturing system 144 comprises the first machine 132 which comprises the fixed base 104A and the first die assembly 82 coupled to the fixed base 104A. The first die assembly 82 defines the cavity 86 therein and is configured to form the bore 40 in the end of the billet 34 to produce the pre-formed billet 36.

The first machine 132 comprises the initial stage second die assembly 128 coupled to the fixed base 104A spaced from the first die assembly 82 and defining the cavity 136 therein with the initial stage second die assembly 128 configured to extrude the pre-formed billet 36 into the preliminarily extruded tube 126. The first machine 132 further comprises the later stage second die assembly 130 coupled to the fixed base 104A spaced from the initial stage second die assembly 128 and defining the cavity 138 therein. The later stage second die assembly 130 is configured to extrude the preliminarily extruded tube 126 into the extruded tube 30.

The first machine 132 comprises the press structure 106A moveable toward and then away from the fixed base 104A. The press structure 106A comprises the first mandrel 84 aligned with the cavity 86 of the first die assembly 82. The press structure 106A further comprises the initial stage second mandrel 140 aligned with the cavity 136 of the initial stage second die assembly 128 and the later stage second mandrel 142 aligned with the cavity 138 of the later stage second die assembly 130. The first mandrel 84 and the initial and later stage second mandrels 140, 142 move simultaneously with each other as the press structure 106A moves towards and then away from the fixed base 104A such that the first mandrel 84 enters the cavity 86 of the first die assembly 82, the initial stage second mandrel 140 enters the cavity 136 of the initial stage second die assembly 128, and the later stage second mandrel 142 enters the cavity 138 of the later stage second die assembly 130 as the press structure 106A moves towards the fixed base 104A.

The manufacturing system 144 further comprises the second machine 134. The second machine 134 comprises the fixed base 104B and the third die assembly 94 coupled to the fixed base 104B and defining the cavity 98 therein. The third die assembly 94 is configured to draw the extruded tube 30 to produce the drawn tube 32. The second machine 134 further comprises the press structure 106B moveable toward and then away from the fixed base 104B. The press structure 106B comprises the third mandrel 96 coupled to the press structure 106B and aligned with the cavity 98 of the third die assembly 94. The third mandrel 96 moves with the press structure 106B as the press structure 106B moves towards and away from the fixed base 104B such that the third mandrel 96 enters the cavity 98 of the third die assembly 94 as the press structure 106B moves towards the fixed base 104B.

One having skill in the art will appreciate that the manufacturing system 144 may comprise the apparatus 102 having the die assemblies 82, 88, 94 and the mandrel assemblies 84, 90, 96 as described above. Furthermore, although the second die assembly 88 and the second mandrel 90 described herein are further defined as the initial and later stage second die assemblies 128, 130 and the initial and later stage second mandrels 140, 142, respectively, it is to be appreciated that the second die assembly 88 and the second mandrel 90 may each be single units.

Method of Manufacturing the Tube with the First and Second Machines

As also generally described above and shown in FIGS. 31-35, the subject invention also provides for a method of manufacturing the tube.

The is tube formed in at least the first machine 132 and the second machine 134 each having the fixed base 104A, B and the press structure 106A, B movable toward the fixed base 104A, B, with the first die assembly 82 coupled to the fixed base 104A of the first machine 132, the second die assembly 88 coupled to the fixed base 104A of the first machine 132 and further defined as the initial stage second die assembly 128 and the later stage second die assembly 130, and the first mandrel 84 coupled to the press structure 106A of the first machine 132, the second mandrel 90 coupled to the press structure 106A of the first machine 132 and spaced from the first mandrel 84 further defined the the initial stage second mandrel 140 and the later stage second mandrel 142. The third die assembly 94 is coupled to the fixed base 104B of the second machine 134 and the third mandrel 96 is coupled to the press structure 106B of the second machine 134.

The method comprises the steps of placing the billet 34 into the cavity 86 of the first die assembly 82 and pressing the billet 34 into the cavity 86 of the first die assembly 82 with the first mandrel 84 coupled to the press structure 106A of the first machine 132 to form the bore 40 at one end of the billet 34 thereby producing the pre-formed billet 36.

The method further comprises the steps of moving the pre-formed billet 36 from the cavity 86 of the first die assembly 82 to the cavity 136 of the initial stage second die assembly 128 and pressing the pre-formed billet 36 into the cavity 136 of the initial stage second die assembly 128 with the initial stage second mandrel 140 coupled to the press structure 106A of the first machine 132 to elongate the pre-formed billet 36 and form the hollow interior 42 therein thereby producing the preliminarily extruded tube 126.

The method further comprises the steps of moving the preliminarily extruded tube 126 from the cavity 136 of the initial stage second die assembly 128 to the cavity 138 of the later stage second die assembly 130 and pressing the preliminarily extruded tube 126 into the cavity 138 of the later stage second die assembly 130 with the later stage second mandrel 142 coupled to the press structure 106A of the first machine 132 to further elongate the preliminarily extruded tube 126 thereby producing the extruded tube 30.

The method further comprises the steps of moving the extruded tube 30 from the cavity 138 of the later stage second die assembly 130 to the cavity 98 of the third die assembly 94 and pressing the extruded tube 30 into the cavity 98 of the third die assembly 94 with the third mandrel 96 coupled to the press structure 106B of the second machine 134 to elongate the extruded tube 30 and decrease the thickness of the wall of the extruded tube 30 thereby producing the drawn tube 32.

It is to be appreciated that each of the steps described above referring to the method of manufacturing the tube with the single machine 120 may be applied to the method of manufacturing the tube with the first and second machines 132, 134, described herein.

Alternative Method of Manufacturing the Tube with the First and Second Machines

Figure 36:
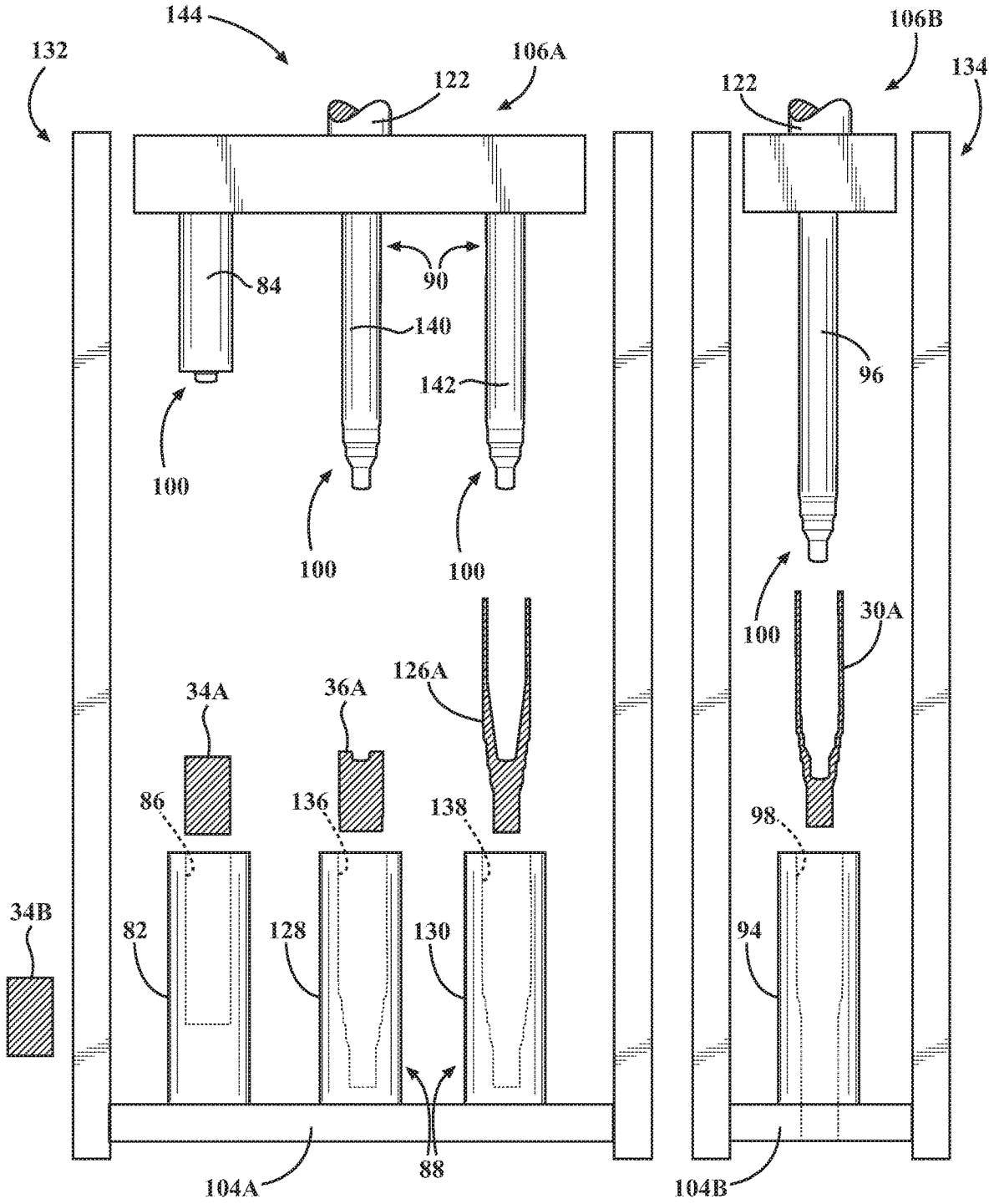
FIG. 36 is a front view of the first and second machines with the first billet, the first pre-formed billet, a first preliminarily extruded tube, and a first extruded tube positioned above a respective one of the first die assembly, the initial and later second die assemblies, and the third die assembly, and a second billet adjacent the single machine.
Figure 37:
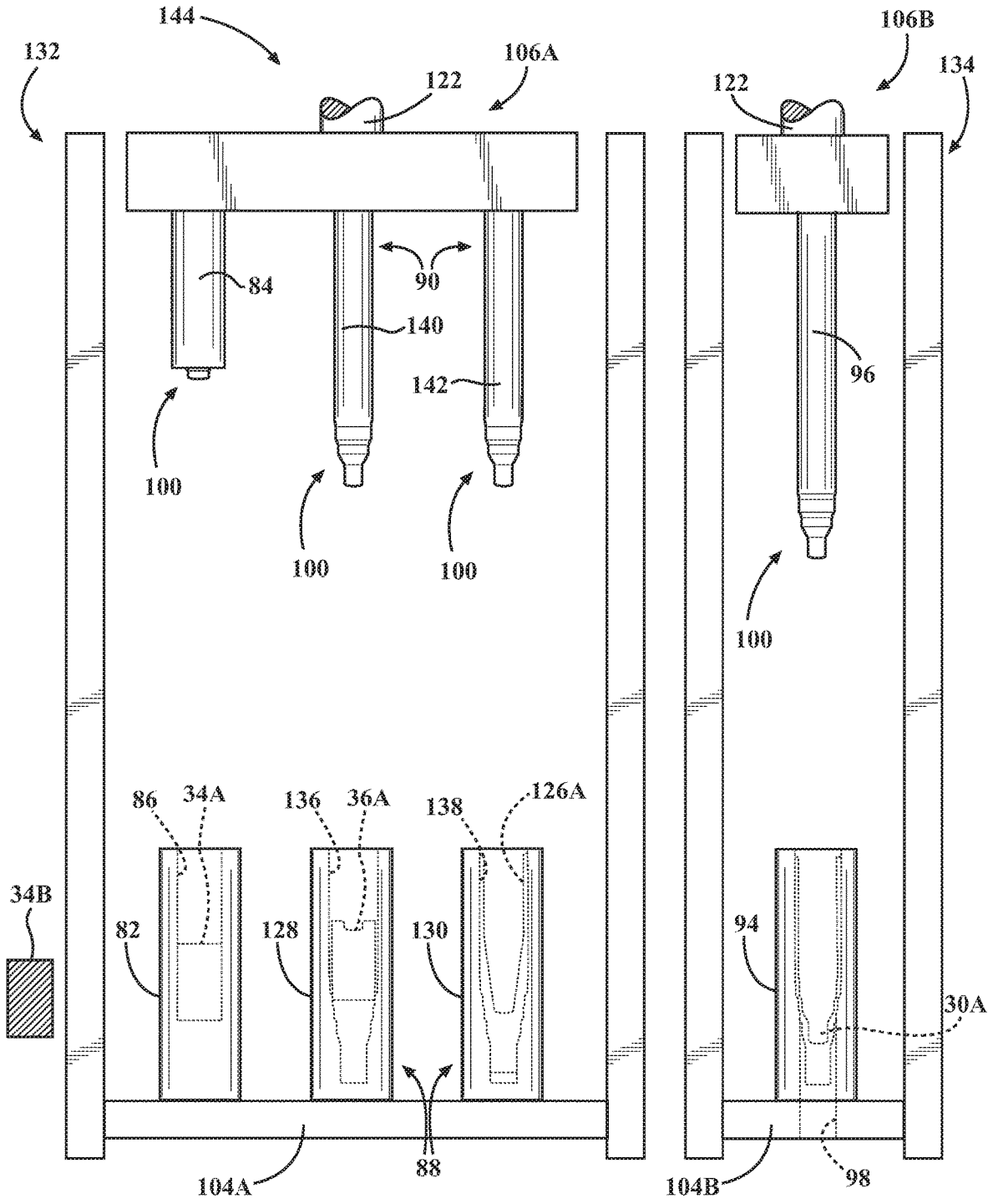
FIG. 37 is a front view of the first and second machines with the first billet, the first pre-formed billet, a first preliminarily extruded tube, and a first extruded tube positioned within a respective one of the cavities of the first die assembly, the initial and later second die assemblies, and the third die assembly, and the second billet adjacent the single machine.
Figure 38:
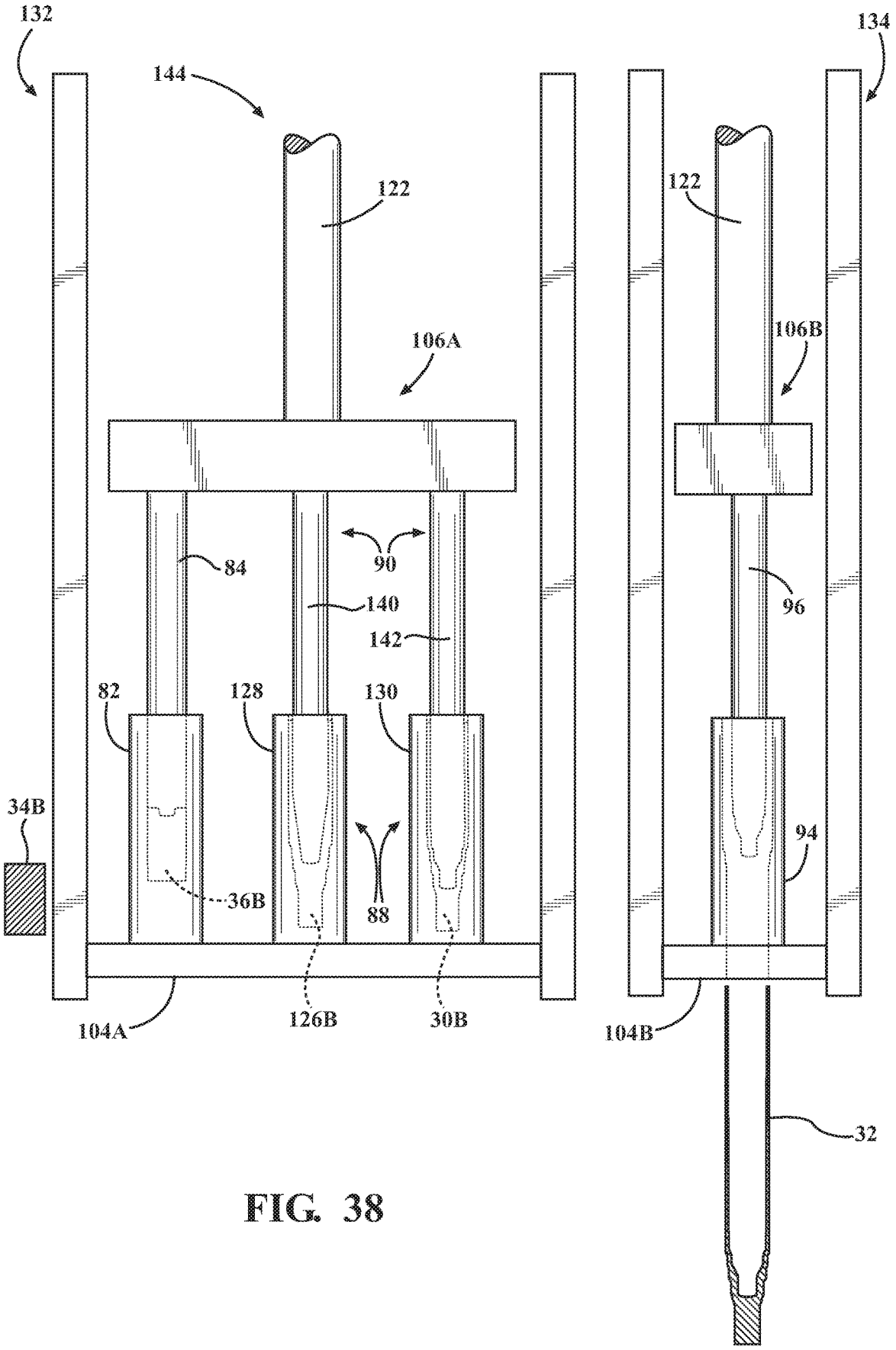
FIG. 38 is a front view of the first and second machines with the single press structure in the pressed position to produce a second pre-formed billet, a second preliminarily extruded tube, a second extruded tube, and the drawn tube.

The subject invention also provides for an alternative method of manufacturing the tube as shown in FIGS. 36-38. The tube is formed in at least the first machine 132 and the second machine 134 each having the fixed base 104A, B and the press structure 106A, B movable toward the fixed base 104A, B. The first die assembly 82 is coupled to the fixed base 104A of the first machine 132, the second die assembly 88 is coupled to the fixed base 104A of the first machine 132 and is further defined as the initial stage second die assembly 128 and the later stage second die assembly 130, the first mandrel 84 is coupled to the press structure 106A of the first machine 132, and the second mandrel 90 is coupled to the press structure 106A of the first machine 132 and is spaced from the first mandrel 84 further defined as the initial stage second mandrel 140 and the later stage second mandrel 142. The third die assembly 94 is coupled to the fixed base 104B of the second machine 134 and the third mandrel 96 is coupled to the press structure 106B of the second machine 134.

The method comprises the steps of placing the first billet 34A into the cavity 86 of the first die assembly 82, placing the first pre-formed billet 36A having the bore 40 defined in one end thereof into the cavity 136 of the initial stage second die assembly 128, placing the first preliminarily extruded tube 126A having the hollow interior 42 into the cavity 138 of the later stage second die assembly 130, and placing the first extruded tube 30A into the cavity 98 of the third die assembly 94. The method further comprises the steps of moving the press structure 106A of the first machine 132 toward the fixed base 104A after the steps of placing the first billet 34A into the first die assembly 82, placing the first pre-formed billet 36A into the initial stage second die assembly 128, and placing the first preliminarily extruded tube 126A into the later stage second die assembly 130 such that the first mandrel 84 contacts the first billet 34A in the first die assembly 82, the initial stage second mandrel 140 contacts the first pre-formed billet 36A in the initial stage second die assembly 128, and the later stage second mandrel 142 contacts the first preliminarily extruded tube 126A in the later stage second die assembly 130 to complete the steps of forming the first billet 34A within the cavity 86 of the first die assembly 82 to produce the second pre-formed billet 36B having the bore 40 defined in one end thereof, extruding the first pre-formed billet 36A within the cavity 136 of the initial stage second die assembly 128 to produce the second preliminarily extruded tube 126B having the hollow interior 42, and extruding the first preliminarily extruded tube 126A within the cavity 138 of the later stage second die assembly 130 to produce the second extruded tube 30B.

The method further comprises the steps of moving the press structure 106B of the second machine 134 toward the fixed base 104B after the step of placing the first extruded tube 30A into the cavity 98 of the third die assembly 94 to complete the step of drawing the first extruded tube 30A within the cavity 98 of the third die assembly 94 to produce the drawn tube 32 having the wall that has a thickness that is reduced relative to the first extruded tube 30A.

It is to be appreciated that each of the steps described above referring to the alternative method of manufacturing the tube with the single machine 120 may be applied to the alternative method of manufacturing the tube with the first and second machines 132, 134, described herein.

General Information

As alluded to above, it is to be appreciated that the apparatus 102 described above may be the single machine 120. Said differently, the single machine 120 may be used to manufacture the article and/or the tube with the inclusion of the mandrel assembly 108 described with the apparatus 102. Additionally, it is to be appreciated that the method of manufacturing the drawn tube 32 having a yield strength of at least 750 MPa can be performed using either the apparatus 102 or the single machine 120 described herein.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of manufacturing a tube having a hollow interior for housing an axle shaft, which transmits rotational motion from a prime mover to a wheel of a vehicle, with the tube formed in at least a first machine and a second machine each having a fixed base and a press structure movable toward the fixed base, a first die assembly coupled to the fixed base of the first machine, a second die assembly coupled to the fixed base of the first machine and further defined as an initial stage second die assembly and a later stage second die assembly, a first mandrel coupled to the press structure of the first machine, a second mandrel coupled to the press structure of the first machine and spaced from the first mandrel further defined as an initial stage second mandrel and a later stage second mandrel, a third die assembly coupled to the fixed base of the second machine, and a third mandrel coupled to the press structure of the second machine, said method comprising the steps of:

placing a billet into a cavity of the first die assembly;

pressing the billet into the cavity of the first die assembly with the first mandrel coupled to the press structure of the first machine to form a bore at one end of the billet thereby producing a pre-formed billet;

moving the pre-formed billet from the cavity of the first die assembly to a cavity of the initial stage second die assembly;

pressing the pre-formed billet into the cavity of the initial stage second die assembly with the initial stage second mandrel coupled to the press structure of the first machine to elongate the pre-formed billet and form a hollow interior therein thereby producing a preliminarily extruded tube;

moving the preliminarily extruded tube from the cavity of the initial stage second die assembly to a cavity of the later stage second die assembly;

pressing the preliminarily extruded tube into the cavity of the later stage second die assembly with the later stage second mandrel coupled to the press structure of the first machine to further elongate the preliminarily extruded tube thereby producing the extruded tube;

moving the extruded tube from the cavity of the later stage second die assembly to a cavity of the third die assembly; and pressing the extruded tube into the cavity of the third die assembly with the third mandrel coupled to the press structure of the second machine to elongate the extruded tube and decrease a thickness of a wall of the extruded tube thereby producing a drawn tube.

2. The method as set forth in claim 1, wherein a total extruded tube manufacturing time to complete the steps of placing a billet, pressing the billet to produce the pre-formed billet; moving the pre-formed billet, and pressing the pre-formed billet to produce the extruded tube is from 15 to 20 seconds.

3. The method as set forth in claim 1, wherein the step of pressing the pre-formed billet is further defined as the step of backward extruding the pre-formed billet with the initial stage second die assembly and the initial stage second mandrel by cycling the single press structure towards and then away from the fixed base to elongate the pre-formed billet and form the hollow interior therein thereby producing the preliminarily extruded tube.

4. The method as set forth in claim 1, wherein the step of pressing the preliminary extruded tube is further defined as the step of backward extruding the preliminarily extruded tube with the later stage second die assembly and the later stage second mandrel by cycling the single press structure towards and then away from the fixed base to further elongate the preliminarily extruded tube thereby producing the extruded tube.

5. The method as set forth in claim 1, wherein a total drawn tube manufacturing time to complete the steps of placing a billet, pressing the billet to produce the pre-formed billet; moving the pre-formed billet, and pressing the pre-formed billet to produce the extruded tube, moving the extruded tube, and pressing the extruded tube to produce the drawn tube is from 20 to 240 seconds.

6. The method as set forth in claim 1, wherein the thickness of the wall of the drawn tube is from 3 to 12 millimeters and the drawn tube has a yield strength of at least 600 MPa.

7. The method as set forth in claim 6, wherein the yield strength of the drawn tube is at least 700 MPa.

8. The method as set forth in claim 1, wherein the step of pressing the extruded tube into the cavity of the third die assembly is further defined as drawing the extruded tube by cycling the press structure of the second machine towards and then away from the fixed base to elongate the extruded tube and decrease a thickness of a wall of the extruded tube thereby producing a drawn tube.

9. The method as set forth in claim 1, further comprising a step of machining an end of the drawn tube to produce a full float hollow axle tube having a hollow interior that spans a length of the full float hollow axle tube.

10. The method as set forth in claim 1, wherein the drawn tube has a drawn wall having a thickness with the thickness of the drawn wall non-uniform about a circumference of the drawn tube.

11. The method as set forth in claim 1, further comprising a step of delaying the extruded tube transportation to the third die assembly to cool the extruded tube.

12. The method as set forth in claim 11, wherein the step of delaying the extruded tube transportation to the third die assembly is further defined as the steps of placing the extruded tube onto a cooling conveyor until the desired temperature of the extruded tube is reached and inserting the extruded tube into the third die assembly.

13. A method of manufacturing a tube having a hollow interior for housing an axle shaft, which transmits rotational motion from a prime mover to a wheel of a vehicle, with the tube formed in at least a first machine and a second machine each having a fixed base and a press structure movable toward the fixed base of the first machine, a first die assembly coupled to the fixed base of the first machine, a second die assembly coupled to the fixed base of the first machine and further defined as an initial stage second die assembly and a later stage second die assembly, a first mandrel coupled to the press structure of the first machine, a second mandrel coupled to the press structure of the first machine and spaced from the first mandrel further defined as an initial stage second mandrel and a later stage second mandrel, a third die assembly coupled to the fixed base of the second machine, and a third mandrel coupled to the press structure of the second machine, said method comprising the steps of:

placing a first billet into a cavity of the first die assembly;

placing a first pre-formed billet having a bore defined in one end thereof into a cavity of the initial stage second die assembly;

placing a first preliminarily extruded tube having a hollow interior into a cavity of the later stage second die assembly;

placing a first extruded tube into a cavity of the third die assembly;

moving the press structure of the first machine toward the fixed base after the steps of placing the first billet into the first die assembly, placing the first pre-formed billet into the initial stage second die assembly, and placing the first preliminarily extruded tube into the later stage second die assembly such that the first mandrel contacts the first billet in the first die assembly, the initial stage second mandrel contacts the first pre-formed billet in the initial stage second die assembly, and the later stage second mandrel contacts the first preliminarily extruded tube in the later stage second die assembly to complete the steps of;

forming the first billet within the cavity of the first die assembly to produce a second pre-formed billet having a bore defined in one end thereof, and extruding the first pre-formed billet within the cavity of the initial stage second die assembly to produce a second preliminarily extruded tube having a hollow interior;

extruding the first preliminarily extruded tube within the cavity of the later stage second die assembly to produce a second extruded tube;

moving the press structure of the second machine toward the fixed base after the step of placing the first extruded tube into the cavity of the third die assembly to complete the step of;

drawing the first extruded tube within the cavity of the third die assembly to produce a drawn tube having a wall that has a thickness that is reduced relative to the first extruded tube.

14. The method as set forth in claim 13 wherein the step of extruding the first pre-formed billet is further defined as the steps of backward extruding the first pre-formed billet with the initial stage second die assembly to elongate the first pre-formed billet and form the hollow interior therein thereby producing the second preliminarily extruded tube.

15. The method as set forth in claim 13, wherein the step of extruding the first preliminarily extruded tube is further defined as the step of backward extruding the first preliminarily extruded tube with the later stage second die assembly to further elongate the first preliminarily extruded tube thereby producing the extruded tube.

16. The method as set forth in claim 13, wherein a thickness of a wall of the drawn tube is from 3 to 12 millimeters and the drawn tube has a yield strength of at least 600 MPa.

17. The method as set forth in claim 16, wherein the yield strength of the drawn tube is at least 700 MPa.

18. The method as set forth in claim 13, further comprising a step of machining an end of the drawn tube to produce a full float hollow axle tube having a hollow interior that spans a length of the full float hollow axle tube.

19. The method as set forth in claim 13, wherein the drawn tube has a drawn wall having a thickness with the thickness of the drawn wall non-uniform about a circumference of the drawn tube.

20. A manufacturing system for manufacturing a tube that has a hollow interior for housing an axle shaft, which transmits rotational motion from a prime mover to a wheel of a vehicle, with said manufacturing system comprising:

a first machine comprising:

a fixed base;

a first die assembly coupled to said fixed base and defining a cavity therein with said first die assembly configured to form a bore in an end of a billet to produce a pre-formed billet;

an initial stage second die assembly coupled to said fixed based spaced from said first die assembly and defining a cavity therein with said initial stage second die assembly configured to extrude the pre-formed billet into a preliminarily extruded tube;

a later stage second die assembly coupled to said fixed based spaced from said initial stage second die assembly and defining a cavity therein with said later stage second die assembly configured to extrude the preliminarily extruded tube into an extruded tube;

a press structure moveable toward and then away from said fixed base with said press structure comprising;

a first mandrel aligned with said cavity of said first die assembly, and an initial stage second mandrel aligned with said cavity of said initial stage second die assembly;

a later stage second mandrel aligned with said cavity of said later stage second die assembly;

wherein said first mandrel and said initial and later stage second mandrels move simultaneously with each other as said press structure moves towards and then away from said fixed base such that said first mandrel enters said cavity of said first die assembly, said initial stage second mandrel enters said cavity of said initial stage second die assembly, and said later stage second mandrel enters said cavity of said later stage second die assembly as said press structure moves towards said fixed base; and a second machine comprising:

a fixed base;

a third die assembly coupled to said fixed base and defining a cavity therein, with said third die assembly configured to draw the extruded tube to produce a drawn tube;

a press structure moveable toward and then away from said fixed base with said press structure comprising;

a third mandrel coupled to said press structure and aligned with said cavity of said third die assembly;

wherein said third mandrels moves with said press structure as said press structure moves towards and away from said fixed base such that said third mandrel enters said cavity of said third die assembly as said press structure moves towards said fixed base.

* * * * *